US011842666B2

(12) United States Patent
Won et al.

(10) Patent No.: US 11,842,666 B2
(45) Date of Patent: Dec. 12, 2023

(54) METHOD AND APPARATUS FOR CONTROLLING LUMINANCE

(71) Applicant: SAMSUNG ELECTRONICS CO., LTD., Suwon-si (KR)

(72) Inventors: Kwanghyun Won, Suwon-si (KR); Hyungki Kim, Suwon-si (KR); Seunghyun Lee, Suwon-si (KR); Jaesung Lee, Suwon-si (KR); Sunil Lee, Suwon-si (KR); Jinsung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/750,078

(22) Filed: May 20, 2022

(65) Prior Publication Data

US 2022/0383791 A1 Dec. 1, 2022

Related U.S. Application Data

(63) Continuation of application No. PCT/KR2022/006747, filed on May 11, 2022.

(30) Foreign Application Priority Data

May 20, 2021 (KR) ..... 10-2021-0064978
Nov. 12, 2021 (KR) ..... 10-2021-0156054

(51) Int. Cl.
*G09G 3/20* (2006.01)

(52) U.S. Cl.
CPC ..... *G09G 3/20* (2013.01); *G09G 2300/023* (2013.01); *G09G 2320/0233* (2013.01);
(Continued)

(58) Field of Classification Search
CPC ..... G09G 2300/023; G09G 2320/0233; G09G 2320/0686; G09G 2360/145; G09G 3/20
See application file for complete search history.

(56) References Cited

U.S. PATENT DOCUMENTS 5,315,377 A 5/1994 Isono
7,532,272 B2 5/2009 Woodgate et al.
(Continued)

FOREIGN PATENT DOCUMENTS

CN 111624814 A 9/2020
JP 5-122733 A 5/1993
(Continued)

OTHER PUBLICATIONS

"Understanding Waveplates and Retarders," Go Edmund optics, Mar. 2021, from https://www.edmundoptics.com/knowledge-center/application-notes/optics/understanding-waveplates/, Total 6 pages.
(Continued)

*Primary Examiner* — Gerald Johnson
(74) *Attorney, Agent, or Firm* — Sughrue Mion, PLLC

(57) ABSTRACT

Provided is an electronic apparatus including a first display, a second display, a lens array between the first display and the second display, a first polarization modulation array between the first display and the lens array, a second polarization modulation array between the lens array and the second display, a memory, and at least one processor configured to identify a first area having a luminance lower than a reference luminance in the second display, identify, to control a first luminance of the first area in the second display to be the reference luminance, a first polarization angle variation corresponding to a first area in the first polarization modulation array and a second polarization angle variation corresponding to a first area in the second polarization modulation array, control the first polarization modulation array based on the first polarization angle varia-
(Continued)

tion, and control the second polarization modulation array based on the second polarization angle variation.

20 Claims, 89 Drawing Sheets

(52) U.S. Cl.
CPC ..... *G09G 2320/0686* (2013.01); *G09G 2360/145* (2013.01)

(56) References Cited

U.S. PATENT DOCUMENTS

| | | | | |
|---|---|---|---|---|
| 7,561,336 | B2 | 7/2009 | Takanobu | |
| 8,582,041 | B2 | 11/2013 | Tomizuka et al. | |
| 9,343,020 | B2 | 5/2016 | Heide et al. | |
| 10,062,345 | B2 | 8/2018 | Yim et al. | |
| 11,067,853 | B1 | 7/2021 | Xindong | |
| 2007/0164950 | A1 | 7/2007 | Tajiri | |
| 2008/0284792 | A1 | 11/2008 | Bell et al. | |
| 2019/0086724 | A1 | 3/2019 | Shih et al. | |
| 2020/0120316 | A1* | 4/2020 | Nakagoshi | G03B 21/00 |
| 2020/0241353 | A1 | 7/2020 | Lee et al. | |
| 2022/0099974 | A1* | 3/2022 | Han | G02B 27/286 |
| 2022/0180614 | A1* | 6/2022 | Staton | G09G 5/00 |
| 2022/0268974 | A1* | 8/2022 | Weindorf | G02B 5/0278 |

FOREIGN PATENT DOCUMENTS

| | | | |
|---|---|---|---|
| JP | 2007193113 | A | 8/2007 |
| JP | 200883463 | A | 4/2008 |
| JP | 4654570 | B2 | 3/2011 |
| KR | 1020100083706 | A | 7/2010 |
| KR | 1020160057592 | A | 5/2016 |

OTHER PUBLICATIONS

"Linear polarization," Wikipedia, Last edited Dec. 26, 2021, Total 3 pages, from https://en.wikipedia.org/wiki/Linear_polarization.
Niu et al., "High precision beam steering using a liquid crystal spatial light modulator," Optical and Quantum Electronics, vol. 51, No. 180, 2019, Total 13 pages.
"Polarization (waves)," Wikipedia, Last edited May 1, 2022, Total 24 pages, from https://en.wikipedia.org/wiki/Polarization_ (waves).
Waldman, "Introduction to Light: The Physics of Light, Vision, and Color," 2002, Total 1 page.
International Search Report and Written Opinion (PCT/ISA/220, 210, & 237) dated Aug. 18, 2022 by the International Searching Authority in International Application No. PCT/KR2022/006747.

* cited by examiner

FIG. 16B

| POL 1 & SECOND ROTATION ANGLE | 33° | 21.5° | 16.5° | 11.5° | 0° | −23.5° | −33.5° | −73.5° |
|---|---|---|---|---|---|---|---|---|
| LUMINANCE | 10601 | 11407 | 10952 | 10624 | 8513 | 5387 | 5880 | 10561 |

METHOD AND APPARATUS FOR CONTROLLING LUMINANCE

CROSS-REFERENCE TO RELATED APPLICATIONS

This application is a bypass continuation application of International Application No. PCT/KR2022/006747, filed on May 11, 2022, which is based on and claims the priority to Korean Patent Application No. 10-2021-0064978, filed on May 20, 2021, and Korean Patent Application No 10-2021-0156054, filed on Nov. 12, 2021, in the Korean Intellectual Property Office, the disclosures of which are incorporated by reference herein in their entireties.

BACKGROUND

1. Technical Field

The disclosure relates to a method of controlling a luminance and an electronic apparatus therefor.

2. Description of Related Art

With the development of displays allowing a user to view different images according to a viewing position, much attention has been paid to a method of effectively minimizing a reduction in a luminance.

In the case of a stack type display, a luminance may decrease as light passes through a plurality of spatial light modulators (SLMs) and an optical device. Particularly, when a lens array in the stack type display is formed of a material having a birefringence feature or has a birefringence feature due to stress applied during a manufacturing process, a luminance may not be uniform in the entire display.

SUMMARY

The disclosure provides a method of controlling a luminance and an electronic apparatus therefor.

According to an aspect of the disclosure, there is provided an electronic apparatus including a first display, a second display, a lens array between the first display and the second display, a first polarization modulation array between the first display and the lens array, a second polarization modulation array between the lens array and the second display, a memory configured to store at least one instruction, and at least one processor configured to execute the at least one instruction to identify a first area having a luminance lower than a reference luminance in the second display, identify, to control a first luminance of the first area in the second display to be the reference luminance, a first polarization angle variation corresponding to a first area in the first polarization modulation array and a second polarization angle variation corresponding to a first area in the second polarization modulation array, control the first polarization modulation array based on the first polarization angle variation, and control the second polarization modulation array based on the second polarization angle variation.

The at least one processor may be further configured to identify a second luminance of a reference area in the second display, identify, to maximize the second luminance, a third polarization angle variation corresponding to a reference area in the first polarization modulation array and a fourth polarization angle variation corresponding to a reference area in the second polarization modulation array, control the first polarization modulation array based on the third polarization angle variation, and control the second polarization modulation array based on the fourth polarization angle variation.

The reference luminance may be a maximum value of the second luminance.

To identify the third polarization angle variation and the fourth polarization angle variation, the at least one processor may be further configured to identify a difference value between a luminance of a reference area in the first display and the second luminance, and identify the third polarization angle variation and the fourth polarization angle variation to minimize the difference value.

The third polarization angle variation and the fourth polarization angle variation may be equal to an angle of a fast axis or an angle of a slow axis of the lens array with respect to an X-axis, the X-axis being a horizontal axis.

The electronic apparatus may further include a camera configured to identify the second luminance, wherein the at least one processor is further configured to identify the second luminance based on changing a viewing angle of the camera.

The first area may include one or more subpixels.

The at least one processor may be further configured to control a rotation angle of the lens array, and identify the first polarization angle variation and the second polarization angle variation based on the rotation angle of the lens array.

According to another aspect of the disclosure, there is provided a method performed by an electronic apparatus, the method including identifying a first area having a luminance lower than a reference luminance in a second display, identifying, to control a first luminance of the first area in the second display to be the reference luminance, a first polarization angle variation corresponding to a first area in a first polarization modulation array and a second polarization angle variation corresponding to a first area in a second polarization modulation array, controlling the first polarization modulation array based on the first polarization angle variation, and controlling the second polarization modulation array based on the second polarization angle variation.

The method may further include identifying a second luminance of a reference area in the second display, identifying, to maximize the second luminance, a third polarization angle variation corresponding to a reference area in the first polarization modulation array and a fourth polarization angle variation corresponding to a reference area in the second polarization modulation array, controlling the first polarization modulation array based on the third polarization angle variation, and controlling the second polarization modulation array based on the fourth polarization angle variation.

The reference luminance is a maximum value of the second luminance.

The identifying of the third polarization angle variation and the fourth polarization angle variation may include identifying a difference value between a luminance of a reference area in the first display and the second luminance, and identifying the third polarization angle variation and the fourth polarization angle variation to minimize the difference value.

The third polarization angle variation and the fourth polarization angle variation may be equal to an angle of a fast axis or a slow axis of a lens array with respect to an X-axis, the X-axis being a horizontal axis.

The identifying of the second luminance may include identifying the second luminance based on changing a viewing angle of a camera of the electronic apparatus to identify the second luminance.

The method may further include controlling a rotation angle of a lens array, wherein the identifying of the first polarization angle variation and the second polarization angle variation is based on the rotation angle of the lens array.

According to yet another aspect of the disclosure, there is provided a computer-readable recording medium storing a program for causing a computer to perform the method, the method including identifying a first area having a luminance lower than a reference luminance in a second display, identifying, to control a first luminance of the first area in the second display to be the reference luminance, a first polarization angle variation corresponding to a first area in a first polarization modulation array and a second polarization angle variation corresponding to a first area in a second polarization modulation array, controlling the first polarization modulation array based on the first polarization angle variation, and controlling the second polarization modulation array based on the second polarization angle variation.

According to yet another aspect of an example embodiment, there is provided an electronic apparatus including a first display, a second display, a lens array between the first display and the second display, a memory configured to store at least one instruction, and at least one processor configured to execute the at least one instruction to identify a luminance of the second display, identify, to maximize the luminance, a first rotation angle corresponding to a polarizer included in the first display and a second rotation angle corresponding to a polarizer included in the second display, rotate the polarizer in the first display based on the first rotation angle, and rotate the polarizer in the second display based on the second rotation angle.

The at least one processor may be further configured to rotate the lens array, and identify the first rotation angle and the second rotation angle based on a rotation angle of the lens array.

According to yet another aspect of the disclosure, there is provided a method performed by an electronic apparatus, the method including identifying a luminance of a second display, identifying, to maximize the luminance, a first rotation angle corresponding to a polarizer included in a first display and a second rotation angle corresponding to a polarizer included in the second display, rotating the polarizer in the first display based on the first rotation angle, and rotating the polarizer in the second display based on the second rotation angle.

The method may further include rotating a lens array, wherein the identifying of the first rotation angle and the second rotation angle is based on a rotation angle of the lens array.

BRIEF DESCRIPTION OF THE DRAWINGS

The above and/or other aspects will become apparent and more readily appreciated from the following description of embodiments, taken in conjunction with the accompanying drawings in which:

FIG. 16B is a diagram for describing a process of controlling a luminance by an electronic apparatus according to an embodiment of the disclosure;

DETAILED DESCRIPTION

Figure 1:
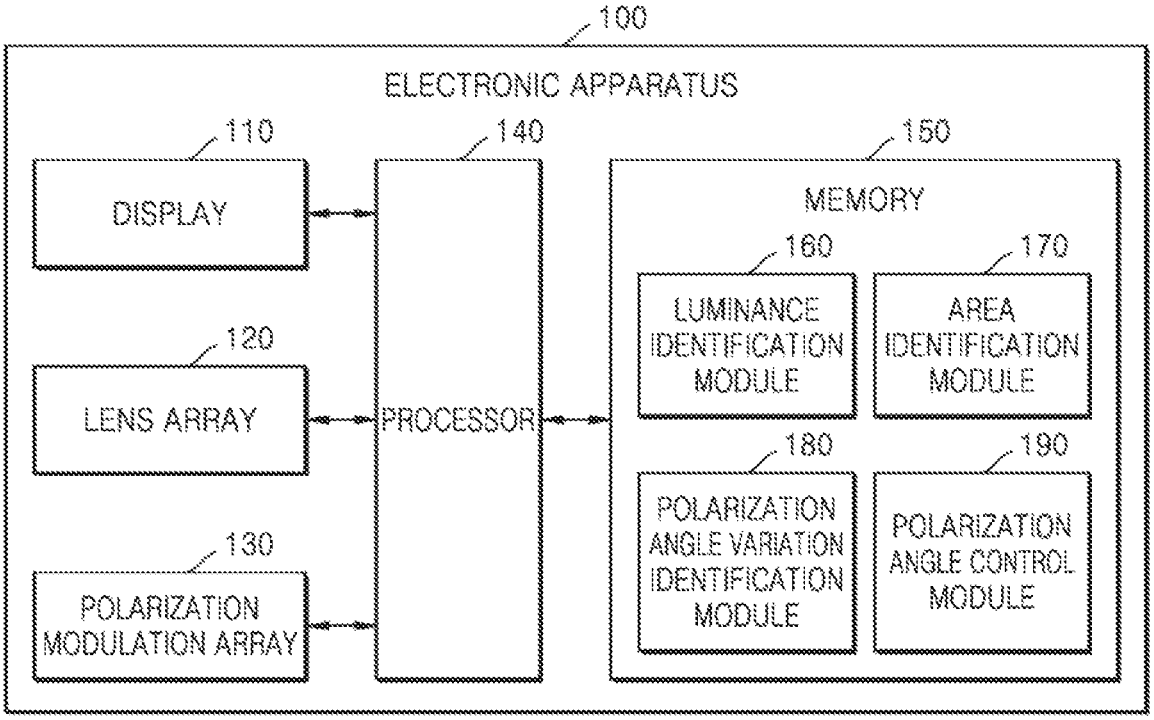
FIG. 1 is a block diagram of an electronic apparatus according to an embodiment of the disclosure.

Throughout the disclosure, the expression "at least one of a, b or c" indicates only a, only b, only c, both a and b, both a and c, both b and c, or all of a, b, and c.

Hereinafter, embodiments of the disclosure will be described in detail with reference to the accompanying drawings.

When embodiments of the disclosure are described herein, a description of techniques which are well known in the technical field to which the disclosure pertains and are not directly related to the disclosure will be omitted. This is to more clearly convey the gist of the disclosure by omitting unnecessary description.

For the same reason, some components are exaggerated, omitted, or schematically illustrated in the accompanying drawings. The size of each component does not entirely reflect the actual size thereof. The same reference numerals are allocated to the same or corresponding elements in each drawing.

Advantages and features of the disclosure and methods of achieving them will be apparent from embodiments of the disclosure described in detail below, in conjunction with the accompanying drawings. However, the disclosure is not limited to the embodiments of the disclosure below and may be embodied in many different forms. Rather, the embodiments of the disclosure are provided so that this disclosure will be thorough and complete and will fully convey the concept of the disclosure to those of ordinary skill in the art. The disclosure should be defined by the scope of the claims. The same reference numerals refer to the same components throughout the specification.

In this case, it will be understood that each block of process flowcharts and combinations of the flowcharts may be performed by computer program instructions. The computer program instructions may be installed in a processor of a general-purpose computer, special-purpose computer, or other programmable data processing equipment, so that means to perform functions described in blocks of each flowchart may be produced by instructions executed by the processor of the computer or the other programmable data processing equipment. The computer program instructions may be stored in a computer usable or readable memory oriented to a computer or other programmable data processing equipment to implement functions in a particular way. Thus, an article of manufacture, including an instruction means for performing the function described in a block (or blocks) of each flowchart, may be produced by the instructions stored in the computer usable or readable memory. Because the computer program instructions may be stored in a computer or other programmable data processing equipment, the functions of the blocks of each flowchart may be provided by the instructions performing a series of operations in the computer or the other programmable data processing equipment to produce a process executable by the computer to generate a computer programmable instructions to operate the computer or the other data processing equipment.

In addition, each block may represent a module, segment, or part of code that includes at least one executable instruction for executing specified logical function(s). It should be noted that in some alternative embodiments of the present disclosure, the functions described in the blocks may be performed in an order different from that described herein. For example, two blocks illustrated consecutively may be performed substantially simultaneously or performed in a reverse order according to functions corresponding thereto in some cases.

In the disclosure, a machine-readable storage medium may be provided in the form of a non-transitory storage medium. Here, the term "non-transitory storage medium" should be understood to mean a tangible device and to not include a signal (e.g., electromagnetic waves) but is not intended to distinguish between a case in which data is semi-permanently stored in the storage medium and a case in which data is temporarily stored in the storage medium. For example, the "non-transitory storage medium" may include a buffer in which data is temporarily stored.

In an embodiment of the disclosure, methods according to various embodiments of the disclosure may be provided by being included in a computer program product. The computer program product may be traded as a product between a seller and a purchaser. The computer program product may be distributed in the form of a storage medium (e.g., compact disc read only memory (CD-ROM)) that is readable by devices, may be distributed through an application store (e.g., Play Store™) or directly between two user devices (e.g., smartphones), or may be distributed online (e.g., by downloading or uploading). In the case of an online distribution, at least part of the computer program product (e.g., a downloadable application) may be at least temporarily stored or temporarily generated in a storage medium readable by devices such as the manufacturer's server, a server of an application store, or a memory of a relay server.

In the disclosure, a subpixel of one pixel may be understood to mean a subpixel of any one of R, G and B components constituting the pixel or a subpixel of any one of Y, U and V components constituting the pixel. In the disclosure, subpixels at certain positions in a plurality of images may be understood to mean subpixels of one of R, G, and B components or one of Y, U and V components of pixels at the same positions in the plurality of images. The above definitions are based on an assumption that an RGB format or a YUV format is employed in an embodiment of the disclosure, and a subpixel may be also understood to mean a subpixel of any color component when another color format is employed.

FIG. 1 is a block diagram of an electronic apparatus 100 according to an embodiment of the disclosure.

According to an embodiment of the disclosure, the electronic apparatus 100 may include a display 110, a lens array 120, a polarization modulation array 130, a processor 140, and a memory 150. However, components of the electronic apparatus 100 are not limited thereto, and the electronic apparatus 100 may further include other components or include some of the components.

The display 110 may display various types of content such as text, images, moving pictures, icons, or symbols. According to an embodiment of the disclosure, the display 110 may include, but is not limited to, at least one of a liquid crystal display (LCD), a light-emitting diode (LED) display, an organic LED (OLED) display, a micro-LED display, a digital micromirror device (DMD), or a liquid-crystal-on-silicon (LCoS) display device.

In an embodiment of the disclosure, the display 110 may include a plurality of displays. For example, the display 110 may include a first display and a second display.

The lens array 120 may include a field-of-view separator such as a lenticular lens to allow a user to view different images according to a viewing position. According to an embodiment of the disclosure, the lens array 120 may include a plurality of lenticular lenses having different pattern angles to realize a fine parallax.

The electronic apparatus 100 may control an angle of polarization of polarized light incident on the polarization modulation array 130. According to an embodiment of the disclosure, the electronic apparatus 100 may control an angle of polarization by differently setting a variation in an angle of variation in each of areas in the polarization modulation array 130 on which polarized light is incident. For example, the electronic apparatus 100 may change an angle of polarization of polarized light incident on a first area in the polarization modulation array 130 by a first polarization angle variation and an angle of polarization of polarized light incident on a second area in the polarization modulation array 130 by a second polarization angle variation.

According to an embodiment of the disclosure, the polarization modulation array 130 may be a liquid crystal spatial light modulator (LCSLM). According to another embodiment, the polarization modulation array 130 may be manufactured by removing a color filter, two polarizers, and a black matrix from a liquid crystal display, but is not limited thereto.

The processor 140 may execute at least one instruction stored in the memory 150 to control overall operations of the electronic apparatus 100.

For example, the processor 140 may identify (obtain) a first area in the second display having a luminance lower than a reference luminance.

The processor 140 may identify the first polarization angle variation, which corresponds to a first area in the first polarization modulation array, and the second polarization angle variation, which corresponds to a first area in the second polarization modulation array, for controlling a first luminance of the first area to be the reference luminance.

The processor 140 may control the first polarization modulation array, based on the first polarization angle variation.

The processor 140 may control the second polarization modulation array, based on the second polarization angle variation.

The memory 150 may include a luminance identification module 160, an area identification module 170, a polarization angle variation identification module 180, and a polarization angle control module 190.

The luminance identification module 160 may store instructions for identifying a luminance of a reference area in the second display.

The area identification module 170 may store instructions for identifying a first area in the second display having a luminance lower than the reference luminance.

The polarization angle variation identification module 180 may store instructions for identifying the first polarization angle variation, which corresponds to the first area in the first polarization modulation array, and the second polarization angle variation, which corresponds to the first area in the second polarization modulation array, for controlling the first luminance of the first area to be the same as the reference luminance.

The polarization angle control module 190 may store instructions for controlling the first polarization modulation array, based on the first polarization angle variation, and controlling the second polarization modulation array, based on the second polarization angle variation.

Figure 2A:
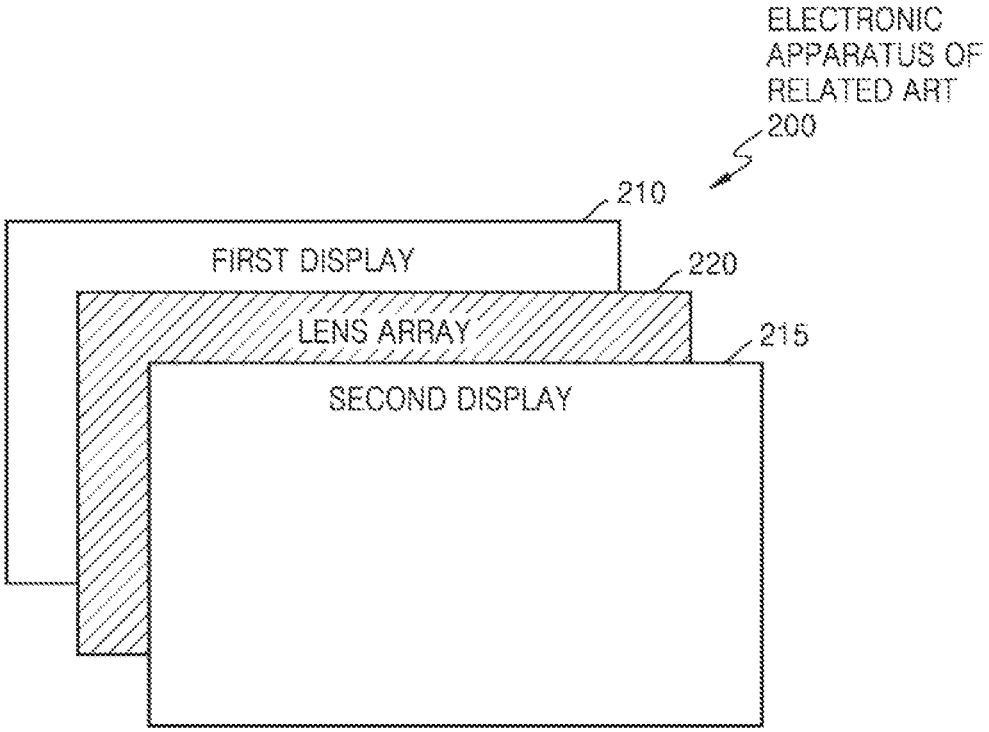
FIG. 2A illustrates an example of an electronic apparatus of the related art.
Figure 2B:
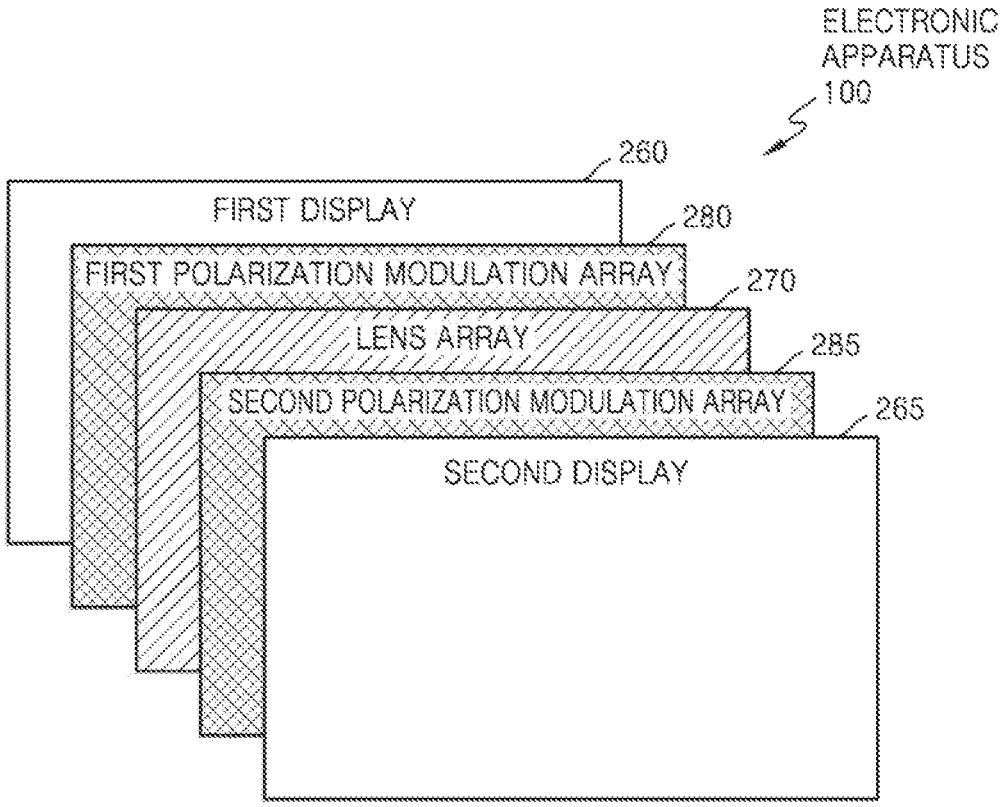
FIG. 2B illustrates an example of an electronic apparatus according to an embodiment of the disclosure.

FIGS. 2A and 2B illustrate examples of an electronic apparatus according to embodiments of the disclosure.

FIG. 2A illustrates a configuration of an electronic apparatus 200 of the related art. The electronic apparatus 200 of the related art may include a first display 210, a second display 215, and a lens array 220. In this case, the lens array 220 may be positioned between the first display 210 and the second display 215.

In an embodiment of the disclosure, the lens array 220 may be formed of a material having a birefringence feature or may have the birefringence feature due to stress applied during a manufacturing process. The birefringence features of the lens array 220 may be changed due to stress applied during the manufacturing process. Accordingly, an angle of polarization of polarized light incident on the lens array 220 and a state of the polarized light may change when the polarized light passes through the lens array 220, and a luminance of the polarized light having passed through the lens array 220 may decrease when the polarized light passes through the second display 215.

Areas in the lens array 220 may have different birefringence features due to stress applied during the manufacturing process. In this case, the different birefringence features of the areas may be understood to mean that the areas are different from one another in terms of a fast axis and a slow axis. A change of an angle and state of polarized light incident on each of the areas and a degree of reduction in a luminance of each of the areas may be different from those of the other areas due to the different birefringence features of the areas, as will be described with reference to FIGS. 3A to 3D below.

FIG. 2B illustrates a configuration of an electronic apparatus 100 according to an embodiment of the disclosure. According to an embodiment of the disclosure, the electronic apparatus 100 may include a first display 260, a second display 265, a lens array 270, a first polarization modulation array 280, and a second polarization modulation array 285. In this case, the lens array 270 may be positioned between the first display 260 and the second display 265. The first polarization modulation array 280 may be positioned between the first display 260 and the lens array 270, and the second polarization modulation array 285 may be positioned between the lens array 270 and the second display 265.

According to an embodiment of the disclosure, the first display 260 and the second display 265 may correspond to the display 110 of FIG. 1, the lens array 270 may correspond to the lens array 120 of FIG. 1, and the first polarization modulation array 280 and the second polarization modulation array 285 may correspond to the polarization modulation array 130 of FIG. 1.

According to an embodiment of the disclosure, in order to improve a reduced luminance due to a birefringence feature of the lens array 270, the electronic apparatus 100 may control the first polarization modulation array 280 and the second polarization modulation array 285 to control an angle of polarization of polarized light incident on the lens array 270.

According to an embodiment, the electronic apparatus 100 may control a luminance of output light to be uniform by differently controlling a variation in an angle of polarization in areas in the first polarization modulation array 280 and the second polarization modulation array 285 on which polarized light is incident, as will be described with reference to FIGS. 4A to 4D below.

An area in the lens array 270 may include one or more subpixels, but is not limited thereto.

FIGS. 3A to 3D illustrate an operation of an electronic apparatus 200 of the related art.

Figure 3A:
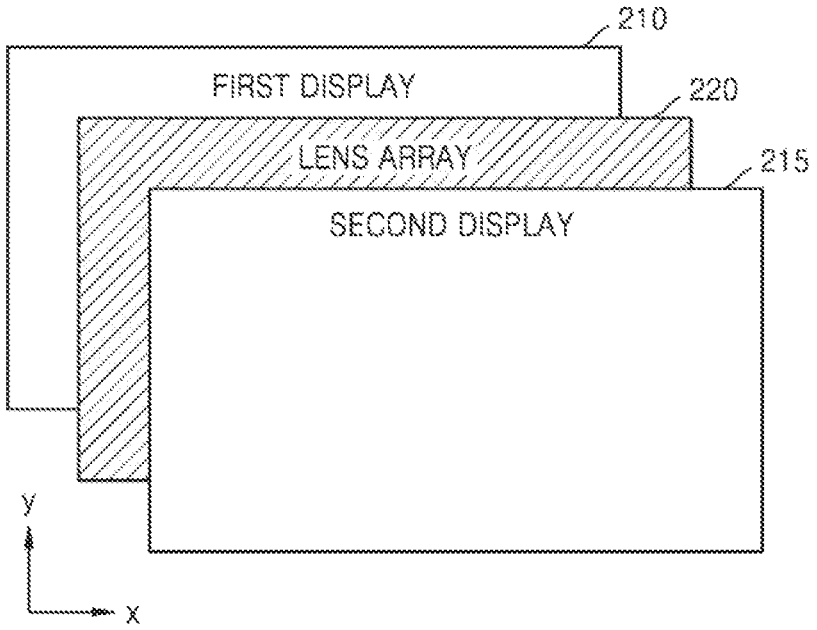
FIG. 3A illustrates an operation of an electronic apparatus of the related art.

FIG. 3A illustrates a configuration of an electronic apparatus 200 of the related art. The electronic apparatus 200 of the related art may include a first display 210, a second display 215, and a lens array 220. In this case, the lens array 220 may be positioned between the first display 210 and the second display 215. However, components of the electronic apparatus 200 of the related art are not limited thereto, and the electronic apparatus 200 may further include other components or include some of the components.

Figure 3B:
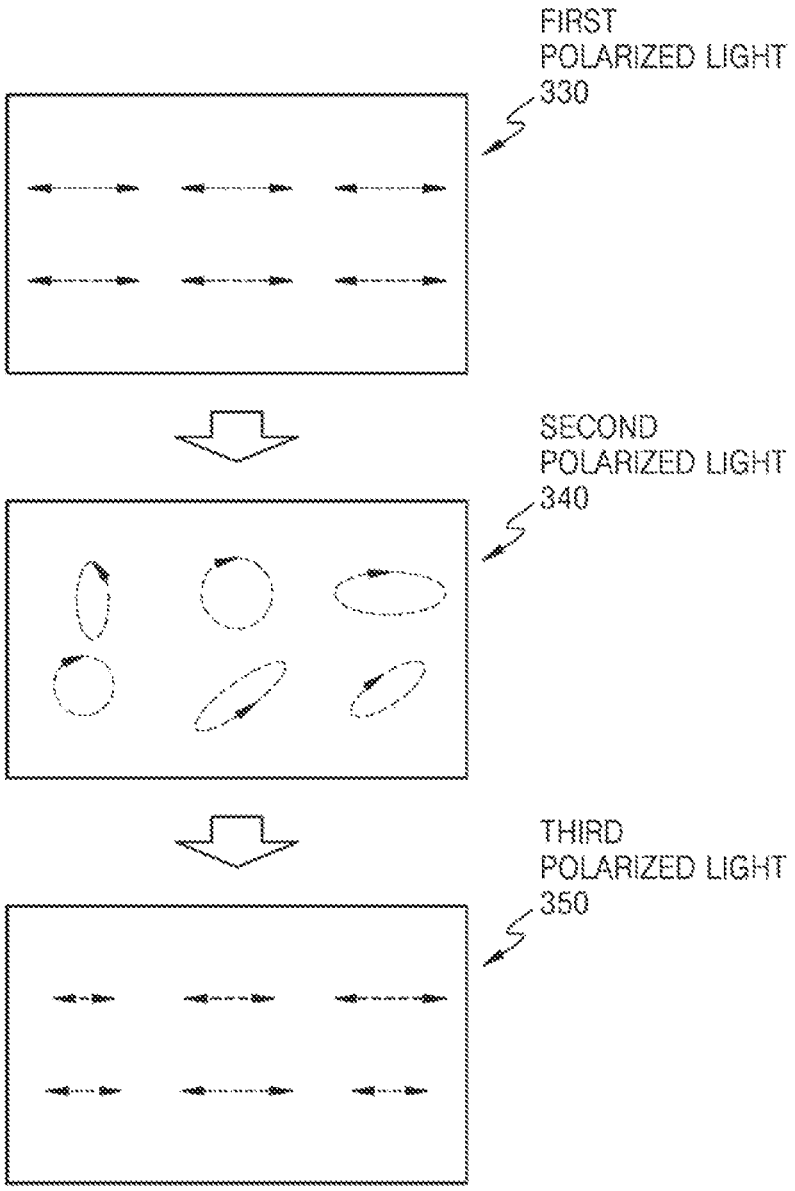
FIG. 3B illustrates an operation of an electronic apparatus of the related art.

FIG. 3B illustrates examples of polarized light having passed through each components of the electronic apparatus 200 of the related art. Pieces of first polarized light 330 are examples of a component having passed through the first display 210 among a plurality of components of light from backlight unit, pieces of second polarized light 340 are examples of polarized light after the pieces of first polarized light 330 pass through the lens array 220, and pieces of polarized light 350 are examples a component having passed through the second display 215 among a plurality of components of the pieces of second polarized light 340.

The pieces of first polarized light 330 may be pieces of linear polarized light having the same intensity and angle of polarization. For example, when all of pieces of light from the backlight are pieces of white light, only a component parallel to an orientation of a gap in a polarizer in the first display 210 among components of the pieces of white light may pass through the first display 210. Accordingly, the pieces of first polarized light 330 may be pieces of linear polarized light that have the same intensity and form an angle of 0° with respect to an X-axis.

The pieces of second polarized light 340 may be linear polarized light, circular polarized light or elliptical polarized light. For example, due to the birefringence feature of the lens array 220, linear polarized light may change into linear polarized light, circular polarized light, or elliptical polarized light when passing through the lens array 220. In this case, areas in the lens array 220 may have different birefringence features due to stress applied during a manufacturing process and thus the pieces of second polarized light 340 may be pieces of linear, circular or elliptical polarized light having different intensities, shapes and/or directions of rotation.

The pieces of third polarized light 350 may be pieces of linear polarized light having different intensities and the same angle of polarization. For example, when the pieces of second polarized light 340 are pieces of circular or elliptical polarized light having different intensities, shapes and directions of rotation, only a component parallel to the orientation of the gap in the polarizer in the second display 215 among the components of the pieces of second polarized light 340 may pass through the second display 215. As the pieces of second polarized light 340 are different from one another in terms of a shape and direction of rotation, the amplitudes of components of the pieces of second polarized light 340 parallel to the orientation of the gap in the polarizer in the second display 215 are different from one another and thus the pieces of third polarized light 350 may be pieces of linear polarized light that have different intensities and form an angle of 0° with the X-axis.

Figure 3C:
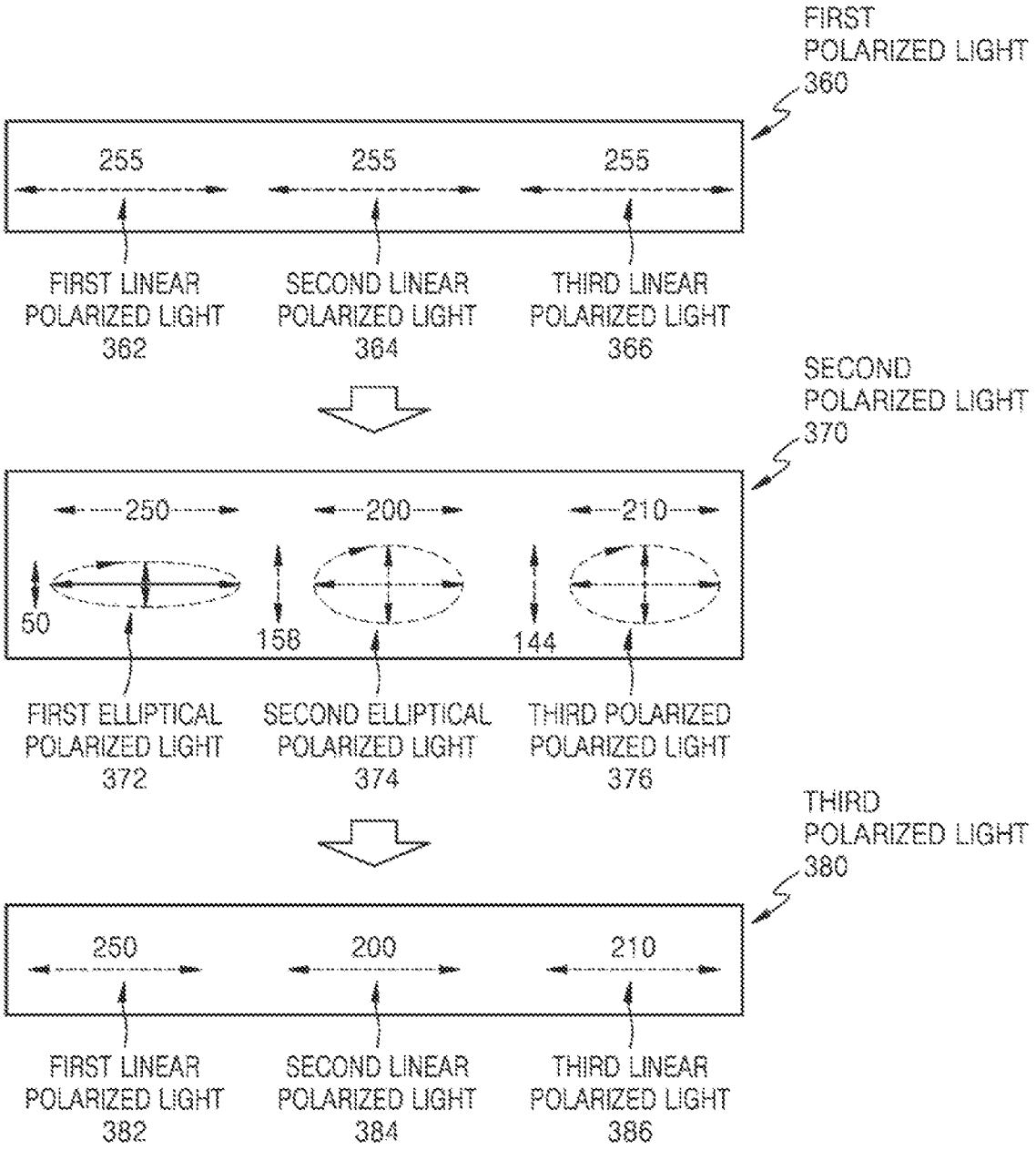
FIG. 3C illustrates an operation of an electronic apparatus of the related art.

FIG. 3C illustrates examples of polarized light having passed through components of the electronic apparatus 200 of the related art. Pieces of first polarized light 360 are examples of a component having passed through the first display 210 among a plurality of components of light from a backlight unit, pieces of second polarized light 350 are examples of polarized light after the pieces of first polarized light 360 pass through the lens array 220, and pieces of polarized light 380 are examples a component having passed through the second display 215 among a plurality of components of the pieces of second polarized light 370.

The pieces of first polarized light 360 may be pieces of linear polarized light having the same intensity and angle of polarization. For example, when pieces of light from the backlight are pieces of white light corresponding to three pixels, only a component parallel to an orientation of a gap in a polarizer in the first display 210 among components of the pieces of white light may pass through the first display 210. Accordingly, the pieces of first polarized light 360 may be pieces of the first linear polarized light 362, the second linear polarized light 364, and the third linear polarized light 366 that have an amplitude of 255 and form an angle of 0° with respect to an X-axis.

The pieces of second polarized light 370 may be linear polarized light, circular polarized light or elliptical polarized light. In this case, areas in the lens array 220 may have different birefringence features and the pieces of the first linear polarized light 362, the second linear polarized light 364, and the third linear polarized light 366 may change into pieces of circular polarized light having different intensities and shapes when passing through the areas in the lens array 220.

For example, the first linear polarized light 362 may change into first elliptical polarized light 372 having an amplitude of 250 in an X-axis direction and an amplitude of 20 in a Y-axis direction when passing through the lens array 220. The second linear polarized light 364 may change into second elliptical polarized light 374 having an amplitude of 200 in the X-axis direction and an amplitude of 158 in the Y-axis direction when passing through the lens array 220. The third linear polarized light 366 may change into third elliptical polarized light 376 having an amplitude of 210 in the X-axis direction and an amplitude of 144 in the Y-axis direction when passing through the lens array 220.

The pieces of third polarized light 380 may be pieces of linear polarized light having different intensities and the same angle of polarization. When the pieces of second polarized light 370 are pieces of circular or elliptical polarized light having different intensities, shapes and directions of rotation, only a component parallel to the orientation of the gap in the polarizer in the second display 215 among the components of the pieces of second polarized light 370 may pass through the second display 215.

For example, when the orientation of the gap in the polarizer in the second display 215 forms an angle of 0° with the X-axis, only components parallel to the X-axis among a plurality of components of the pieces of second polarized light 370 may pass through the second display 215. Accordingly, only first linear polarized light 382 that have an amplitude of 250 in the X-axis direction and form an angle of 0° with the X-axis among components of the first elliptical polarized light 372 may pass through the second display 215. Likewise, only second linear polarized light 384 that have an amplitude of 200 in the X-axis direction and form an angle of 0° with the X-axis among components of the second elliptical polarized light 374 may pass through the second display 215, and only third linear polarized light 386 that have an amplitude of 210 in the X-axis direction and form an angle of 0° with the X-axis among components of the third elliptical polarized light 376 may pass through the second display 215.

Figure 3D:
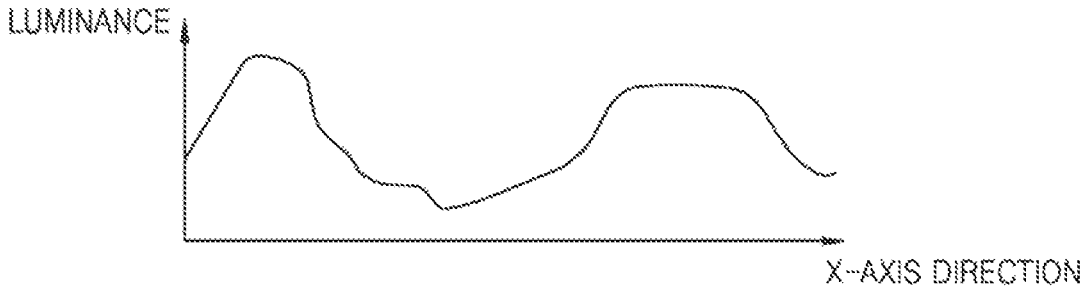
FIG. 3D illustrates an operation of an electronic apparatus of the related art.

FIG. 3D illustrates examples of a luminance of the electronic apparatus 200 of the related art on an X-axis. As described above with respect to FIGS. 3B and 3C, an amplitude of light having passed through the second display may decrease due to a birefringence feature of a lens array in the electronic apparatus 200 of the related art and thus the luminance of the electronic apparatus 200 may decrease.

When areas in the lens array have different birefringence features, degrees of reduction in luminance of the areas may be different from each other. For example, referring to FIG. 3D, a luminance on the X-axis may vary according to a birefringence feature of the lens array in the electronic apparatus 200 of the related art. A luminance on the Y-axis may vary according to the birefringence feature of the lens array in the electronic apparatus 200 of the related art.

FIGS. 4A to 4D illustrate an operation of an electronic apparatus 100 according to an embodiment of the disclosure.

Figure 4A:
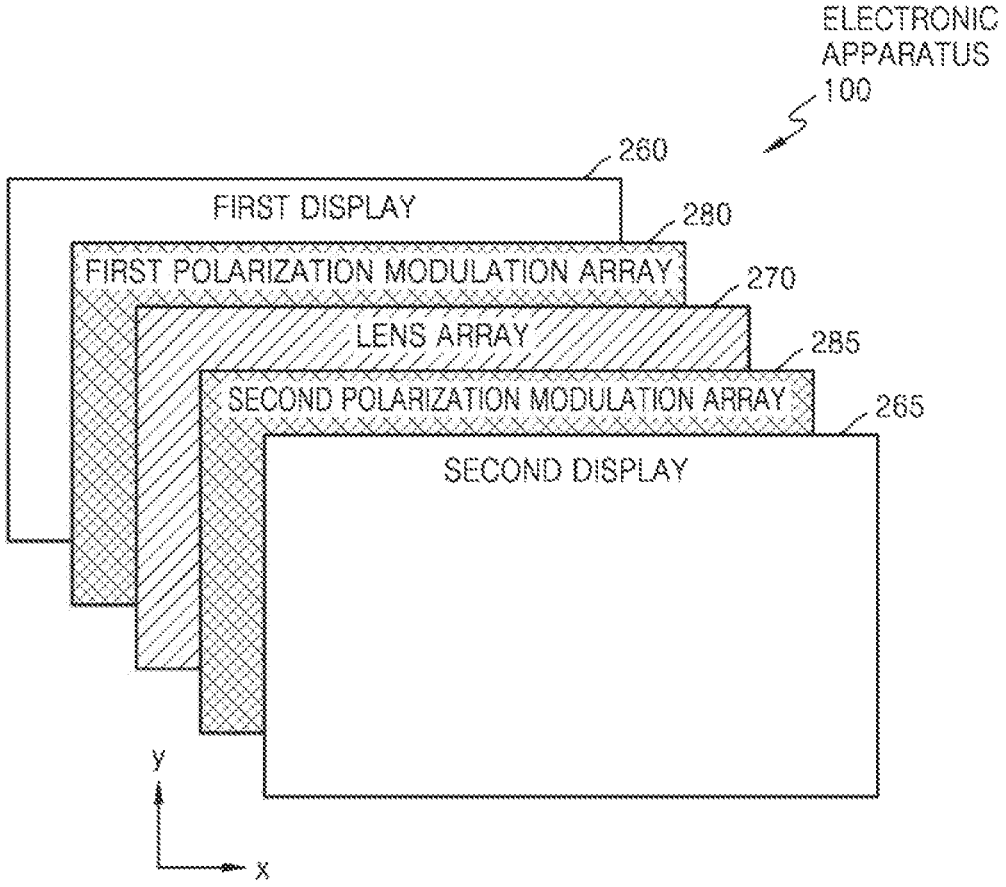
FIG. 4A illustrates an operation of an electronic apparatus according to an embodiment of the disclosure.

FIG. 4A illustrates a configuration of an electronic apparatus 100 according to an embodiment of the disclosure. According to an embodiment of the disclosure, the electronic apparatus 100 may include a first display 260, a second display 265, a lens array 270, a first polarization modulation array 280, and a second polarization modulation array 285. In this case, the lens array 270 may be positioned between the first display 260 and the second display 265. The first polarization modulation array 280 may be positioned between the first display 260 and the lens array 270, and the second polarization modulation array 285 may be positioned between the lens array 270 and the second display 265.

Figure 4B:
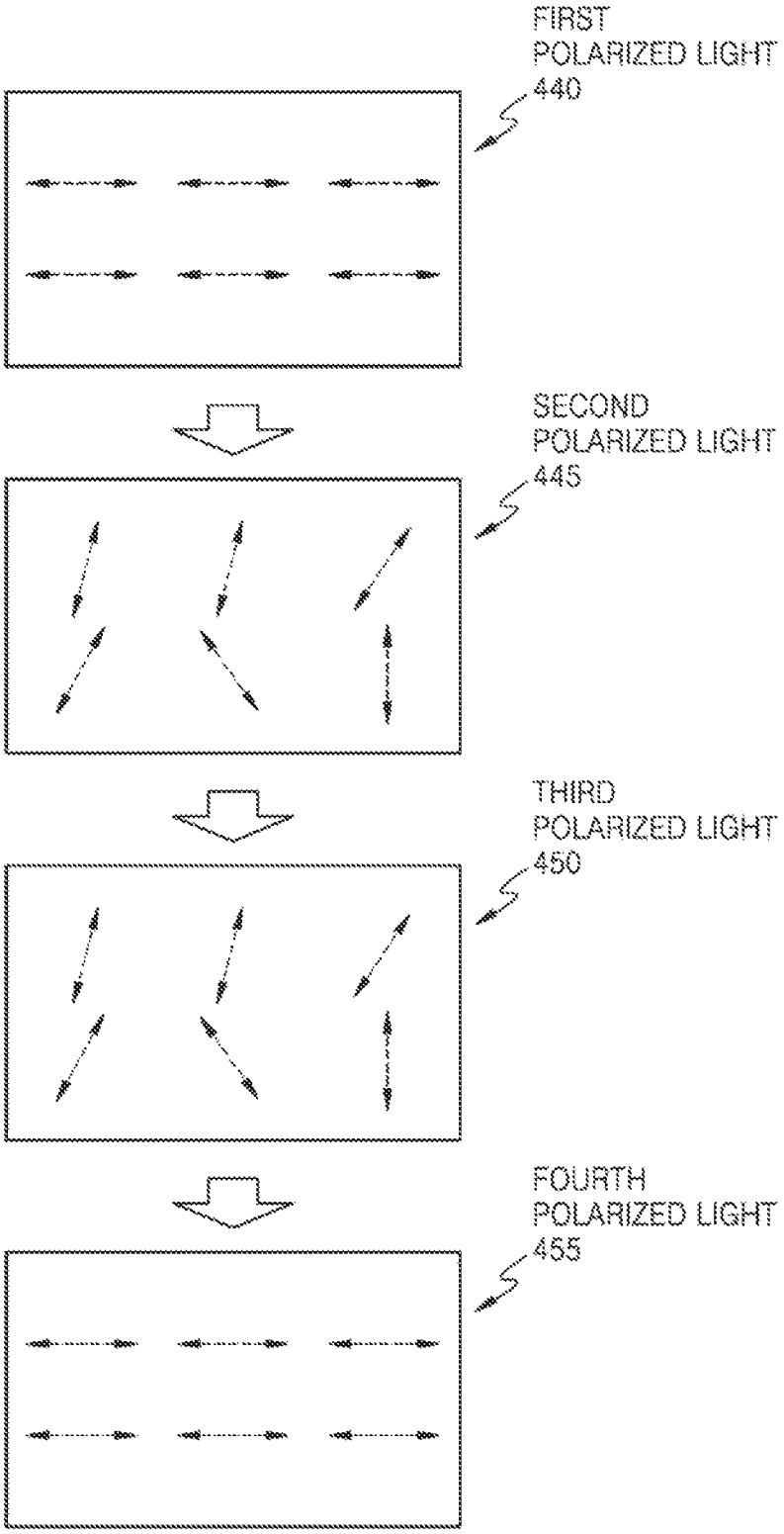
FIG. 4B illustrates an operation of an electronic apparatus according to an embodiment of the disclosure.

FIG. 4B illustrates examples of polarized light having passed through components of the electronic apparatus 100. Pieces of first polarized light 440 are examples of a component having passed through the first display 260 among a plurality of components of light from a backlight, and pieces of second polarized light 445 are examples of polarized light after the pieces of first polarized light 440 pass through the first polarization modulation array 280. Pieces of third polarized light 450 are examples of polarized light after the pieces of second polarized light 445 pass through the lens array 270, and pieces of fourth polarized light 455 are examples of polarized light after the pieces of third polarized light 450 pass through the second polarization modulation array 285.

According to an embodiment of the disclosure, the pieces of first polarized light 440 may be pieces of linear polarized light having the same intensity and angle of polarization. For example, when all of pieces of light from the backlight are pieces of white light, only a component parallel to an orientation of a gap in a polarizer in the first display 260 among components of the pieces of white light may pass through the first display 260. Accordingly, the pieces of first polarized light 440 may be pieces of linear polarized light that have the same intensity and form an angle of 0° with respect to an X-axis.

According to an embodiment of the disclosure, the pieces of second polarized light 445 may be pieces of linear polarized light having the same intensity and different angles of polarization. The electronic apparatus 100 may change only an angle of polarization of polarized light incident on the first polarization modulation array 280 while maintaining the intensity of the polarized light. The electronic apparatus 100 may adjust the angle of polarization of the incident polarized light by differently changing a polarization angle variation of each area in the first polarization modulation array 280. Accordingly, the pieces of second polarized light 445 may be pieces of linear polarized light having different polarization angles according to an incident area.

A polarization angle variation corresponding to each area in the first polarization modulation array 280 may be understood to mean a value for allowing a luminance of the electronic apparatus 100 to be equal to a reference luminance. For example, the pieces of second polarized light 445 may be parallel to a fast axis or a slow axis in each area in the lens array as an angle of polarization of polarized light incident on each area in the first polarization modulation array 280 is adjusted based on a polarization angle variation.

According to an embodiment of the disclosure, the pieces of third polarized light 450 may be pieces of linear polarized light having the same intensity and different angles of polarization. For example, when a first area in the lens array 270 has a quarter-wave plate feature, an intensity of and angle of polarization of polarized light having passed through the first area may be maintained. When a second area in the lens array 270 has a half-wave plate feature, an intensity of polarized light having passed through the second area may be maintained but an angle of polarization may change. Accordingly, the pieces of third polarized light 450 may have the same intensity as the pieces of second polarized light 445 and an angle of polarization that is the same as or different from the angle of polarization of the pieces of second polarized light 445.

According to an embodiment of the disclosure, the pieces of fourth polarized light 455 may be pieces of linear polarized light having the same intensity and angle of polarization. The electronic apparatus 100 may change only an angle of polarization of polarized light incident on the second polarization modulation array 285 while maintaining the intensity of the polarized light. The electronic apparatus 100 may adjust the angle of polarization of the incident polarized light by differently changing a polarization angle variation of each area in the second polarization modulation array 285.

The polarization angle variation corresponding to each area in the second polarization modulation array 285 may be understood to mean a value for allowing the pieces of fourth polarized light 455 to be parallel to an orientation of a gap in the polarizer in the second display 265. For example, when the orientation of the gap in the polarizer in the second display 265 forms an angle of 0° with the X-axis, an angle of polarization of polarized light incident on each area in the second polarization modulation array 285 may be adjusted and thus the pieces of fourth polarized light 455 may have the same intensity and form an angle of 0° with the X-axis.

Figure 4C:
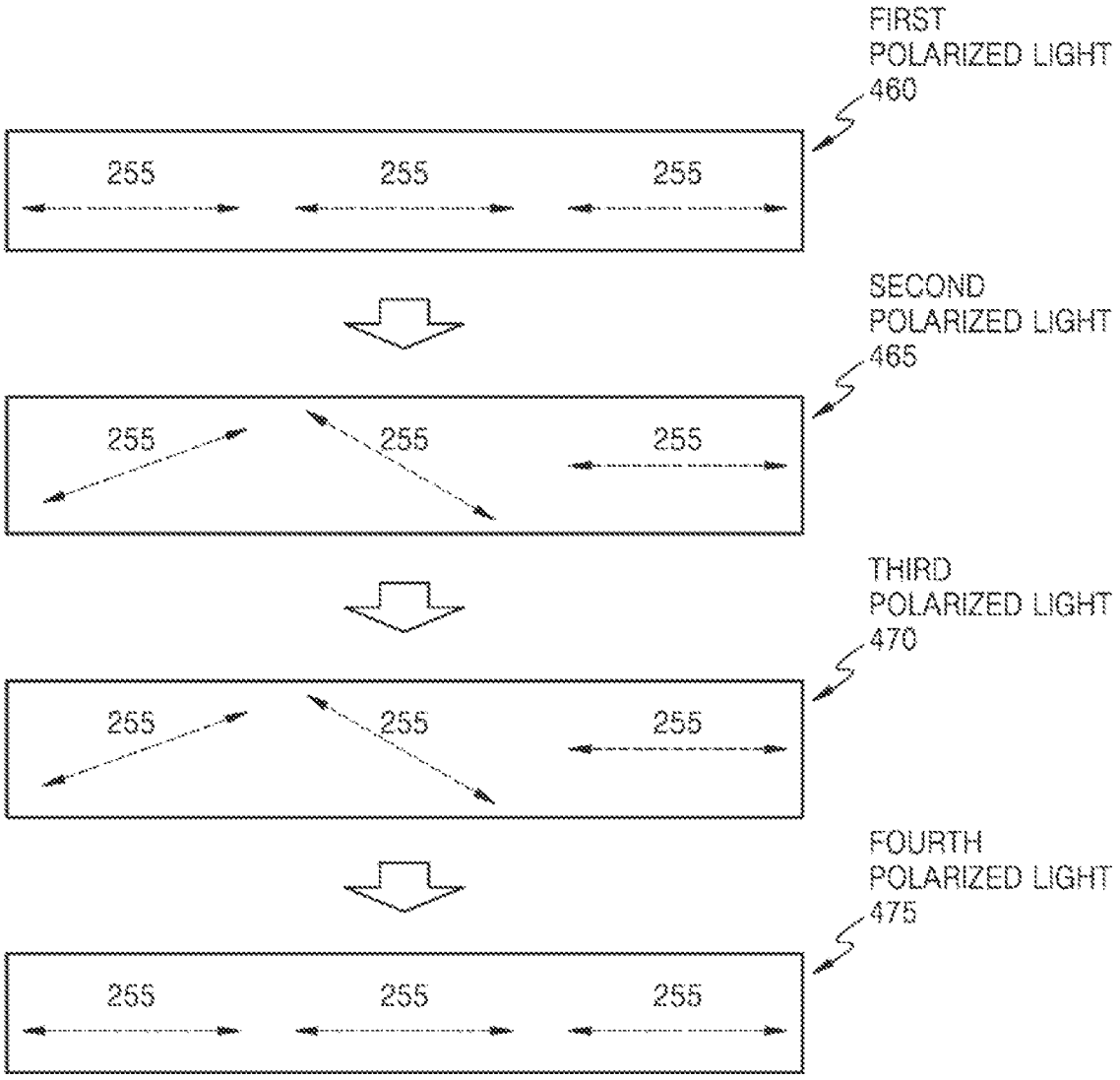
FIG. 4C illustrates an operation of an electronic apparatus according to an embodiment of the disclosure.

FIG. 4C illustrates examples of polarized light having passed through components of the electronic apparatus 100. Pieces of first polarized light 460 are examples of a component having passed through the first display 260 among a plurality of components of light from a backlight unit, and pieces of second polarized light 465 are examples of polarized light after the pieces of first polarized light 440 pass through the first polarization modulation array 280. Pieces of third polarized light 470 are examples of polarized light after the pieces of second polarized light 465 pass through the lens array 270, and pieces of fourth polarized light 475 are examples of polarized light after the pieces of third polarized light 470 pass through the second polarization modulation array 285.

According to an embodiment of the disclosure, the pieces of first polarized light 460 may be pieces of linear polarized light having the same intensity and angle of polarization. For example, when pieces of light from the backlight are pieces of white light corresponding to three pixels, only a component parallel to an orientation of a gap in a polarizer in the first display 260 among components of the pieces of white light may pass through the first display 260. Accordingly, the pieces of first polarized light 460 may be pieces of linear polarized light that have an amplitude of 255 and form an angle of 0° with the X-axis.

According to an embodiment of the disclosure, the pieces of second polarized light 465 may be pieces of linear polarized light having the same intensity and different angles of polarization. For example, the electronic apparatus 100 may adjust an angle of polarization of incident polarized light by differently setting a polarization angle variation for each area in the first polarization modulation array 280 and thus the pieces of second polarized light 465 may be pieces of linear polarized light that have an amplitude of 255 and form different angles with the X-axis.

According to an embodiment of the disclosure, the pieces of third polarized light 470 may be pieces of linear polarized light having the same intensity and different angles of polarization. For example, when the lens array 270 has the quarter-wave plate feature, the pieces of third polarized light 470 may be pieces of linear polarized light having an amplitude of 255 and the same angle of polarization as the pieces of second polarized light 465.

According to an embodiment of the disclosure, the pieces of fourth polarized light 475 may be pieces of linear polarized light having the same intensity and angle of polarization. For example, the electronic apparatus 100 may adjust an angle of polarization of incident polarized light by differently setting a polarization angle variation for each area in the second polarization modulation array 285 and thus the pieces of fourth polarized light 475 may be pieces of linear polarized light that have an amplitude of 255 and form an angle of 0° with the X-axis.

Figure 4D:
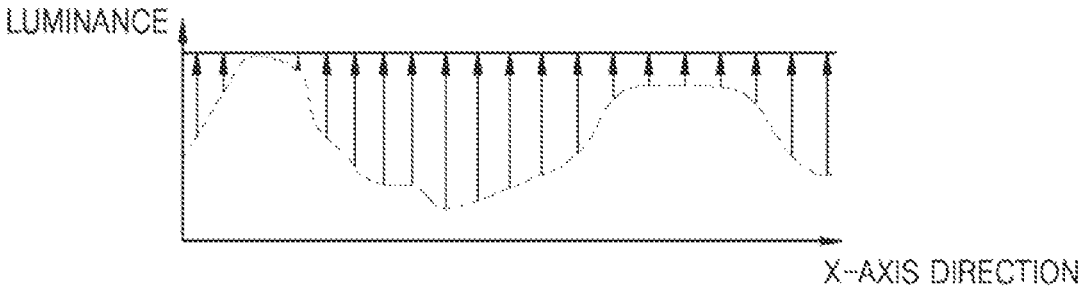
FIG. 4D illustrates an operation of an electronic apparatus according to an embodiment of the disclosure.

FIG. 4D illustrates examples of a luminance of the electronic apparatus 100 on an X-axis. As described above with respect to FIGS. 4B and 4C, the electronic device 100 may adjust an angle of polarization of polarized light, based on a polarization angle variation for each area in the first polarization modulation array 280 and the second polarization modulation array 285, thereby maintaining an intensity of light passing through the electronic apparatus 100. Accordingly, the electronic apparatus 100 may have the same luminance regardless of an area.

For example, as an angle of polarization of polarized light incident on the first polarization modulation array 280 and the second polarization modulation array 285 may be adjusted, so that a luminance on the X-axis may be the same. The electronic apparatus 100 may adjust an angle of polarization of polarized light incident on the first polarization modulation array 280 and the second polarization modulation array 285, so that a luminance on the Y-axis may be the same.

FIGS. 5A to 5H are diagrams for describing a process of controlling a luminance by the electronic apparatus 100 according to an embodiment of the disclosure.

Figure 5A:
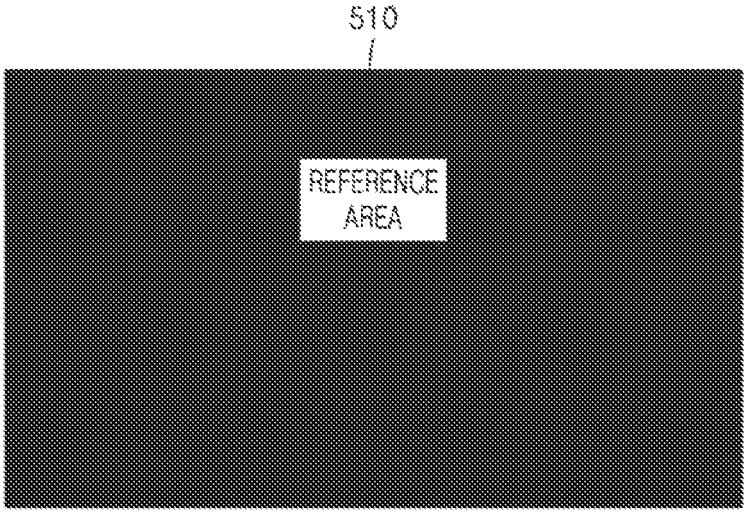
FIG. 5A is a diagram for describing a process of controlling a luminance by an electronic apparatus according to an embodiment of the disclosure.

Referring to FIG. 5A, according to an embodiment of the disclosure, the electronic apparatus 100 may set polarization angle variations of the first polarization modulation array 280 and the second polarization modulation array 285 to an initial value and identify a luminance of a reference area 510 in a second display. For example, the electronic apparatus 100 may set polarization angle variations of the first polarization modulation array 280 and the second polarization modulation array 285 to the an initial value and identify a luminance of the reference area 510 when white light is generated from backlight. The initial value of the polarization angle variations may be set, based on previous data, but embodiments of the disclosure are not limited thereto.

Figure 5B:
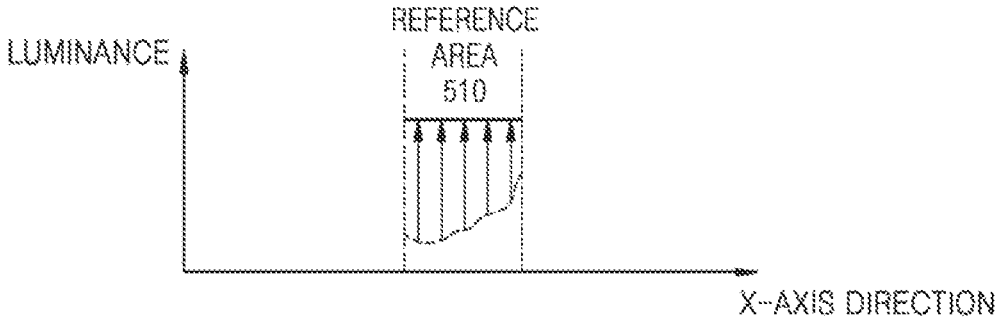
FIG. 5B is a diagram for describing a process of controlling a luminance by an electronic apparatus according to an embodiment of the disclosure.

FIG. 5B illustrates an example of a luminance of a reference area that reduces due to a birefringent feature of the lens array 270 in the electronic apparatus 100. According to an embodiment of the disclosure, the electronic apparatus 100 may identify a third polarization angle variation corresponding to a reference area in the first polarization modulation array 280 and a fourth polarization angle variation corresponding to a reference area in the second polarization modulation array 285 for maximizing the luminance of the reference area 510. Thereafter, the electronic apparatus 100 may control the first polarization modulation array 280, based on the third polarization angle variation, and control the second polarization modulation array 285 based on the fourth polarization angle variation, thereby maximizing the luminance of the reference area 510. For example, the electronic apparatus 100 may appropriately adjust a polarization angle variation corresponding to reference areas in the first polarization modulation array 280 and the second polarization modulation array 285, so that the reference area 510 may uniformly have a maximum luminance on the X-axis as shown in FIG. 5B.

Figure 5C:
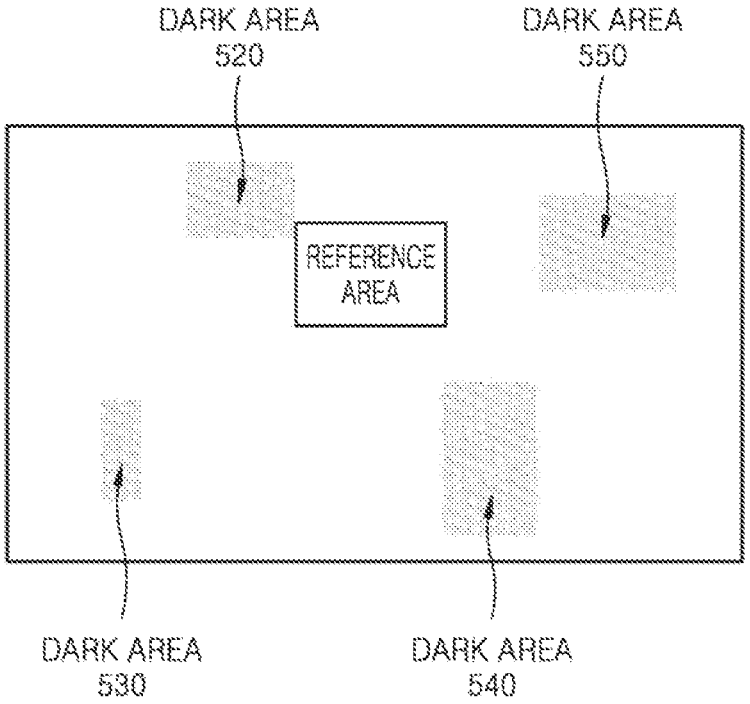
FIG. 5C is a diagram for describing a process of controlling a luminance by an electronic apparatus according to an embodiment of the disclosure.

Referring to FIG. 5C, according to an embodiment of the disclosure, the electronic apparatus 100 may identify an area having a luminance lower than a luminance of the reference area 510 or a reference luminance. For example, the electronic apparatus 100 may identify luminance of areas other than the reference area 510 when white light is generated from backlight unit and identify at least one area having a luminance lower than a reference luminance. Referring to FIG. 5C, the electronic apparatus 100 may identify four dark areas 520 to 550 having luminance lower than the reference luminance.

Figure 5D:
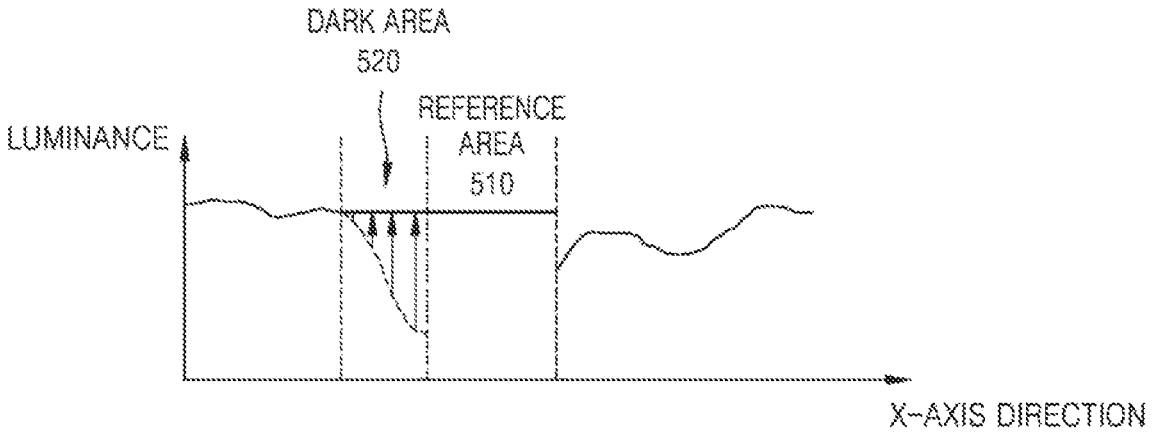
FIG. 5D is a diagram for describing a process of controlling a luminance by an electronic apparatus according to an embodiment of the disclosure.

FIG. 5D illustrates examples of identified luminance of all areas in the second display 265. In this case, as areas in the lens array 270 have different birefringence features, luminance of the second display 265 may change along the X-axis as shown in FIG. 5D.

According to an embodiment of the disclosure, the electronic apparatus 100 may identify a first polarization angle variation corresponding to a dark area in the first polarization modulation array 280 and a second polarization angle variation corresponding to a dark area in the second polarization modulation array 285 for controlling a luminance of a dark area in the electronic apparatus 100 to be the same as a reference luminance. Thereafter, the electronic apparatus 100 may control the first polarization modulation array 280, based on the first polarization angle variation, and control the second polarization modulation array 285 based on the second polarization angle variation, so that the luminance of the dark area may be the same as the reference luminance. For example, the electronic apparatus 100 may appropriately adjust a polarization angle variation corresponding to the dark area 520 in the first polarization modulation array 280 and the second polarization modulation array 285, so that a luminance of the dark area 520 may be the same as a luminance of a reference area as shown in FIG. 5D.

Figure 5E:
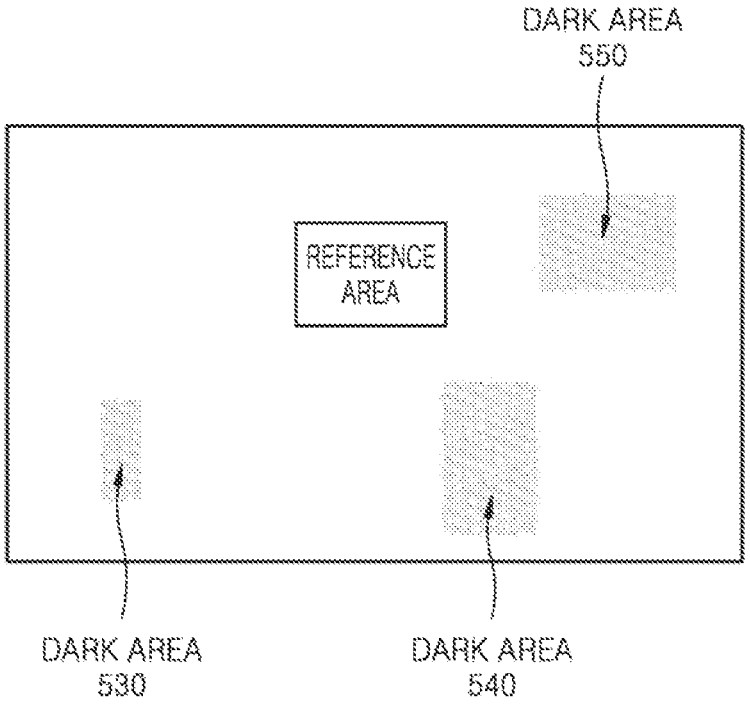
FIG. 5E is a diagram for describing a process of controlling a luminance by an electronic apparatus according to an embodiment of the disclosure.

FIG. 5E illustrates an example of a result of adjusting a polarization angle variation corresponding to a dark area in the first polarization modulation array 280 and the second polarized modulation array 285. For example, a polarization angle variation corresponding to the dark area 520 in the first polarization modulation array 280 and the second polarization modulation array 285 may be appropriately adjusted so that the luminance of the dark area 520 may be the same as a luminance of a reference area, and thus, the dark area 520 may be unidentifiable.

Figure 5F:
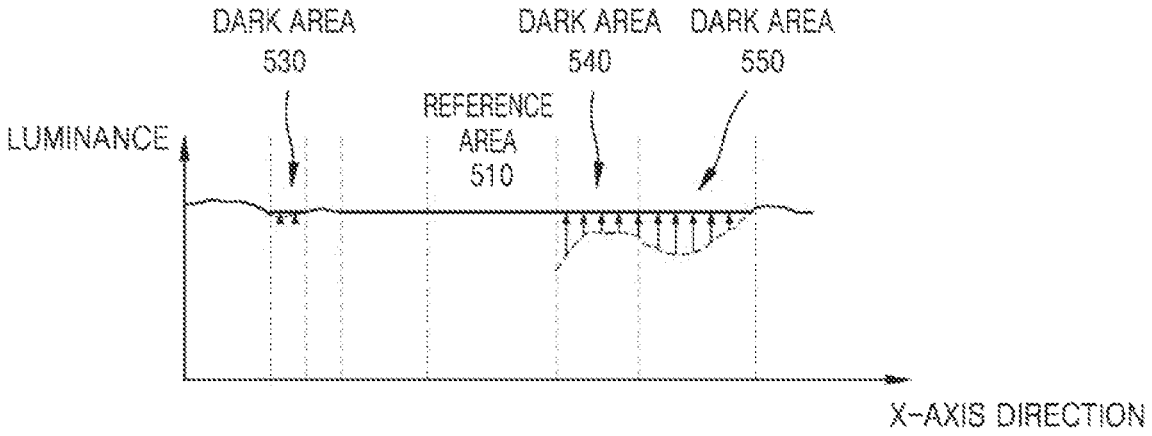
FIG. 5F is a diagram for describing a process of controlling a luminance by an electronic apparatus according to an embodiment of the disclosure.

FIG. 5F illustrates examples of identified luminance of all areas in the second display 265. As described above with reference to FIG. 5D, the electronic apparatus 100 may identify a first polarization angle variation corresponding to a dark area in the first polarization modulation array 280 and a second polarization angle variation corresponding to a dark area in the second polarization modulation array 285, which are set to make a luminance of a dark area a reference luminance. Thereafter, the electronic apparatus 100 may control the first polarization modulation array 280, based on the first polarization angle variation, and control the second polarization modulation array 285 based on the second polarization angle variation, so that the luminance of the dark area may be equal to the reference luminance. For example, the electronic apparatus 100 may appropriately adjust polarization angle variations corresponding to the dark areas 530 to 550 in the first polarization modulation array 280 and the second polarization modulation array 285, so that a luminance of the dark areas 530 to 550 may be the same as the luminance of the reference area as shown in FIG. 5F.

Figure 5G:
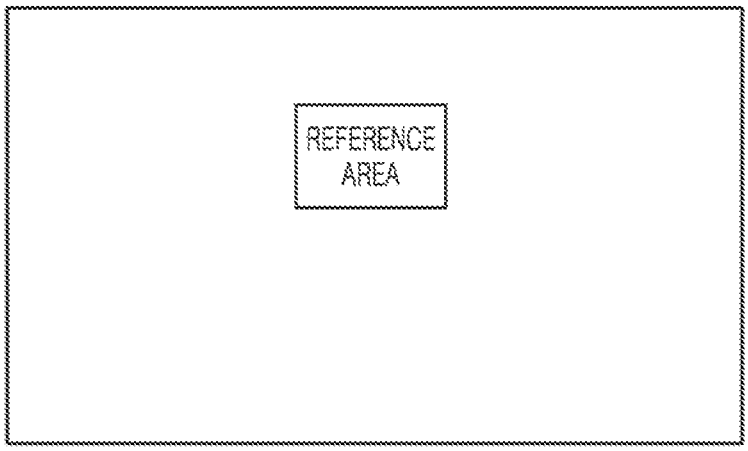
FIG. 5G is a diagram for describing a process of controlling a luminance by an electronic apparatus according to an embodiment of the disclosure.

FIG. 5G illustrates an example of a result of adjusting a polarization angle variation corresponding to an dark area in the first polarization modulation array 280 and the second polarized modulation array 285. For example, a polarization angle variation corresponding to the dark areas 530 to 550 in the first polarization modulation array 280 and the second polarization modulation array 285 may be appropriately adjusted so that the luminance of each of the dark areas 530 to 550 may be the same as a luminance of a reference area, and thus, the dark areas 530 to 550 may be unidentifiable.

Figure 5H:
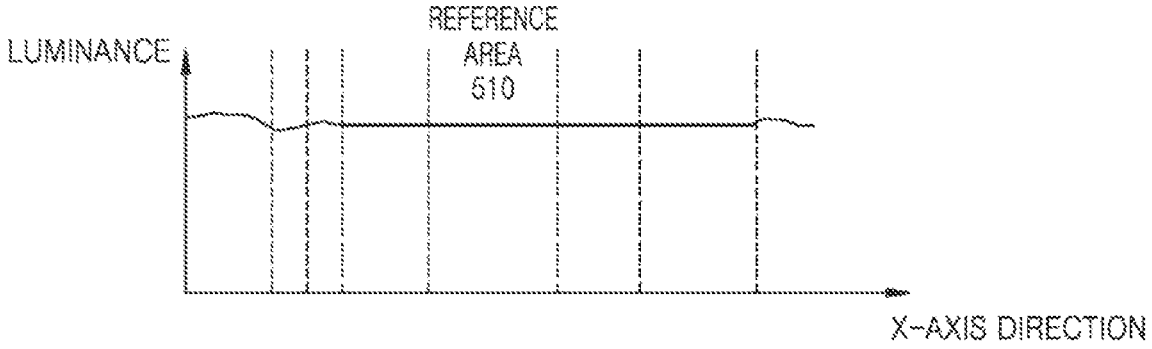
FIG. 5H is a diagram for describing a process of controlling a luminance by an electronic apparatus according to an embodiment of the disclosure.

FIG. 5H illustrates examples of identified luminance of all areas in the second display 270. As the electronic apparatus 100 performs the above-described operations, a luminance of all areas in the second display 270 may be greater than or equal to a luminance of a reference area.

Although a change in a luminance on the X-axis is shown in FIGS. 5B, 5D, 5F and 5H, a change in a luminance on the Y-axis may be substantially the same as the change in the luminance on the X-axis when the above-described operations are performed.

FIGS. 6A to 6F are diagrams for describing a process of controlling a luminance by the electronic apparatus 100 according to an embodiment of the disclosure.

Figure 6A:
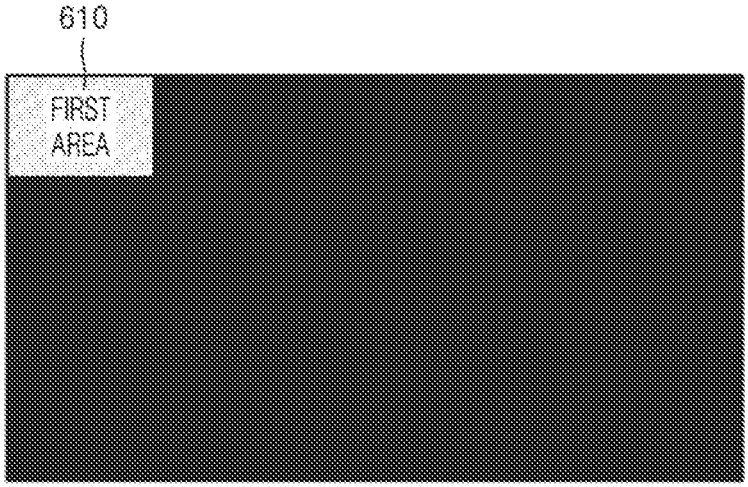
FIG. 6A is a diagram for describing a process of controlling a luminance by an electronic apparatus according to an embodiment of the disclosure.

Referring to FIG. 6A, according to an embodiment of the disclosure, the electronic apparatus 100 may set polarization angle variations of the first polarization modulation array 280 and the second polarization modulation array 285 to an initial value and identify a luminance of a first area 610 in the second display 270. For example, the electronic apparatus 100 may set polarization angle variations of the first polarization modulation array 280 and the second polarization modulation array 285 to the initial value and identify a luminance of the first area 610 when white light is generated from backlight. The initial value of the polarization angle variation may be set, based on previous data, but embodiments of the disclosure are not limited thereto.

Figure 6B:
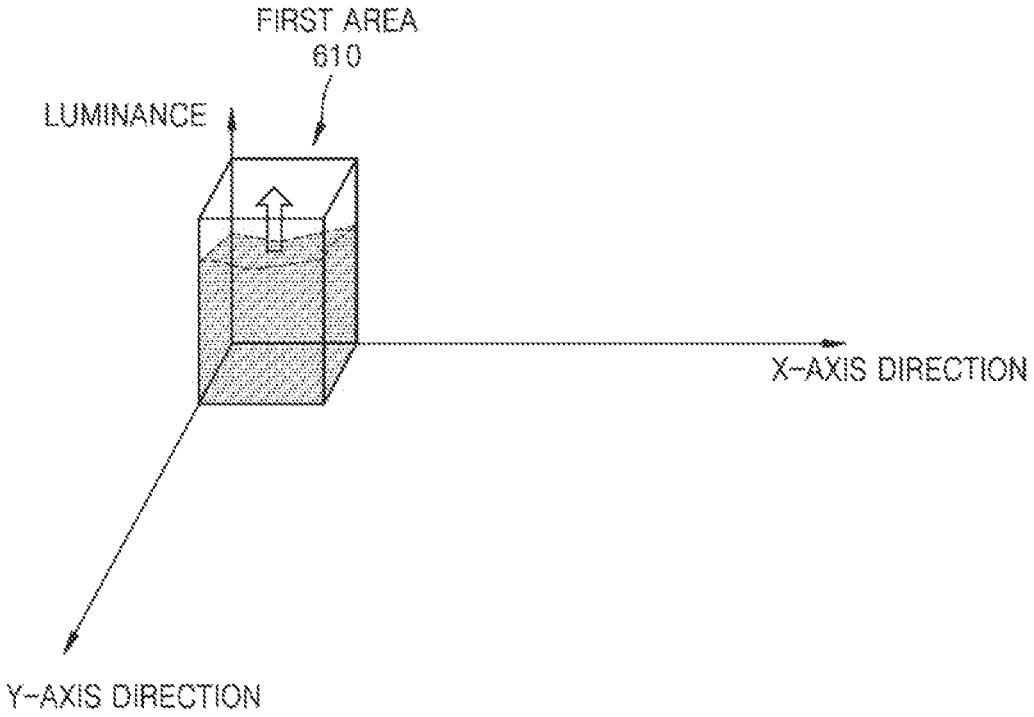
FIG. 6B is a diagram for describing a process of controlling a luminance by an electronic apparatus according to an embodiment of the disclosure.

Referring to FIG. 6B, according to an embodiment of the disclosure, the electronic apparatus 100 may identify a first polarization angle variation corresponding to the first area 610 in the first polarization modulation array 280 and a second polarization angle variation corresponding to the first area 610 in the second polarization modulation array 285 for maximizing a luminance of the first area 610. Thereafter, the electronic apparatus 100 may control the first polarization modulation array 280, based on the first polarization angle variation, and control the second polarization modulation array 285 based on the second polarization angle variation, thereby maximizing the luminance of the first area 610.

Figure 6C:
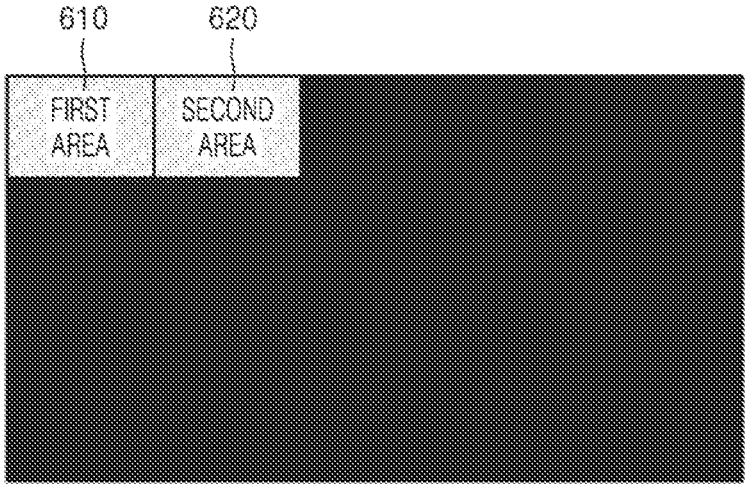
FIG. 6C is a diagram for describing a process of controlling a luminance by an electronic apparatus according to an embodiment of the disclosure.

Referring to FIG. 6C, according to an embodiment of the disclosure, the electronic apparatus 100 may set polarization angle variations of the first polarization modulation array 280 and the second polarization modulation array 285 to an initial value and identify a luminance of a second area 620 in the second display 270. For example, the electronic apparatus 100 may set polarization angle variations of the first polarization modulation array 280 and the second polarization modulation array 285 to the initial value and identify a luminance of the second area 620 when white light is generated from backlight.

Figure 6D:
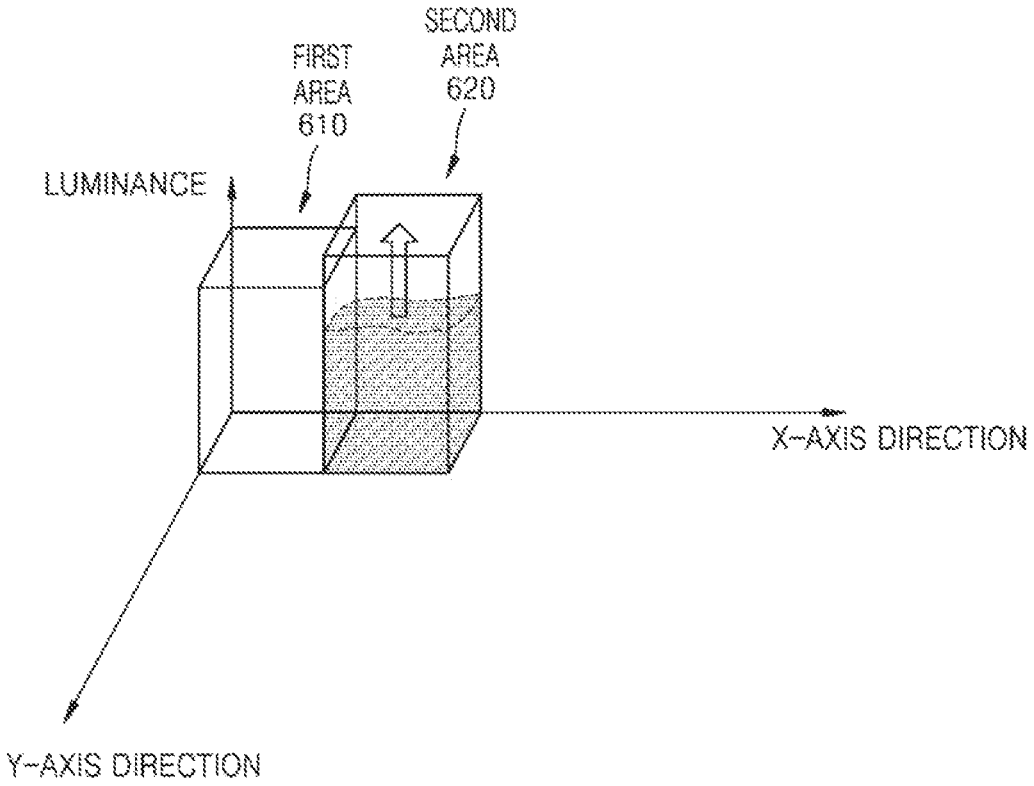
FIG. 6D is a diagram for describing a process of controlling a luminance by an electronic apparatus according to an embodiment of the disclosure.

Referring to FIG. 6D, according to an embodiment of the disclosure, the electronic apparatus 100 may identify a third polarization angle variation corresponding to the second area 620 in the first polarization modulation array 280 and a fourth polarization angle variation corresponding to the second area 620 in the second polarization modulation array 285 for maximizing a luminance of the second area 620. Thereafter, the electronic apparatus 100 may control the first polarization modulation array 280, based on the third polarization angle variation, and control the second polarization modulation array 285 based on the fourth polarization angle variation, thereby maximizing the luminance of the second area 620.

Figure 6E:
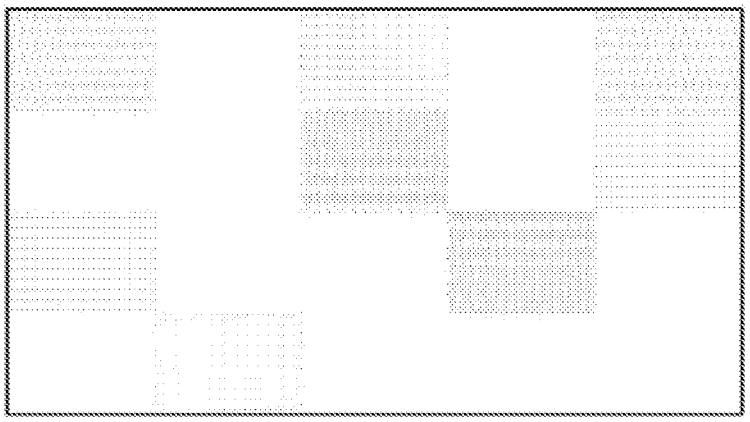
FIG. 6E is a diagram for describing a process of controlling a luminance by an electronic apparatus according to an embodiment of the disclosure.
Figure 6F:
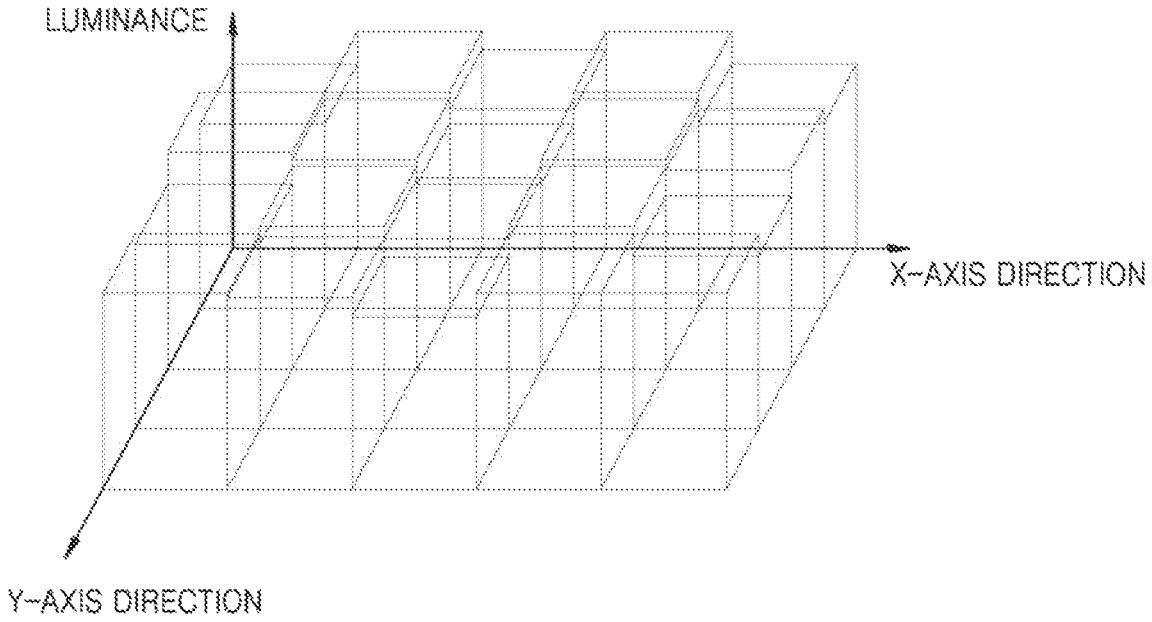
FIG. 6F is a diagram for describing a process of controlling a luminance by an electronic apparatus according to an embodiment of the disclosure.

Referring to FIG. 6E, the electronic apparatus 100 may appropriately adjust polarization angle variations corresponding to areas in the first polarization modulation array 280 and the second polarization modulation array 285, thereby maximizing luminance of all areas. As a result, as shown in FIG. 6F, all areas in the second display 270 may have a maximum luminance. Although FIG. 6F illustrates that all the areas in the second display 270 have different maximum luminance, FIG. 6F provides only an example, and at least one of all of the areas in the second display 270 may have the same maximum luminance.

Figure 7A:
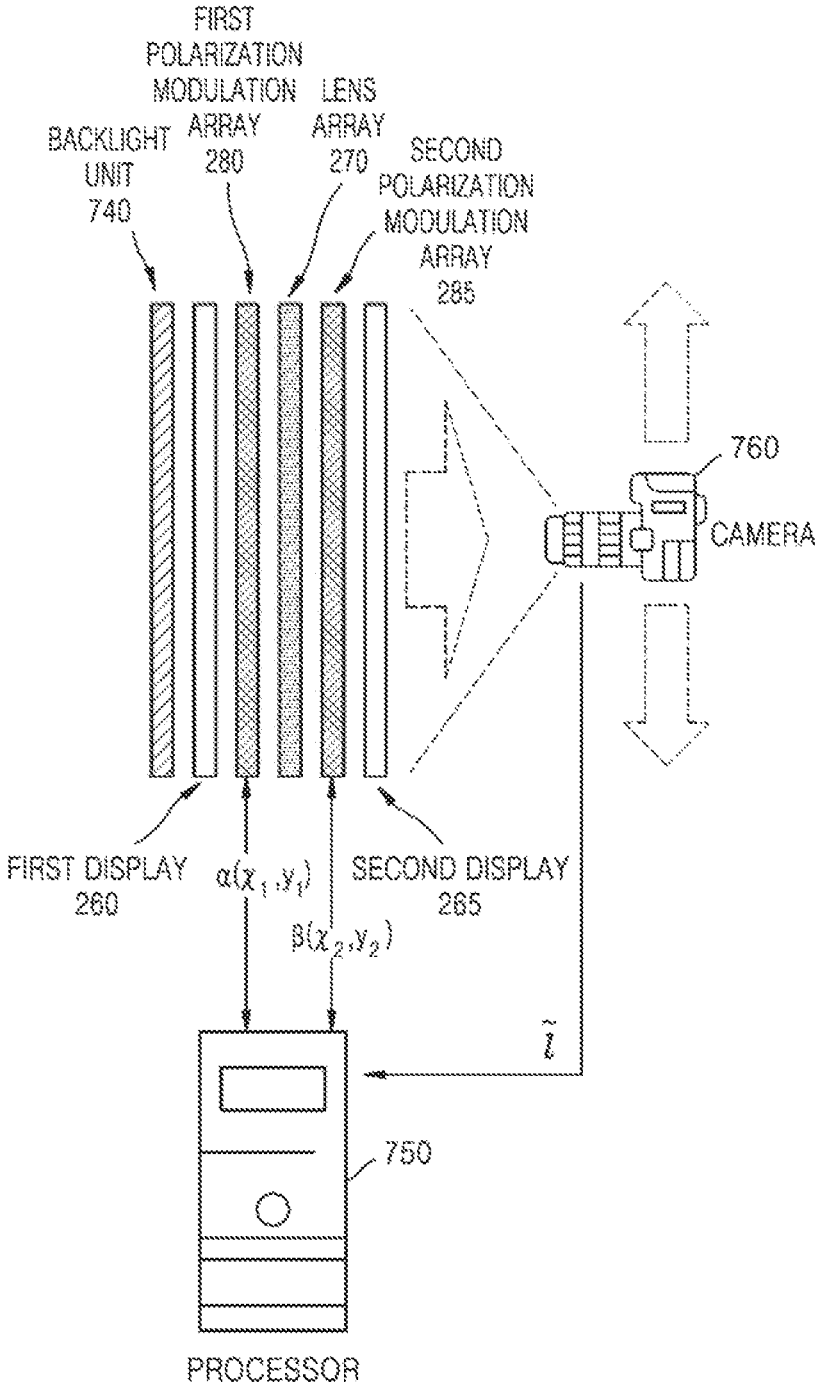
FIG. 7A is a diagram for describing a process of controlling a luminance by an electronic apparatus according to an embodiment of the disclosure.
Figure 7B:
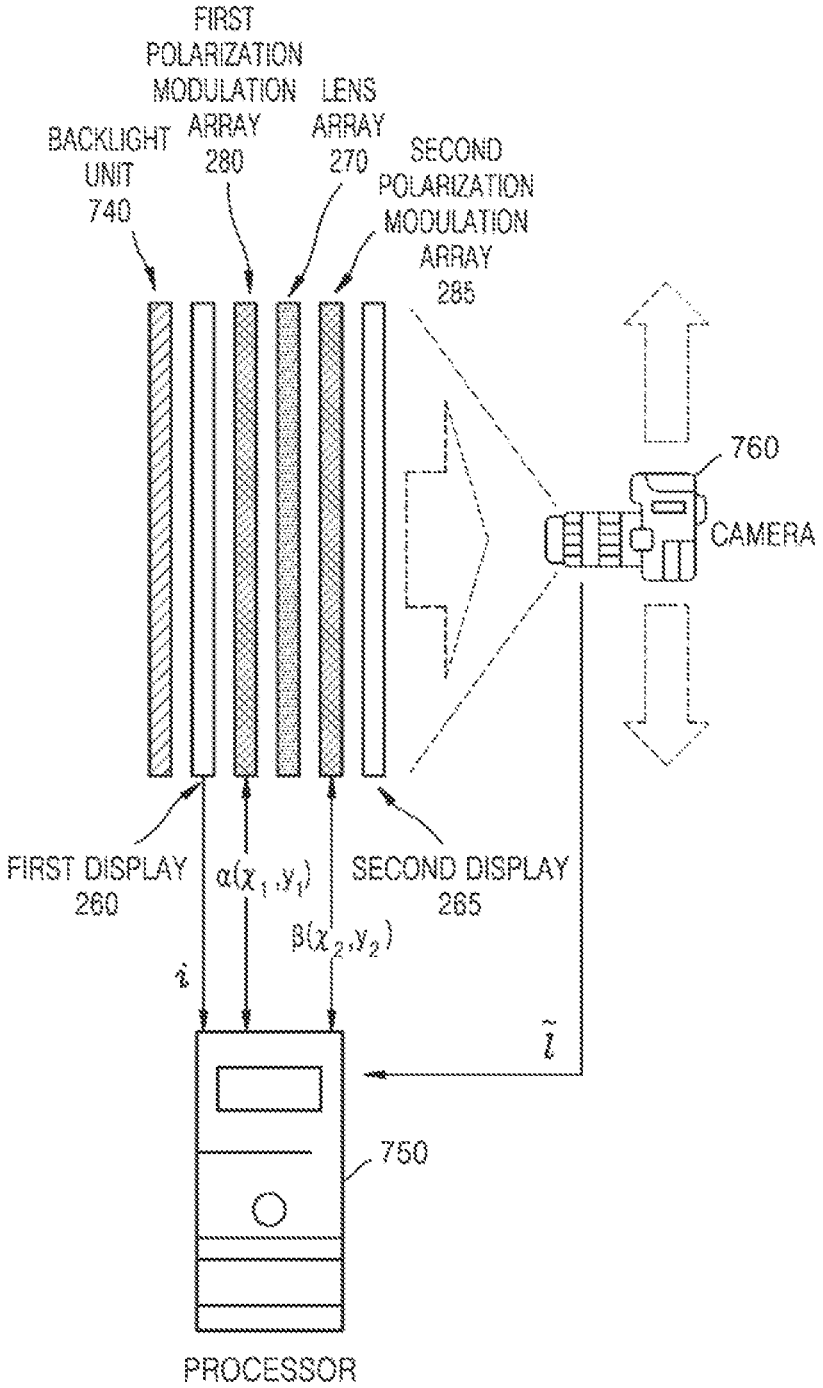
FIG. 7B is a diagram for describing a process of controlling a luminance by an electronic apparatus according to an embodiment of the disclosure.

FIGS. 7A and 7B are diagrams for describing a process of controlling a luminance by an electronic apparatus 100 according to an embodiment of the disclosure.

According to an embodiment of the disclosure, the electronic apparatus 100 may include a first display 260, a second display 265, a lens array 270, a first polarization modulation array 280, a second polarization modulation array 285, and a backlight unit 740. In this case the lens array 270 is positioned between the first display 260 and the second display 265, and the backlight unit 740 may be positioned before the first display 260. The first polarization modulation array 280 may be positioned between the first display 260 and the lens array 270, and the second polarization modulation array 285 may be positioned between the lens array 270 and the second display 265.

In an embodiment of the disclosure, the electronic apparatus 100 may include a processor 750 and a camera 760. The camera 760 may identify a luminance of the second display 265 according to a position of the camera 760, and the processor 750 may identify a polarization angle variation for maximizing the luminance of the second display 265 provided from the camera 760. However, the above description is intended to provide only an example and the electronic apparatus 100 may not include the camera 760.

Referring to FIG. 7A, according to an embodiment of the disclosure, the camera 760 may identify a luminance $\tilde{I}$ of a first area in the second display 265. In this case, the first area may include one or more adjacent pixels.

Thereafter, the electronic apparatus 100 may identify a first polarization angle variation $\alpha(x_1, y_1)$ corresponding to a first area in the first polarization modulation array 280 and a second polarization angle variation $\beta(x_2, y_2)$ corresponding to a first area in the second polarization modulation array 285 for maximizing the luminance $\tilde{I}$, as expressed in Equations (1) to (3) below.

$$\alpha(x_1, y_1), \quad \beta(x_2, y_2) = \text{Argmax}\,\text{Cost}(\tilde{i})\left(0 \le \alpha(x_1, y_1), \beta(x_2, y_2) < \frac{\pi}{2}\right) \quad \text{Equation (1)}$$

$$\text{Cost}(\tilde{i}) = \frac{1}{P}\sum_{p=P} \tilde{i}(x_p, y_p) \quad \text{Equation (2)}$$

$$\tilde{i}(x_p, y_p) = Q(F(i(x_p, y_p), \alpha(x_1, y_1)), \beta(x_2, y_2), \text{lens_stress}). \quad \text{Equation (3)}$$

Here, p denotes an index of each of pixels included in a first area, and P denotes the total number of the pixels included in the first area. $\tilde{I}(x_p, y_p)$ denotes a luminance of a pixel with an index p in the second display 265, and $i(x_p, y_p)$ denotes a luminance of a pixel with an index p in first display 260. F denotes a polarization modulation function of the first polarization modulation array 280, and Q denotes a polarization modulation function of the second polarization modulation array 285.

$(x_1, y_1)$ denotes a position of liquid crystal (LC) in the first polarization modulation array 280 corresponding to the first area, and $(x_2, y_2)$, denotes a position of LC in the second polarization modulation array 285 corresponding to the first area. Generally, the position of the LC in the first polarization modulation array 280 corresponding to the first area and the position of the LC in the second polarization modulation array 285 corresponding to the first area may be the same as the position of the first area in the second display 265, but are not limited thereto.

According to an embodiment of the disclosure, the electronic apparatus 100 may identify a luminance of the second display 265 according to a viewing angle of the camera 760 while changing the viewing angle of the camera 769, and identify a polarization angle variation for maximizing the identified luminance.

Referring to FIG. 7B, according to an embodiment of the disclosure, the electronic apparatus 100 may identify a luminance $\tilde{I}$ of the first area in the second display 265 and a luminance i of the first area in the first display 260, and identify the difference between $\tilde{I}$ and i. In this case, the first area may include one or more adjacent pixels.

Thereafter, the electronic apparatus 100 may identify a first polarization angle variation $\alpha(x_1, y_1)$ corresponding to the first area in the first polarization modulation array 280 and a second polarization angle variation $\beta(x_2, y_2)$ corresponding to the first area in the second polarization modulation array 285 for minimizing the difference between $\tilde{I}$ and i as expressed in Equations (4) to (6) below.

$$\alpha(x_1, x_2), \quad \beta(x_2, y_2) = \text{Argmin}\,\text{Cost}(i, \tilde{i})\left(0 \le \alpha(x_1, y_2), \beta(x_2, y_2) < \frac{\pi}{2}\right) \quad \text{Equation (4)}$$

$$\text{Cost}(i, \tilde{i}) = \frac{1}{P}\sum_{p=P} \left|i(x_p, y_p) - \tilde{i}(x_p, y_p)\right| \quad \text{Equation (5)}$$

$$\tilde{i}(x_p, y_p) = Q(F(i(x_p, y_p), \alpha(x_1, y_1)), \beta(x_2, y_2), \text{lens_stress}) \quad \text{Equation (6)}$$

Here, p denotes an index of each of pixels included in a first area, and P denotes the total number of the pixels included in the first area. $\tilde{I}(x_p, y_p)$ denotes a luminance of a pixel with an index p in the second display 265, and $i(x_p, y_p)$ denotes a luminance of a pixel with an index p in first display 260. F denotes a polarization modulation function of the first polarization modulation array 280, and Q denotes a polarization modulation function of the second polarization modulation array 285.

A range of $\alpha(x_1, y_1)$ and $\beta(x_2, y_2)$ is limited to $$\left(0, \frac{\pi}{2}\right)$$

but is only intended to reduce load due to calculation and thus embodiments of the disclosure are not limited thereto.

FIGS. 8A to 8G are diagrams for describing a process of controlling a luminance by an electronic apparatus 100 according to an embodiment of the disclosure.

Figure 8A:
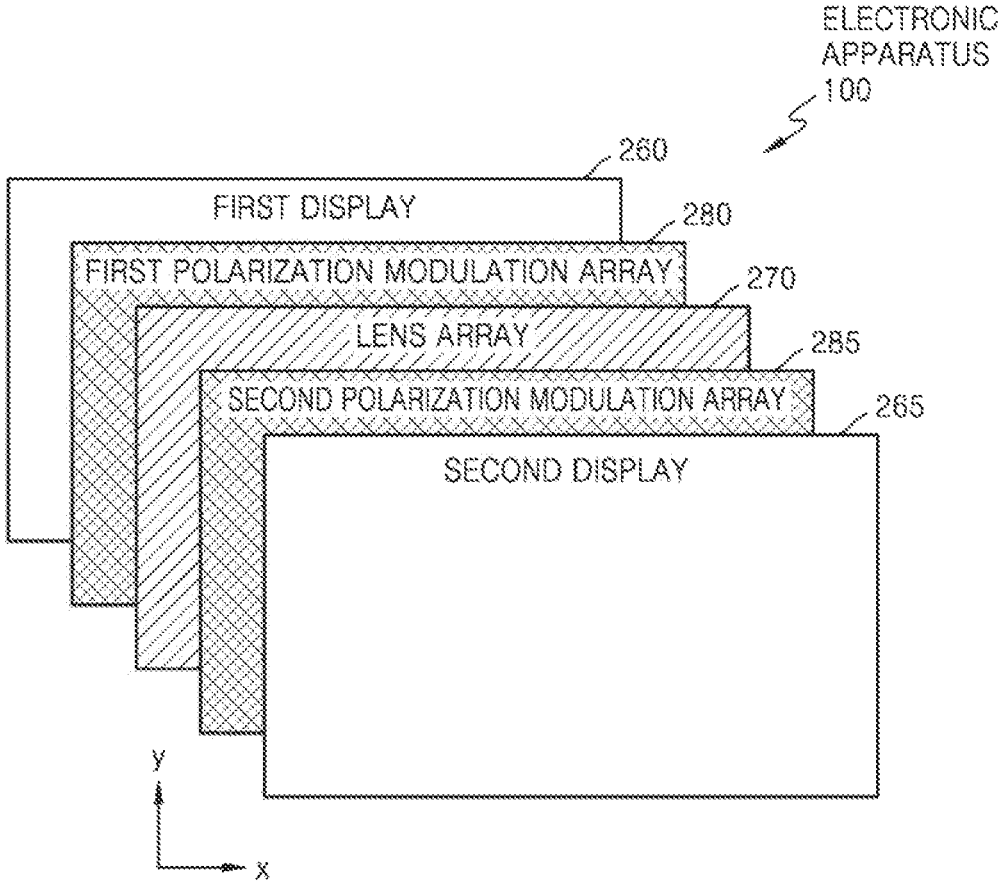
FIG. 8A is a diagram for describing a process of controlling a luminance by an electronic apparatus according to an embodiment of the disclosure.

FIG. 8A illustrates a configuration of the electronic apparatus 100 according to an embodiment of the disclosure. According to an embodiment of the disclosure, the electronic apparatus 100 may include a first display 260, a second display 265, a lens array 270, a first polarization modulation array 280, and a second polarization modulation array 285. In this case, the lens array 270 may be positioned between the first display 260 and the second display 265. The first polarization modulation array 280 may be positioned between the first display 260 and the lens array 270, and the second polarization modulation array 285 may be positioned between the lens array 270 and the second display 265.

Figure 8B:
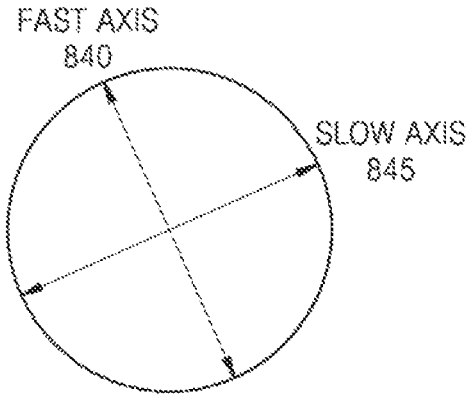
FIG. 8B is a diagram for describing a process of controlling a luminance by an electronic apparatus according to an embodiment of the disclosure.

FIG. 8B illustrates an example of a fast axis and a slow axis of a first area in the lens array 270. According to an embodiment of the disclosure, the first area in the lens array 270 may have the quarter-wave plate feature, and a fast axis 840 and a slow axis 845 of the first area in the lens array 270 may be provided as illustrated in FIG. 8B.

Figure 8C:
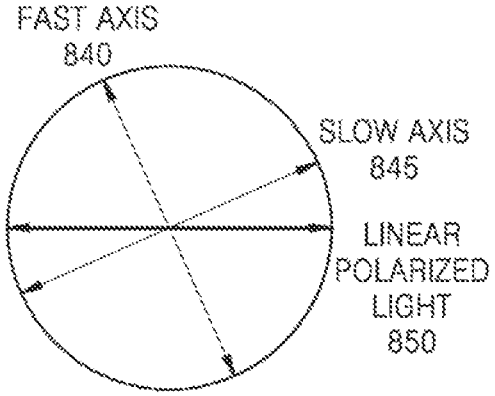
FIG. 8C is a diagram for describing a process of controlling a luminance by an electronic apparatus according to an embodiment of the disclosure.

FIG. 8C illustrates an example of linear polarized light having passed through the first display 260. According to an embodiment of the disclosure, linear polarized light 850 having passed through the first display 260 may have an intensity and an angle of polarization as shown in FIG. 8C.

Figure 8D:
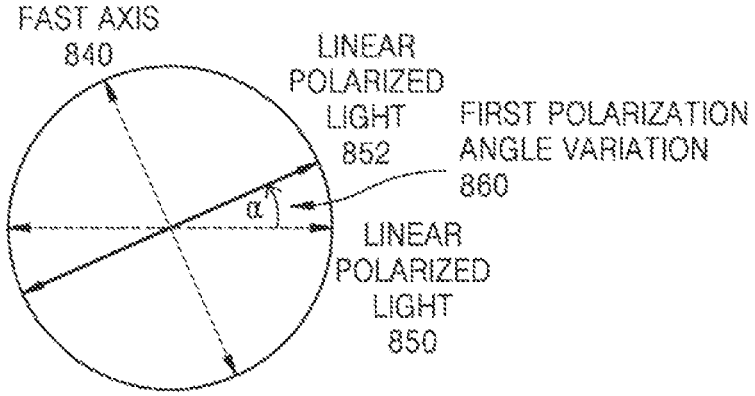
FIG. 8D is a diagram for describing a process of controlling a luminance by an electronic apparatus according to an embodiment of the disclosure.

Referring to FIG. 8D, according to an embodiment of the disclosure, the linear polarized light 850 having passed through the first display 260 may change to linear polarized light 852 parallel to the slow axis 845 while passing through the first area in the first polarization modulation array 280. For example, the electronic apparatus 100 may identify a first polarization angle variation 860, i.e., α, for maximizing a luminance of the second display 265 or controlling the luminance of the second display 265 to be the same as a reference luminance, and the linear polarized light 850 may rotate by the first polarization angle variation 860 to change to the linear polarized light 852 parallel to the slow axis 845 when passing through the first area in the first polarization modulation array 280.

Figure 8E:
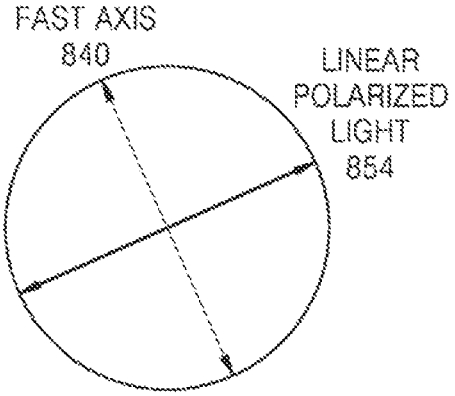
FIG. 8E is a diagram for describing a process of controlling a luminance by an electronic apparatus according to an embodiment of the disclosure.

Referring to FIG. 8E, according to an embodiment of the disclosure, an intensity and an angle of polarization of the linear polarized light 852 having passed through the first polarization modulation array 280 may be maintained when the linear polarized light 852 passes through the first area in the lens array 270. For example, when the first area in the lens array 270 has the quarter-wave plate feature, the linear polarized light 852 is parallel to the slow axis 845 of the first area in the lens array 270 and thus may change to linear polarized light 854 having the same intensity and angle of polarization as the linear polarized light 852 when passing through the area in the lens array 270.

Figure 8F:
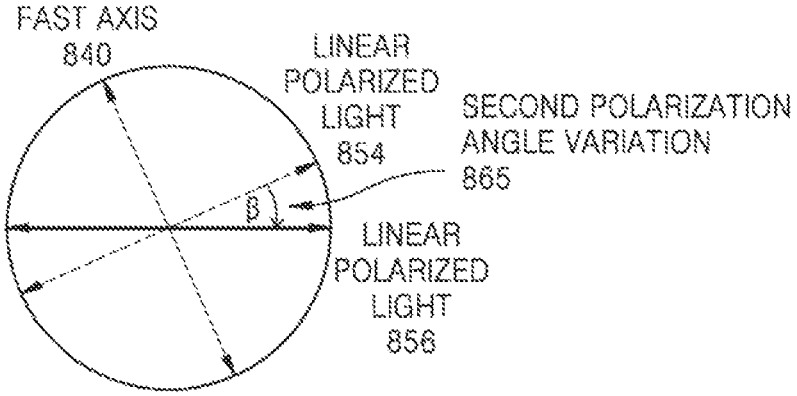
FIG. 8F is a diagram for describing a process of controlling a luminance by an electronic apparatus according to an embodiment of the disclosure.

Referring to FIG. 8F, according to an embodiment of the disclosure, the linear polarized light 854 having passed through the lens array 270 may change to linear polarized light 856 parallel to an orientation of a gap in a polarizer in the second display 265 while passing through the first area in the second polarization modulation array 285. For example, the electronic apparatus 100 may identify a polarization angle variation 865, i.e., β, for maximizing the luminance of the second display 265 or controlling the luminance of the second display 265 to be the same as a reference luminance. In this case, the second polarization angle variation 865 and the first polarization angle variation 860 may be the same value with opposite direction, but embodiments of the disclosure are not limited thereto.

According to an embodiment of the disclosure, the linear polarized light 854 may rotate by the second polarization angle variation 865 to change to the linear polarized light 856 parallel to the orientation of the gap in the polarizer in the second display 265, when passing through the first area in the second polarization modulation array 285. In this case, the linear polarized light 856 may be linear polarized light having the same intensity and angle of polarization as the linear polarized light 850.

Figure 8G:
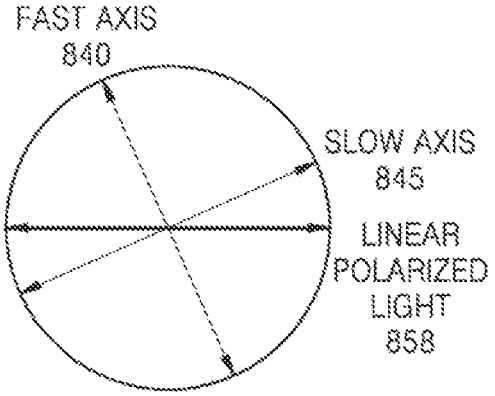
FIG. 8G is a diagram for describing a process of controlling a luminance by an electronic apparatus according to an embodiment of the disclosure.

FIG. 8G illustrates an example of linear polarized light having passed through the second display 265. According to an embodiment of the disclosure, as the linear polarized light 856 is parallel to the orientation of the gap in the polarizer in the second display 265, linear polarized light 858 having passed through the second display 265 may have the same intensity and angle of polarization as the linear polarized light 856.

Referring to FIGS. 8C and 8G, the linear polarized light 850 having passed through the first display 260 and the linear polarized light 858 having passed through the second display 265 may have the same intensity. According to an embodiment of the disclosure, the electronic apparatus 100 may identify the first polarization angle variation 860 corresponding to the first area in the first polarization modulation array 280 and the second polarization angle variation 865 corresponding to the first area in the second polarization modulation array 285 for maximizing the luminance of the second display 265 or controlling the luminance of the second display 265 to be the same as the reference luminance, and respectively control the first polarization modulation array 280 and the second polarization modulation array 285, based on the first polarization angle variation 860 and the second polarization angle variation 865. Accordingly, the linear polarized light 850 having passed through the first display 260 and the linear polarized light 858 having passed through the second display 265 may have the same intensity, thereby a reduction in the luminance of the second display 265 can be prevented.

FIGS. 9A to 9G are diagrams for describing a process of controlling a luminance by an electronic apparatus 100 according to an embodiment of the disclosure.

Figure 9A:
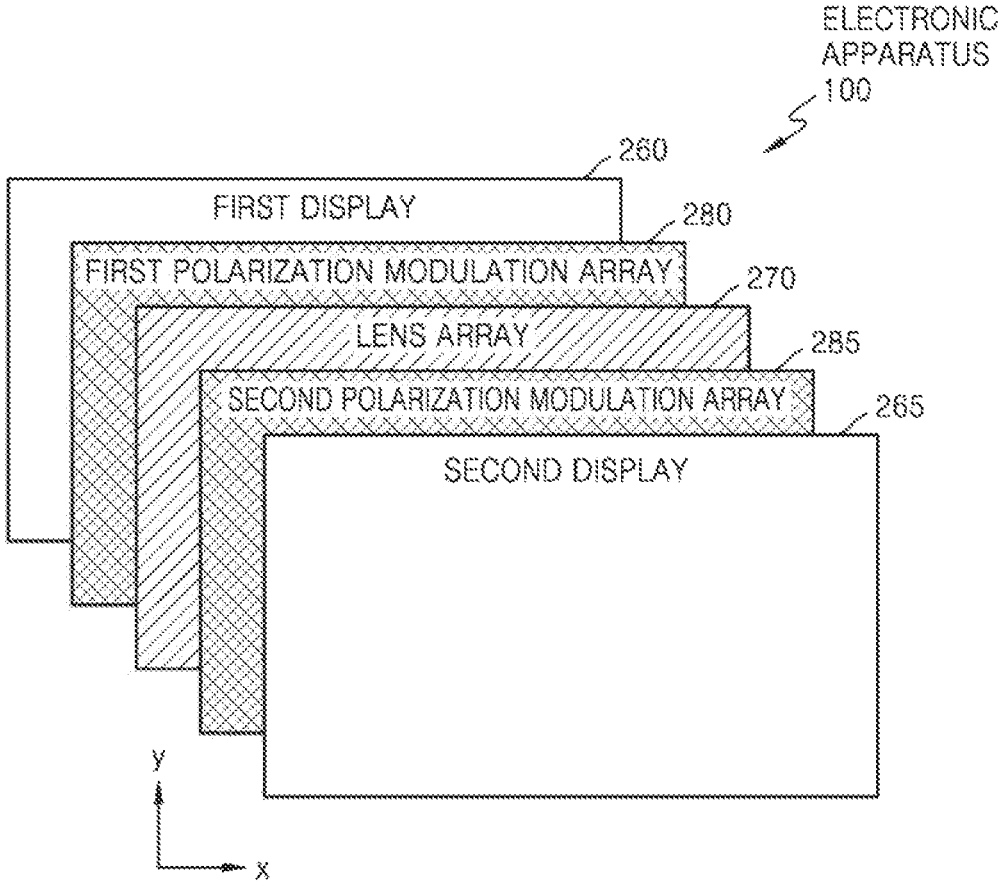
FIG. 9A is a diagram for describing a process of controlling a luminance by an electronic apparatus according to an embodiment of the disclosure.

FIG. 9A illustrates a configuration of the electronic apparatus 100 according to an embodiment of the disclosure. According to an embodiment of the disclosure, the electronic apparatus 100 may include a first display 260, a second display 265, a lens array 270, a first polarization modulation array 280, and a second polarization modulation array 285. In this case, the lens array 270 may be positioned between the first display 260 and the second display 265. The first polarization modulation array 280 may be positioned between the first display 260 and the lens array 270, and the second polarization modulation array 285 may be positioned between the lens array 270 and the second display 265.

Figure 9B:
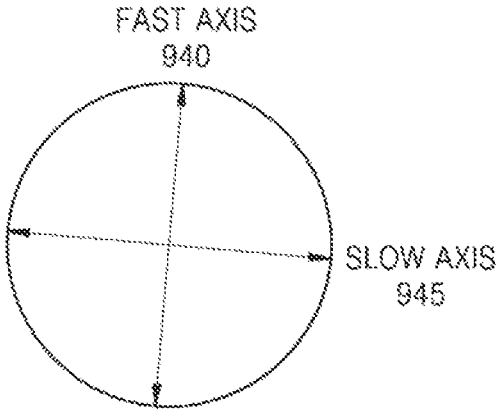
FIG. 9B is a diagram for describing a process of controlling a luminance by an electronic apparatus according to an embodiment of the disclosure.

FIG. 9B illustrates an example of a fast axis and a slow axis of a first area in the lens array 270. According to an embodiment of the disclosure, the first area in the lens array 270 may have the quarter-wave plate feature, and a fast axis 940 and a slow axis 945 in the first area in the lens array 270 may be formed as illustrated in FIG. 9B.

Figure 9C:
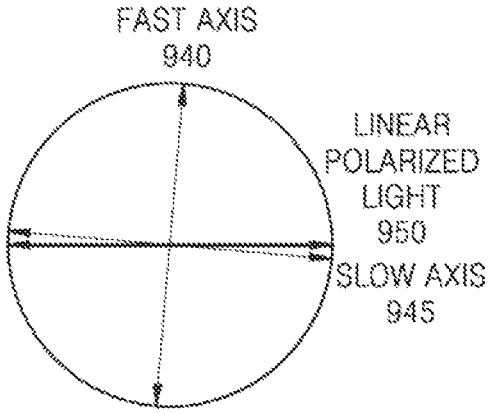
FIG. 9C is a diagram for describing a process of controlling a luminance by an electronic apparatus according to an embodiment of the disclosure.

FIG. 9C illustrates an example of linear polarized light having passed through the first display 260. According to an embodiment of the disclosure, linear polarized light 950 having passed through the first display 260 may have an intensity and an angle of polarization as shown in FIG. 9C.

Figure 9D:
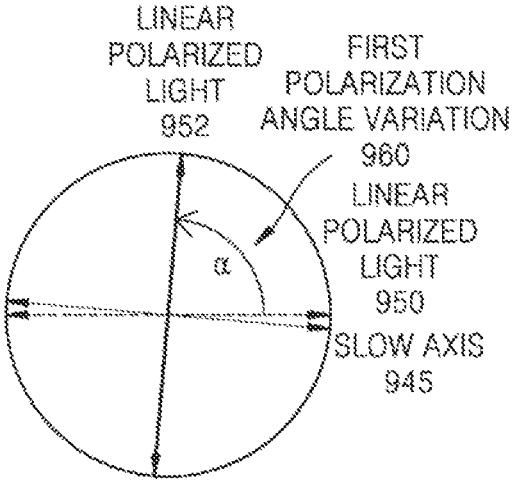
FIG. 9D is a diagram for describing a process of controlling a luminance by an electronic apparatus according to an embodiment of the disclosure.

Referring to FIG. 9D, according to an embodiment of the disclosure, the linear polarized light 950 having passed through the first display 260 may change to linear polarized light 952 parallel to a fast axis 940 while passing through the first area in the first polarization modulation array 280. For example, the electronic apparatus 100 may identify a fir9st polarization angle variation 960, e.g., α, for maximizing a luminance of the second display 265 or controlling the luminance of the second display 265 to be the same as a reference luminance, and the linear polarized light 950 may rotate by the first polarization angle variation 860 to change to the linear polarized light 952 parallel to the fast axis 940 when passing through the first area in the first polarization modulation array 280.

Figure 9E:
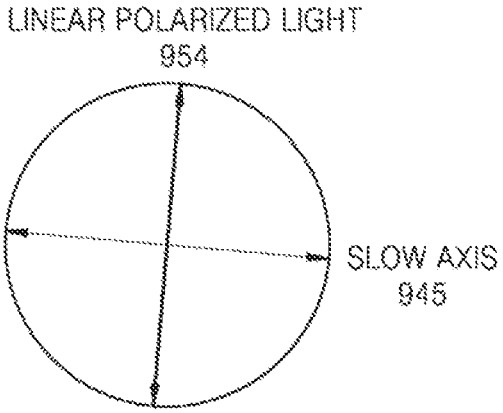
FIG. 9E is a diagram for describing a process of controlling a luminance by an electronic apparatus according to an embodiment of the disclosure.

Referring to FIG. 9E, according to an embodiment of the disclosure, an intensity and an angle of polarization of the linear polarized light 952 having passed through the first polarization modulation array 280 may be maintained when the linear polarized light 952 passes through the first area in the lens array 270. For example, when the first area in the lens array 270 has the quarter-wave plate feature, the linear polarized light 952 is parallel to the fast axis 940 of the first area in the lens array 270 and thus may change to linear polarized light 954 having the same intensity and angle of polarization as the linear polarized light 952 when passing through the area in the lens array 270.

Figure 9F:
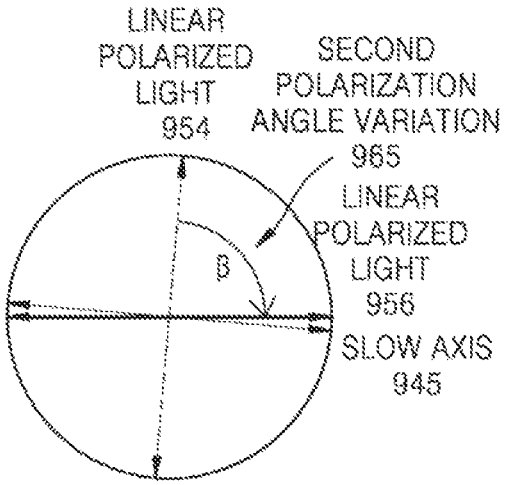
FIG. 9F is a diagram for describing a process of controlling a luminance by an electronic apparatus according to an embodiment of the disclosure.

Referring to FIG. 9F, according to an embodiment of the disclosure, the linear polarized light 954 having passed through the lens array 270 may change to linear polarized light 956 parallel to an orientation of a gap in a polarizer in the second display 265 while passing through the first area in the second polarization modulation array 285. For example, the electronic apparatus 100 may identify a second polarization angle variation 965, i.e., β, for maximizing the luminance of the second display 265 or controlling the luminance of the second display 265 to be the same as a reference luminance. In this case, the second polarization angle variation 965 may be a value same with that of the first polarization angle variation 960 and a direction opposite to that of the first polarization angle variation 960 but is not limited thereto.

According to an embodiment of the disclosure, the linear polarized light 954 may rotate by the second polarization angle variation 965 to change to the linear polarized light 956 parallel to the orientation of the gap in the polarizer in the second display 265, when passing through the first area in the second polarization modulation array 285. In this case, the linear polarized light 956 may be linear polarized light having the same intensity and angle of polarization as the linear polarized light 950.

Figure 9G:
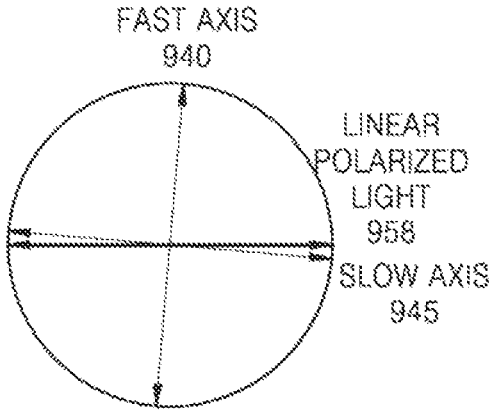
FIG. 9G is a diagram for describing a process of controlling a luminance by an electronic apparatus according to an embodiment of the disclosure.

FIG. 9G illustrates an example of linear polarized light having passed through the second display 265. According to an embodiment of the disclosure, as the linear polarized light 956 is parallel to the orientation of the gap in the polarizer in the second display 265, linear polarized light 958 having passed through the second display 265 may have the same intensity and angle of polarization as the linear polarized light 956.

Referring to FIGS. 9C and 9G, the linear polarized light 950 having passed through the first display 260 and the linear polarized light 958 having passed through the second display 265 may have the same intensity. According to an embodiment of the disclosure, the electronic apparatus 100 may identify the first polarization angle variation 960 corresponding to the first area in the first polarization modulation array 280 and the second polarization angle variation 965 corresponding to the first area in the second polarization modulation array 285 for maximizing the luminance of the second display 265 or controlling the luminance of the second display 265 to be the same as the reference luminance, and respectively control the first polarization modulation array 280 and the second polarization modulation array 285, based on the first polarization angle variation 960 and the second polarization angle variation 965. Accordingly, the linear polarized light 950 having passed through the first display 260 and the linear polarized light 958 having passed through the second display 265 may have the same intensity, thereby a reduction in the luminance of the second display 265 can be prevented.

FIGS. 10A to 10G are diagrams for describing a process of controlling a luminance by an electronic apparatus 100 according to an embodiment of the disclosure.

Figure 10A:
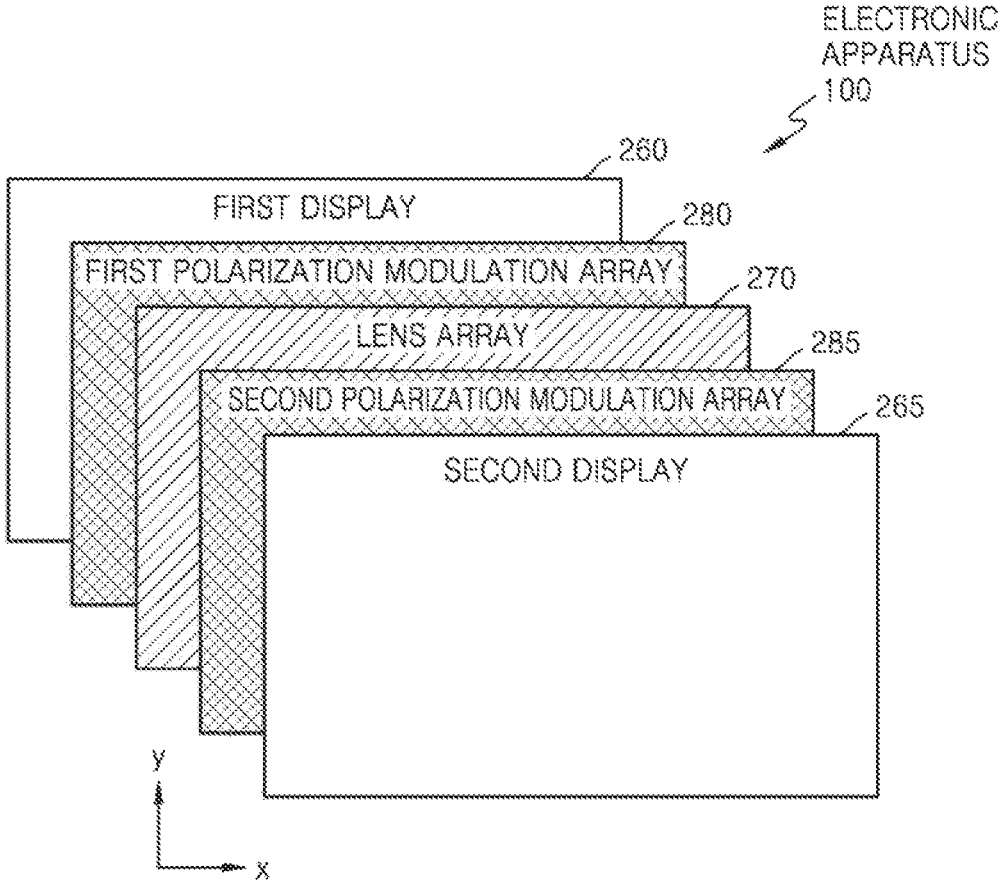
FIG. 10A is a diagram for describing a process of controlling a luminance by an electronic apparatus according to an embodiment of the disclosure.

FIG. 10A illustrates a configuration of the electronic apparatus 100 according to an embodiment of the disclosure. According to an embodiment of the disclosure, the electronic apparatus 100 may include a first display 260, a second display 265, a lens array 270, a first polarization modulation array 280, and a second polarization modulation array 285. In this case, the lens array 270 may be positioned between the first display 260 and the second display 265. The first polarization modulation array 280 may be positioned between the first display 260 and the lens array 270, and the second polarization modulation array 285 may be positioned between the lens array 270 and the second display 265.

Figure 10B:
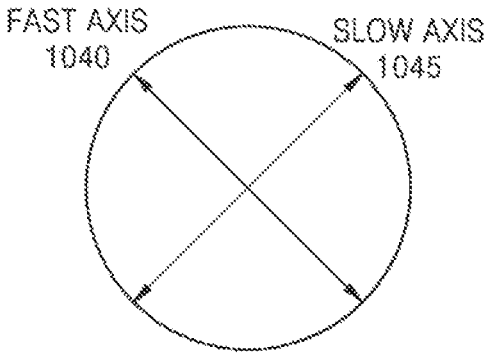
FIG. 10B is a diagram for describing a process of controlling a luminance by an electronic apparatus according to an embodiment of the disclosure.

FIG. 10B illustrates examples of a fast axis and a slow axis of the first area in the lens array 270. According to an embodiment of the disclosure, the first area in the lens array 270 may have the half-wave plate feature, and a fast axis 1040 and a slow axis 1045 in the first area in the lens array 270 may be formed as illustrated in FIG. 10B.

Figure 10C:
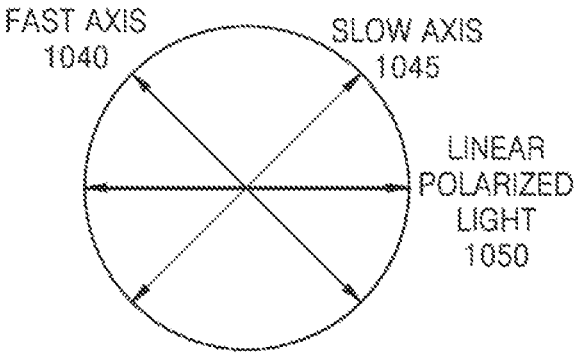
FIG. 10C is a diagram for describing a process of controlling a luminance by an electronic apparatus according to an embodiment of the disclosure.

FIG. 10C illustrates an example of linear polarized light having passed through the first display 260. According to an embodiment of the disclosure, linear polarized light 1050 having passed through the first display 260 may have an intensity and an angle of polarization as shown in FIG. 10C.

Figure 10D:
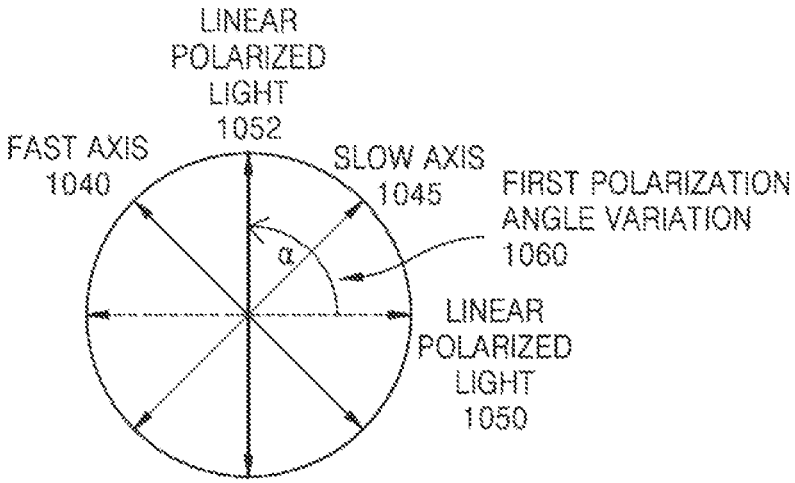
FIG. 10D is a diagram for describing a process of controlling a luminance by an electronic apparatus according to an embodiment of the disclosure.

Referring to FIG. 10D, according to an embodiment of the disclosure, the linear polarized light 1050 having passed through the first display 260 may change to linear polarized light 1052 that are not parallel to the fast axis 1040 and the slow axis 1045 when passing through the first area in the first polarization modulation array 280. For example, the electronic apparatus 100 may identify a first polarization angle variation 1060, i.e., α, for maximizing a luminance of the second display 265 or controlling the luminance of the second display 265 to be the same as a reference luminance, and the linear polarized light 1050 may rotate by the first polarization angle variation 1060 to change to the linear polarized light 1052 parallel to the fast axis 1040 when passing through the first area in the first polarization modulation array 280. In this case, when the first area in the lens array 270 has the half-wave plate feature, the first polarization angle variation 1060 may be a certain value.

Figure 10E:
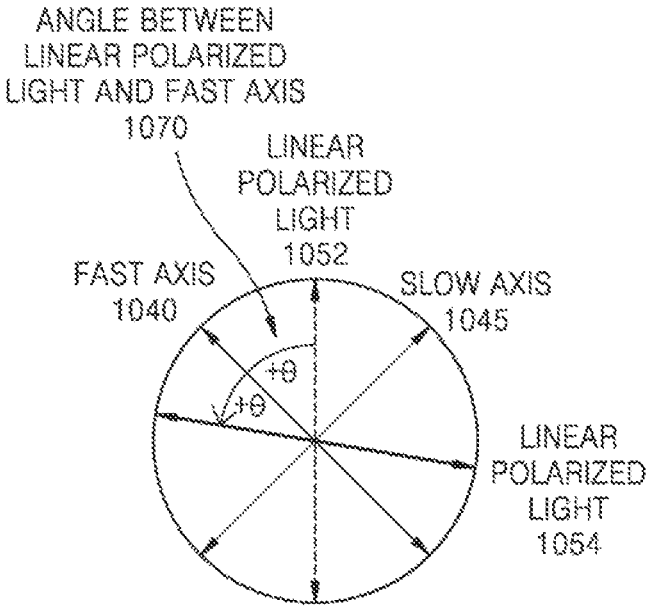
FIG. 10E is a diagram for describing a process of controlling a luminance by an electronic apparatus according to an embodiment of the disclosure.

Referring to FIG. 10E, according to an embodiment of the disclosure, an intensity of the linear polarized light 1052 having passed through the first polarization modulation array 280 may be maintained but an angle of polarization may change, when the linear polarized light 1052 passes through the first area in the lens array 270. For example, when the first area in the lens array 270 has the half-wave plate feature, the linear polarized light 1052 may rotate by twice an angle 1070, i.e., θ, between the linear polarized light 1052 and the fast axis 1040 while passing through the first area in the lens array 270 and thus may change to linear polarized light 1054 having the same intensity as the linear polarized light 1052 and a different angle of polarization from that of the linear polarized light 1052.

Figure 10F:
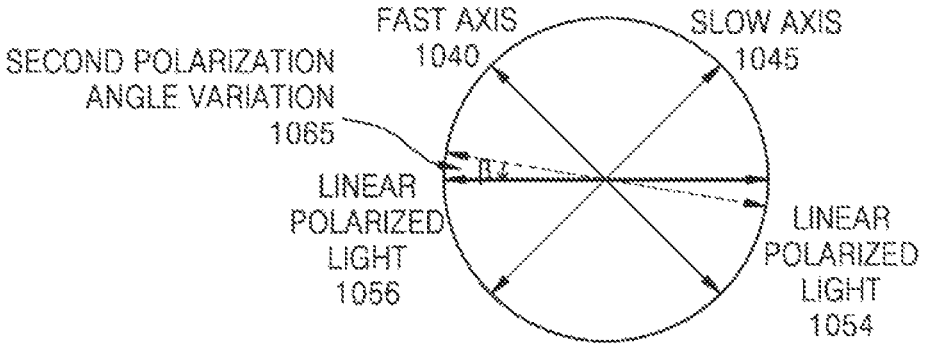
FIG. 10F is a diagram for describing a process of controlling a luminance by an electronic apparatus according to an embodiment of the disclosure.

Referring to FIG. 10F, according to an embodiment of the disclosure, the linear polarized light 1054 having passed through the lens array 270 may change to linear polarized light 1056 parallel to an orientation of a gap in a polarizer in the second display 265 while passing through the first area in the second polarization modulation array 285. For example, the electronic apparatus 100 may identify a second polarization angle variation 1065, i.e., β, for maximizing the luminance of the second display 265 or controlling the luminance of the second display 265 to be the same as a reference luminance. In this case, the second polarization angle variation 1065 and the first polarization angle variation 1060 may be different values but embodiments of the disclosure are not limited thereto.

According to an embodiment of the disclosure, the linear polarized light 1054 may rotate by the second polarization angle variation 1065 to change to the linear polarized light 1056 parallel to the orientation of the gap in the polarizer in the second display 265, when passing through the first area in the second polarization modulation array 285. In this case, the linear polarized light 1056 may be linear polarized light having the same intensity and angle of polarization as the linear polarized light 1050.

Figure 10G:
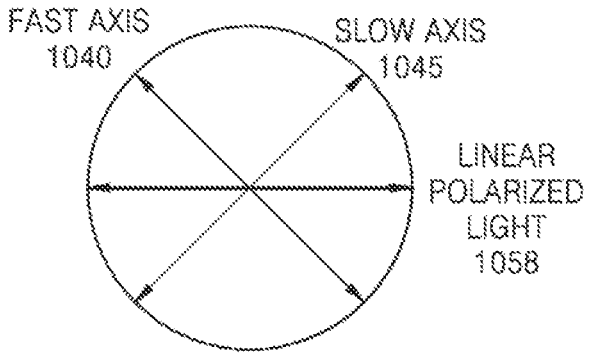
FIG. 10G is a diagram for describing a process of controlling a luminance by an electronic apparatus according to an embodiment of the disclosure.

FIG. 10G illustrates an example of linear polarized light having passed through the second display 265. According to an embodiment of the disclosure, as the linear polarized light 1056 is parallel to the orientation of the gap in the polarizer in the second display 265, linear polarized light 1058 having passed through the second display 265 may have the same intensity and angle of polarization as the linear polarized light 1056.

Referring to FIGS. 10C and 10G, the linear polarized light 1050 having passed through the first display 260 and the linear polarized light 1058 having passed through the second display 265 may have the same intensity. According to an embodiment of the disclosure, the electronic apparatus 100 may identify the first polarization angle variation 1060 corresponding to the first area in the first polarization modulation array 280 and the second polarization angle variation 1065 corresponding to the first area in the second polarization modulation array 285 for maximizing the luminance of the second display 265 or controlling the luminance of the second display 265 to be the same as the reference luminance, and respectively control the first polarization modulation array 280 and the second polarization modulation array 285, based on the first polarization angle variation 1060 and the second polarization angle variation 1065. Accordingly, the linear polarized light 1050 having passed through the first display 260 and the linear polarized light 1058 having passed through the second display 265 may have the same intensity, thereby a reduction in the luminance of the second display 265 can be prevented.

Figure 11:
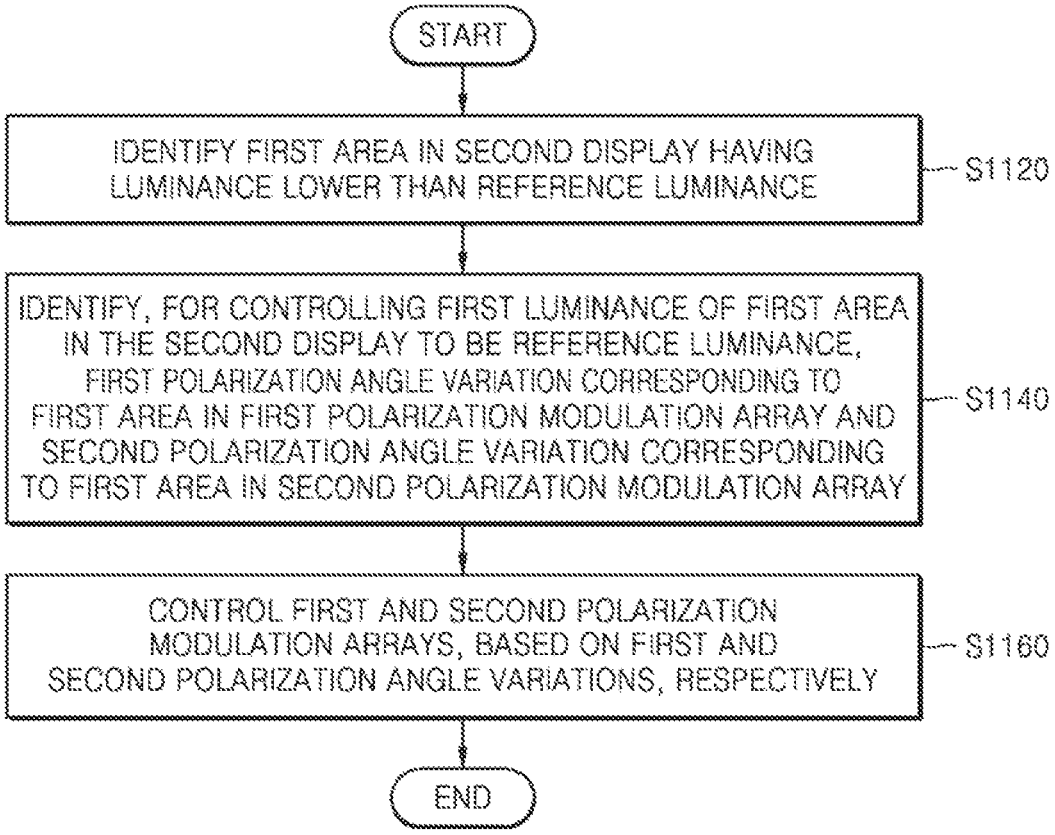
FIG. 11 is a flowchart of a process of controlling a luminance by an electronic apparatus according to an embodiment of the disclosure.

FIG. 11 is a flowchart of a process of controlling a luminance by an electronic apparatus according to an embodiment of the disclosure.

In operation S1120, the electronic apparatus may identify a first area having a luminance lower than a reference luminance in a second display.

According to an embodiment of the disclosure, the reference luminance may be a maximum luminance of a reference area in the second display. For example, the electronic apparatus may identify the luminance of the reference area in the second display, and identify, for maximizing the luminance of the reference area, a third polarization angle variation corresponding to a reference area in a first polarization modulation array and a fourth polarization angle variation corresponding to a reference area in a second polarization modulation array. The electronic apparatus may respectively control the first and second polarization modulation arrays, based on the third and fourth polarization angle variations, so that the reference area may have a maximum luminance.

According to an embodiment of the disclosure, the electronic apparatus may identify a difference value between a luminance of a reference area in a first display and the luminance in the reference area in the second display area, and identify the third polarization angle variation and the fourth polarization angle variation for minimizing the difference.

According to an embodiment of the disclosure, the third polarization angle variation and the fourth polarization angle variation may be the same as an angle of a fast or slow axis of a lens array with respect to the X-axis.

According to an embodiment of the disclosure, the electronic apparatus may include a camera for identifying the luminance of the reference area and identify the luminance of the reference area according to a viewing angle of the camera.

In operation S1140, the electronic apparatus may identify, for controlling a first luminance of the first area to be a reference luminance, a first polarization angle variation corresponding to a first area in the first polarization modulation array and a second polarization angle variation corresponding to a first area in the second polarization modulation array.

According to an embodiment of the disclosure, the electronic apparatus may control a rotation angle of the lens array, and identify the first and second polarization angle variations, based on the rotation angle of the lens array.

In operation S1160, the electronic apparatus may respectively control the first and second polarization modulation arrays, based on the first and second polarization angle variations. Therefore, the luminance of the first area in the second display may be the same as the reference luminance.

Figure 12:
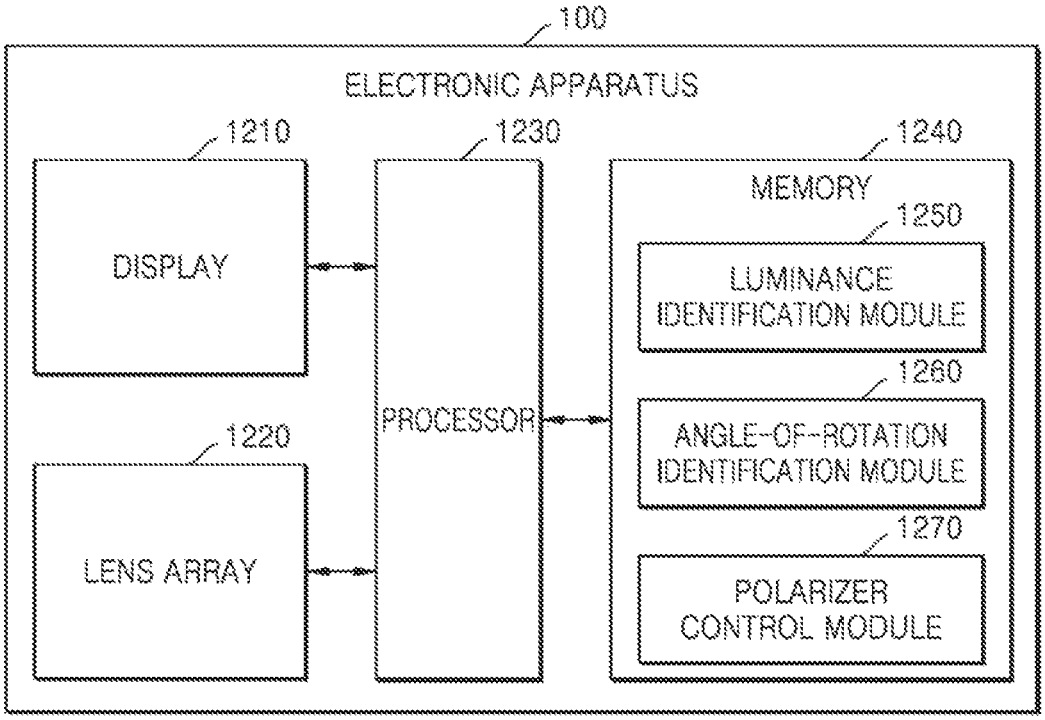
FIG. 12 is a block diagram of an electronic apparatus according to an embodiment of the disclosure.

FIG. 12 is a block diagram of an electronic apparatus 1200 according to an embodiment of the disclosure.

According to an embodiment of the disclosure, the electronic apparatus 100 may include a display 1210, a lens array 1220, a polarization modulation array 1230, and a processor 1240. However, components of the electronic apparatus 1200 are not limited thereto, and the electronic apparatus 1200 may further include other components or include some of the components.

The display 1210 may display various types of content such as text, images, moving pictures, icons, or symbols. According to an embodiment of the disclosure, the display 1210 may include, but is not limited to, at least one of an LCD, an LED display, an OLED display, a micro-LED display, a DMD, or an LCoS display device.

In an embodiment of the disclosure, the display 1210 may include a plurality of displays. For example, the display 1210 may include a first display and a second display. According to an embodiment of the disclosure, each of the first display and the second display may include a vertical polarizer, a horizontal polarizer, and a cell.

The lens array 1220 may include a field-of-view separator such as a lenticular lens to allow a user to view different images according to a viewing position. According to an embodiment of the disclosure, the lens array 1220 may include a plurality of lenticular lenses having different pattern angles to realize a fine parallax.

The processor 1230 may execute at least one instruction stored in the memory 1240 to control overall operations of the electronic apparatus 1200.

For example, the processor 1230 may identify a luminance of the second display.

The processor 1230 may identify a first rotation angle corresponding to the first display and a second rotation angle corresponding to the second display for maximizing the luminance of the second display.

The processor 1230 may rotate a polarizer in the first display, based on the first rotation angle.

The processor 1230 may rotate a polarizer in the second display, based on the second rotation angle.

The memory 1240 may include a luminance identification module 1250, an angle-of-rotation identification module 1260, and a polarizer control module 1270.

The luminance identification module 1250 may store instructions for identifying the luminance of the second display.

The angle-of-rotation identification module 1260 may store instructions for identifying the first rotation angle corresponding to the first display and the second rotation angle corresponding to the second display for maximizing the luminance of the second display.

The polarizer control module 1270 may store instructions for rotating the polarizer in the first display, based on the first rotation angle, and rotating the polarizer in the second display, based on the second rotation angle.

FIGS. 13A to 13D illustrate an operation of an electronic apparatus of the related art.

Figure 13A:
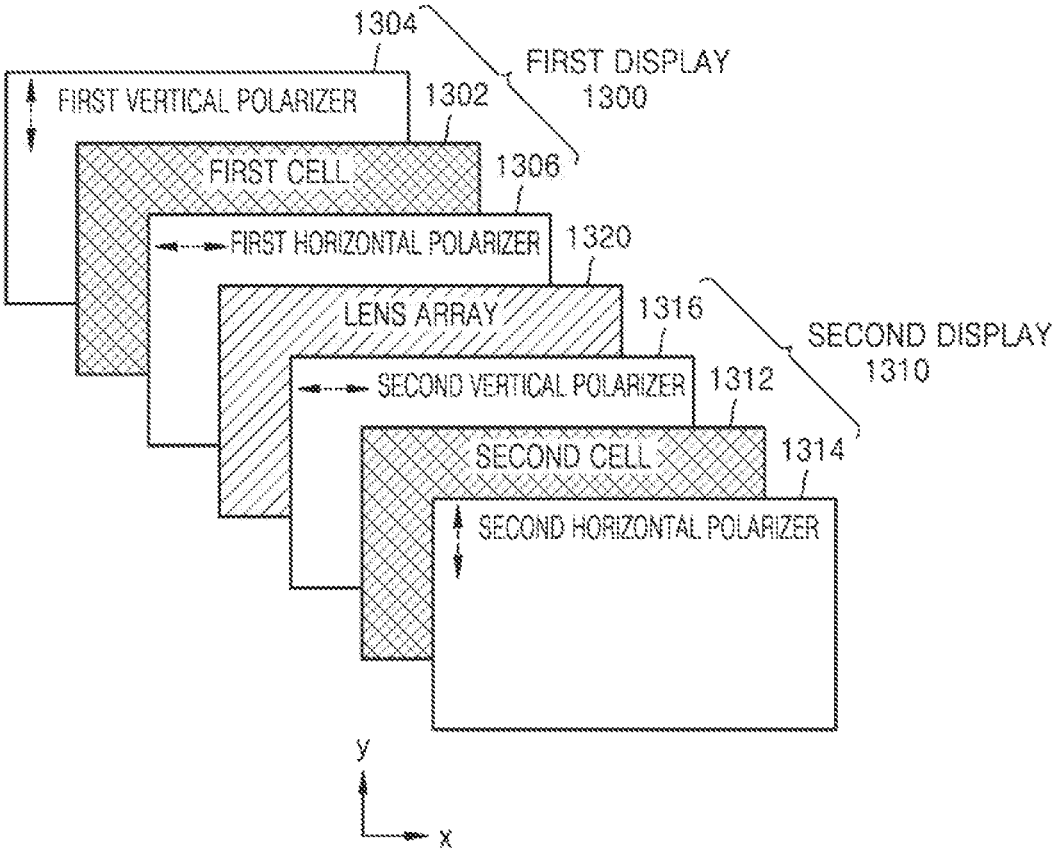
FIG. 13A illustrates an operation of an electronic apparatus of the related art.

FIG. 13A illustrates a configuration of the electronic apparatus of the related art. The electronic apparatus of the related art may include a first display 1300, a second display 1310, and a lens array 1320. In this case, the lens array 1320 may be positioned between the first display 1300 and the second display 1310.

The first display 1300 may include a first vertical polarizer 1304, a first cell 1302, and a first horizontal polarizer 1306, and the second display 1310 may include a second horizontal polarizer 1316, a second cell 1312, and a second vertical polarizer 1314. However, components of the electronic apparatus of the related art are not limited thereto, and the electronic apparatus may further include other components or include some of the components.

Figure 13B:
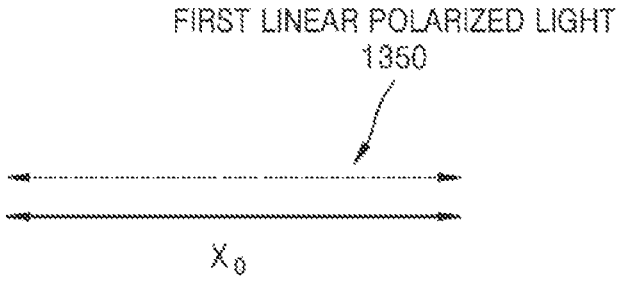
FIG. 13B illustrates an operation of an electronic apparatus of the related art.

FIG. 13B illustrates an example of polarized light having passed through the first display 1300 of the electronic apparatus of the related art. For example, when all of pieces of light from backlight unit are pieces of white light, only a component parallel to an orientation of a gap in the first horizontal polarizer 1306 in the first display 1300 among components of the pieces of white light may pass through the first horizontal polarizer 1306. Thus, the first linear polarized light 1350 may be linear polarized light that has an amplitude $X_0$ and forms an angle of 0° with the X-axis.

Figure 13C:
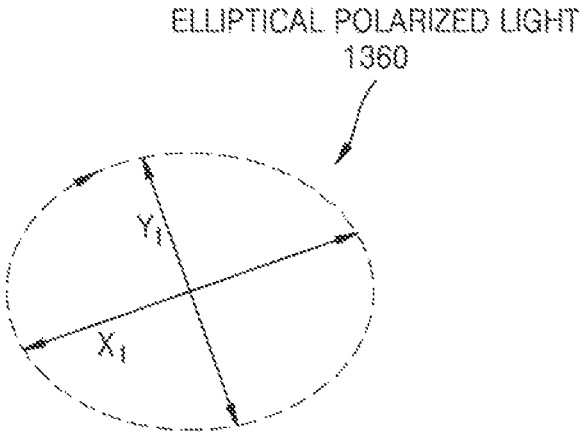
FIG. 13C illustrates an operation of an electronic apparatus of the related art.

FIG. 13C illustrates an example of polarized light having passed through the lens array 1320 of the electronic apparatus of the related art. Due to a birefringent feature of the lens array 1320, the first linear polarized light 1350 may change to elliptical polarized light 1360 while passing through the lens array 1320. For example, when the lens array 1320 has the quarter-wave plate feature, the first linear polarized light 1350 may change to the elliptical polarized light 1360 while passing through the lens array 1320.

The elliptical polarized light 1360 may include a component having an amplitude $X_1$ in a direction of a fast axis (or a slow axis) of the lens array 1320 and a component having an amplitude $Y_1$ in the direction of the slow axis (or the fast axis). A relation between an amplitude of each component and an amplitude of the first polarized light 1350 may be expressed by Equation (7) below.

$$X_1^2+Y_1^2=X_0^2 \quad \text{Equation (7)}$$

Figure 13D:
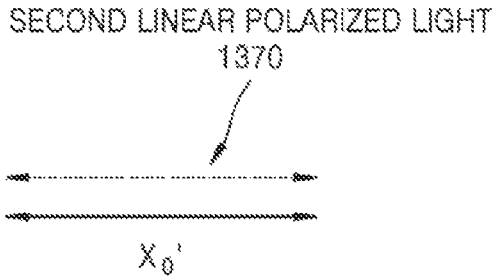
FIG. 13D illustrates an operation of an electronic apparatus of the related art.

FIG. 13D illustrates an example of polarized light having passed through the second display 1310 of the electronic apparatus of the related art. Only a component parallel to an orientation of a gap in the second horizontal polarizer 1316 in the second display 1310 among components of elliptical polarized light having passed through the lens array 1320 may pass through the second horizontal polarizer 1316. Thus, the second linear polarized light 1370 may be linear polarized light that has an amplitude $X_0'$ and forms an angle of 0° with the X-axis.

The amplitude $X_0'$ of the second linear polarized light 1370 may be less than the amplitude $X_0$ of the first linear polarized light 1350. As a result, the luminance of the second display 1310 may decrease.

FIGS. 14A to 14D illustrate an operation of an electronic apparatus 1200 according to an embodiment of the disclosure.

Figure 14A:
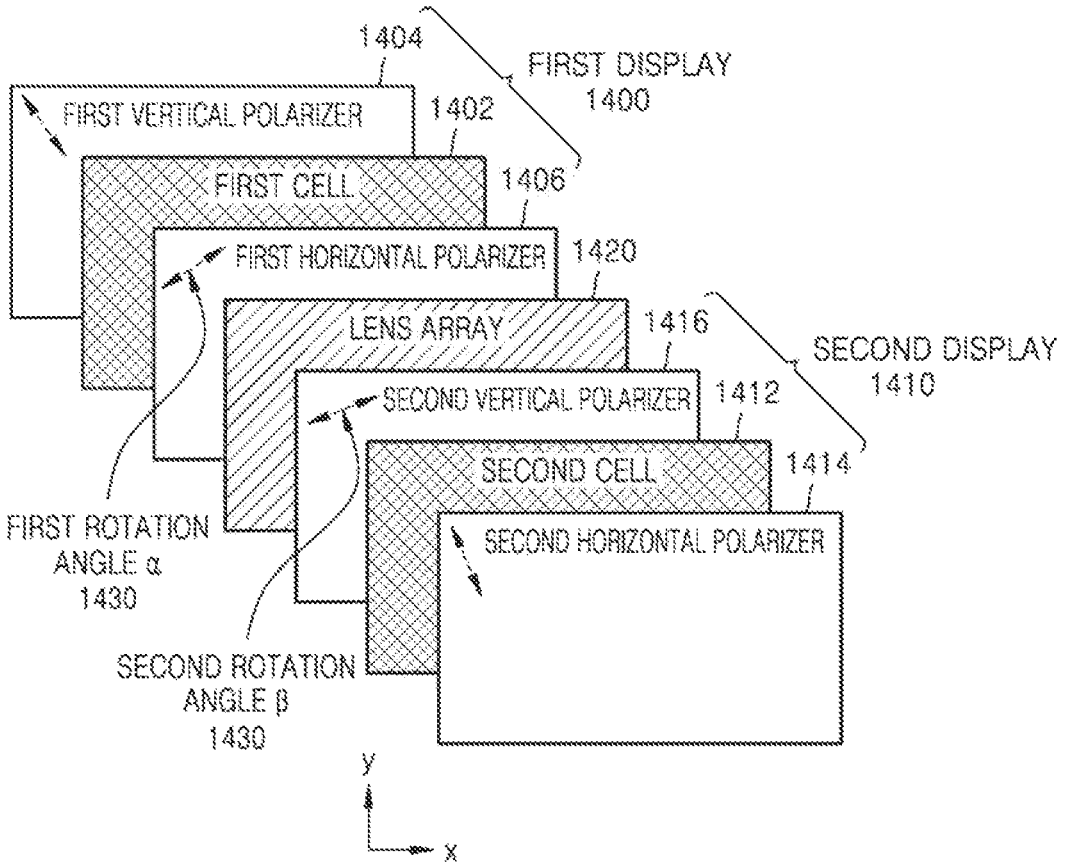
FIG. 14A illustrates an operation of an electronic apparatus according to an embodiment of the disclosure.

FIG. 14A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

According to an embodiment of the disclosure, the first display 1400 and the second display 1410 may correspond to the display 1210 of FIG. 12, and the lens array 1420 may correspond to the lens array 1220 of FIG. 12.

According to an embodiment of the disclosure, the electronic apparatus 1200 may identify a rotation angle of a polarizer in a display for maximizing a luminance of the second display 1410, and rotate the polarizer in the display, based on the rotation angle. For example, the electronic apparatus 1200 may rotate the first horizontal polarizer 1406 in the first display 1400 by a first rotation angle 1430, i.e., $\alpha$, and rotate the first vertical polarizer 1404 such that an orientation of a gap in the first vertical polarizer 1404 is perpendicular to an orientation of a gap in the first horizontal polarizer 1406. In addition, the electronic apparatus 1200 may rotate the second horizontal polarizer 1416 in the second display 1410 by a second rotation angle 1440, i.e., $\beta$, and rotate the second vertical polarizer 1414 such that an orientation of a gap in the second vertical polarizer 1414 is perpendicular to an orientation of a gap in the second horizontal polarizer 1416.

Figure 14B:
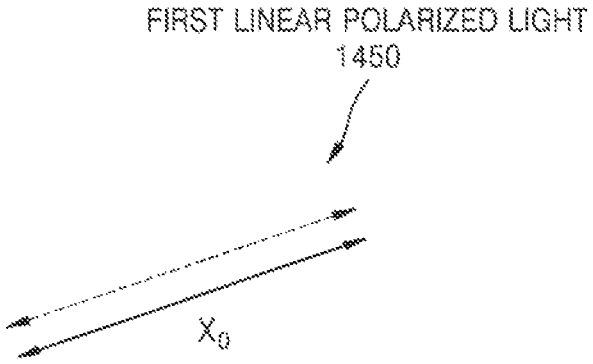
FIG. 14B illustrates an operation of an electronic apparatus according to an embodiment of the disclosure.

FIG. 14B illustrates an example of polarized light having passed through the first display 1400 of the electronic apparatus 1200. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, because the first horizontal polarizer 1406 rotates by the first rotation angle 1430, the first linear polarized light 1450 may be linear polarized light that has an amplitude $X_0$ and forms an angle $\alpha$ with the X-axis.

Figure 14C:
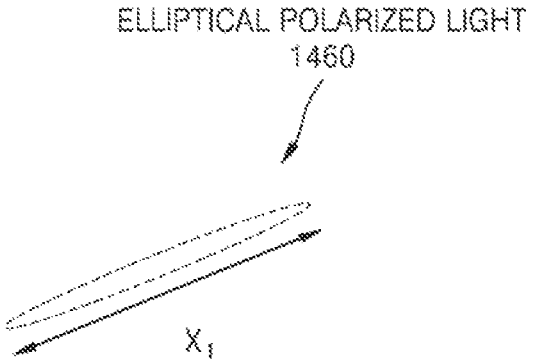
FIG. 14C illustrates an operation of an electronic apparatus according to an embodiment of the disclosure.

FIG. 14C illustrates an example of polarized light having passed through the lens array 1420. According to an embodiment of the disclosure, due to a birefringence feature of the lens array 1420, the first linear polarized light 1450 may change to elliptical polarized light 1460 while passing through the lens array 1420. For example, when the lens array 1420 has the quarter-wave plate feature, the first linear polarized light 1450 may change to the elliptical polarized light 1460 while passing through the lens array 1420.

According to an embodiment of the disclosure, as the first horizontal polarizer 1406 rotates by the first rotation angle 1430, the first linear polarized light 1450 having passed through the first horizontal polarizer 1406 may be parallel to the fast or slow axis of the lens array 1420 of forms a very small angle with the fast or slow axis of the lens array 1420. As a result, among components of the elliptical polarized light 1460, a component in a direction of the fast axis (or slow axis) of the lens array 1420 may have an amplitude $X_1$ and a component in a direction of the slow axis (or fast axis) may have a very low amplitude. A relation between the amplitude of the component in the fast axis (or the slow axis) and the amplitude of the first polarized light 1450 may be expressed by Equation (8) below.

$$X_1 \approx X_0 \quad \text{Equation (8)}$$

Figure 14D:
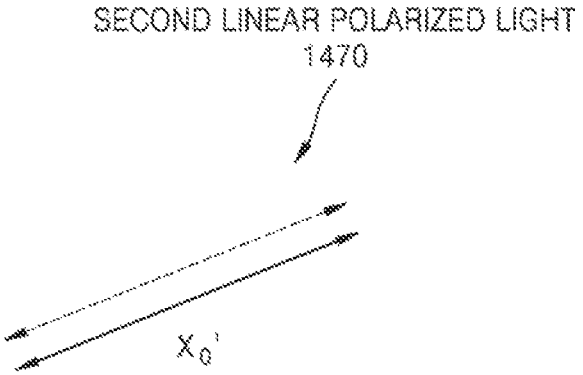
FIG. 14D illustrates an operation of an electronic apparatus according to an embodiment of the disclosure.

FIG. 14D illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of elliptical polarized light having passed through the lens array 1420 may pass through the second horizontal polarizer 1416. In this case, as the second horizontal polarizer 1416 rotates by the second rotation angle 1440, the orientation of the gap in the second horizontal polarizer 1416 may be parallel to the fast or slow axis of the lens array 1420 or form a very small angle with the fast or slow axis of the lens array 1420. As a result, the second linear polarized light 1470 may be linear polarized light that has an amplitude $X_0'$ and form an angle β with the X-axis.

In an embodiment of the disclosure, the $X_0'$ may be similar to or the same as an amplitude $X_0$ of the first linear polarized light 1450. As a result, a degree of reduction in the luminance of the second display 1410 may be minimized due to the birefringence feature of the lens array 1420.

Figure 15A:
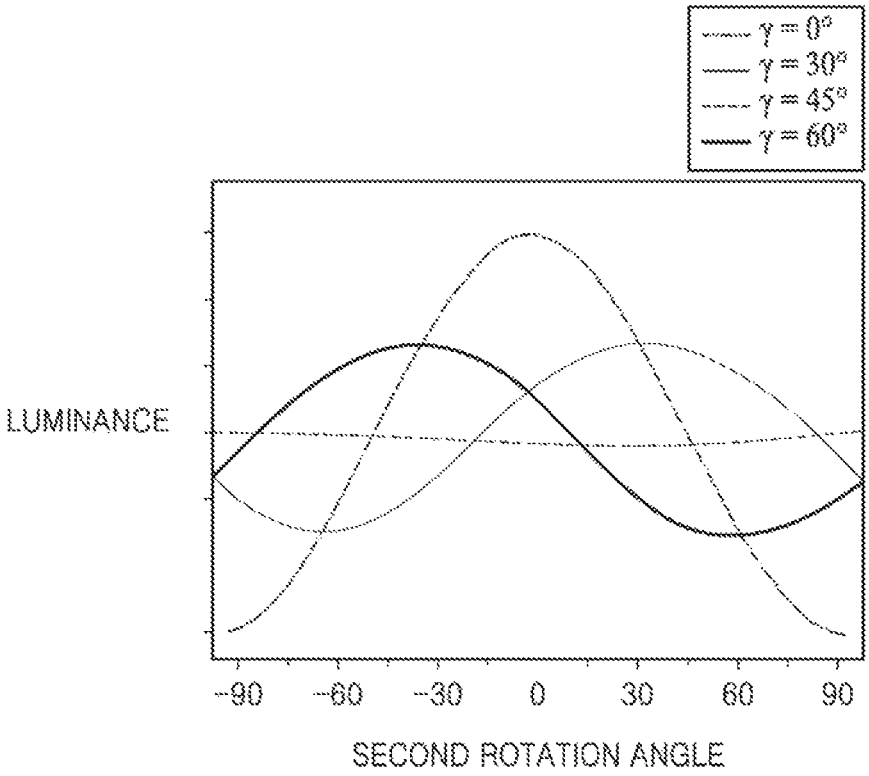
FIG. 15A is a diagram for describing a process of controlling a luminance by an electronic apparatus according to an embodiment of the disclosure.
Figure 15B:
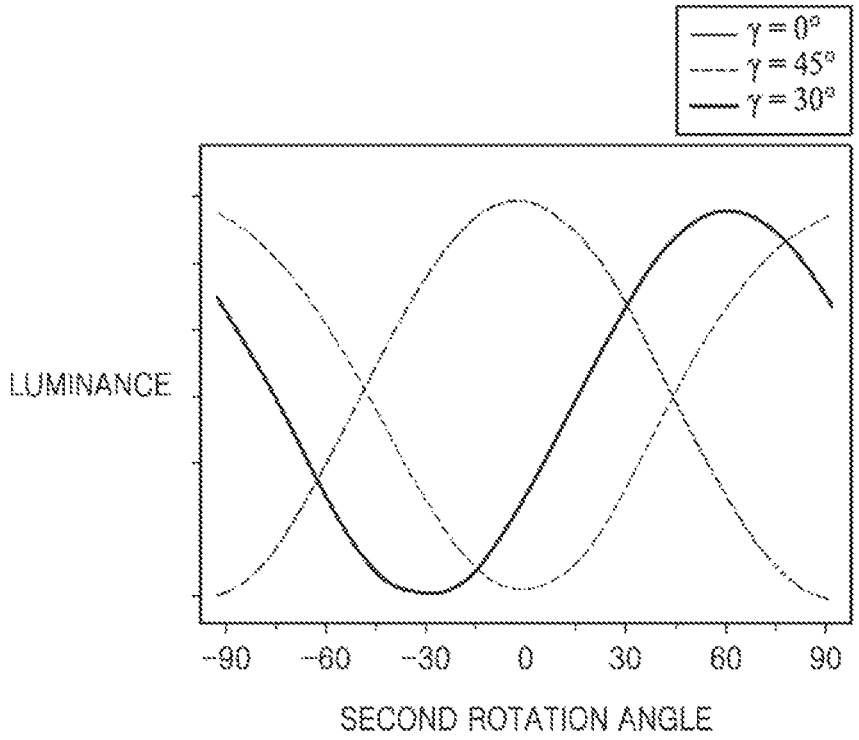
FIG. 15B is a diagram for describing a process of controlling a luminance by an electronic apparatus according to an embodiment of the disclosure.

FIGS. 15A and 15B are diagrams for describing a process of controlling a luminance by an electronic apparatus 1200 according to an embodiment of the disclosure.

According to an embodiment of the disclosure, the electronic apparatus 1200 may identify a luminance of the second display 1410 by rotating the lens array 1420 and the second display 1410 while the first display 1400 is fixed. For example, the electronic apparatus 1200 may identify the luminance of the second display 1410 by rotating the lens array 1420 and the polarizer in the second display 1410 while a rotation angle of the polarizer in the first display 1400 is fixed to 0°.

FIG. 15A illustrates an example of a luminance of the second display 1410 when the lens array 1420 has the quarter-wave plate feature. According to an embodiment of the disclosure, the electronic apparatus 1200 may identify a luminance of the second display 1410 by rotating the polarizer in the second display 1410 while the fast or slow axis of the lens array 1420 is rotated by 0°, 30°, 60° and 90°. For example, the second display 1410 may have a maximum luminance when a rotation angle of the fast or slow axis of the lens array 1420 is 0° and a rotation angle of the polarizer in the second display 1410 is 0°.

FIG. 15B illustrates an example of a luminance of the second display 1410 when the lens array 1420 has the half-wave plate feature. According to an embodiment of the disclosure, the electronic apparatus 1200 may identify a luminance of the second display 1410 by rotating the polarizer in the second display 1410 while the fast or slow axis of the lens array 1420 is rotated by 0°, 30°, 60° and 90°.

For example, the second display 1410 may have a maximum luminance when a rotation angle of the fast or slow axis of the lens array 1420 is 0° and a rotation angle of the polarizer in the second display 1410 is 0°. Otherwise, the second display 1410 may have a maximum luminance when a rotation angle of the fast or slow axis of the lens array 1420 is 30° and a rotation angle of the polarizer in the second display 1410 is 60°. The second display 1410 may have a maximum luminance when a rotation angle of the fast or slow axis of the lens array 1420 is 45° and a rotation angle of the polarizer in the second display 1410 is 90°.

Figure 16A:
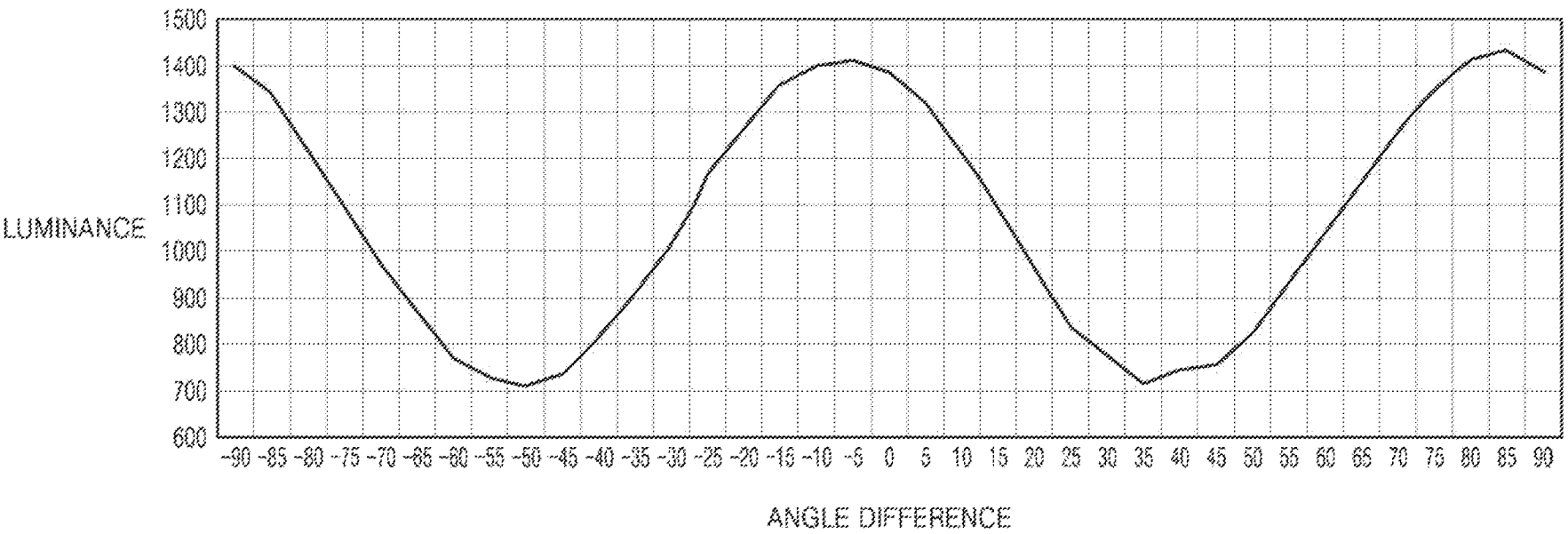
FIG. 16A is a diagram for describing a process of controlling a luminance by an electronic apparatus according to an embodiment of the disclosure.

FIGS. 16A and 16B are diagrams for describing a process of controlling a luminance by an electronic apparatus 1200 according to an embodiment of the disclosure.

In an embodiment of the disclosure, the electronic apparatus 1200 may identify an optimum rotation angle of the lens array 1420, and rotate the lens array 1420, based on the identified rotation angle. For example, the electronic apparatus 1200 may identify an optimum rotation angle of the lens array 1420 for reducing crosstalk, and rotate the lens array 1420, based on the identified rotation angle. According to another embodiment, the electronic apparatus 1200 may identify an optimum rotation angle for effectively reducing the moiré phenomenon, and rotate the lens array 1420, based on the identified rotation angle. However, the above description is only intended to provide an embodiment of the disclosure, and the electronic apparatus 1200 may identify an optimum rotation angle of the lens array 1420 in consideration of the number of views, resolution, parallax, etc.

In an embodiment of the disclosure, the electronic apparatus 1200 may identify the luminance of the second display 1410 by simultaneously rotating the polarizers in the first display 1400 and the second display 1410 while the lens array 1420 is rotated by the identified rotation angle. For example, the electronic apparatus 1200 may identify a luminance of the second display 1410 by simultaneously rotating the polarizers in the first display 1400 and the second display 1410 while the fast or slow axis of the lens array 1420 is rotated by 16.5°.

FIG. 16A illustrates an example of a luminance of the second display 1410 when the polarizers in the first display 1400 and the second display 1410 are simultaneously rotated while the fast or slow axis of the lens array 1420 is rotated by 16.5. According to an embodiment of the disclosure, when the difference between angles of the polarizers in the first display 1400 and the second display 1410 with the lens array 1420 is −5°, the second display 1410 may have a maximum luminance. Otherwise, when the difference between angles of the polarizers in the first display 1400 and the second display 1410 with the lens array 1420 is 85°, the second display 1410 may have a maximum luminance. This means that when the difference between the angles of the polarizers in the first display 1400 and the second display 1410 with the lens array 1420 is −5° or 85°, an orientation of a gap in the polarizer in the second display 1410 is parallel to the fast or slow axis of the lens array 1420.

FIG. 16B illustrates an example of a luminance of the second display 1410 when the polarizers in the first display 1400 and the second display 1410 are simultaneously rotated while the fast or slow axis of the lens array 1420 is rotated by 16.5. According to an embodiment of the disclosure, when the polarizers in the first display 1400 and the second display 1410 rotate by 21.5°, the second display 1410 may have a maximum luminance of 1407. That is, as the polarizers in the first display 1400 and the second display 1410 rotate by 21.5°, the luminance of the second display 1410 may be higher by 34% than a luminance of 8513 of the second display 1410 when the polarizers in the first display 1400 and the second display 1410 do not rotate.

A rotation angle of the polarizers in the first display 1400 and the second display 1410 for maximizing a luminance of the second display 1410 may vary according to an arrangement of the lens array 1420. For example, FIGS. 16A and 16B illustrate a luminance when the lens array 1420 is inverted and thus angles of rotation of the polarizers in the first display 1400 and the second display 1410 for maximizing a luminance of the second display 1410 are different from each other.

FIGS. 17A to 17E are diagrams for describing a process of controlling a luminance by an electronic apparatus 1200 according to an embodiment of the disclosure.

Figure 17A:
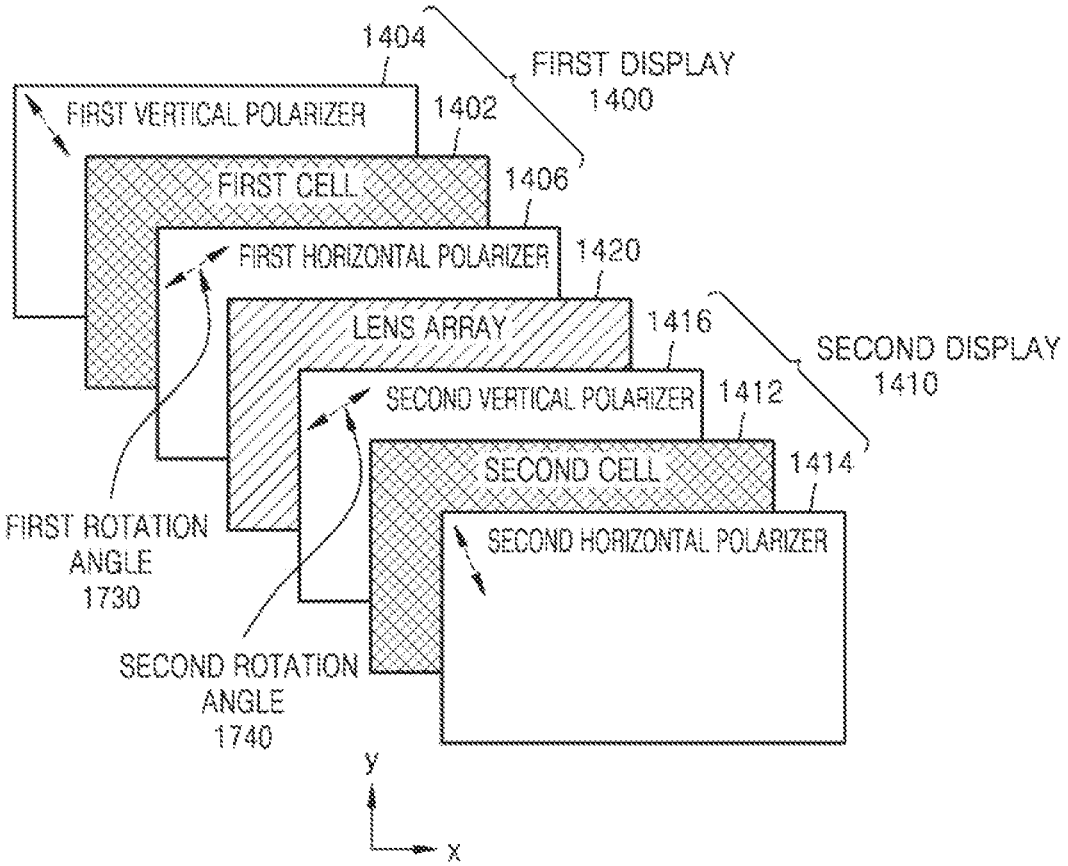
FIG. 17A is a diagram for describing a process of controlling a luminance by an electronic apparatus according to an embodiment of the disclosure.

FIG. 17A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

According to an embodiment of the disclosure, the electronic apparatus 1200 may identify a rotation angle of a polarizer in a display for maximizing a luminance of the second display 1410, and rotate the polarizer in the display, based on the rotation angle. For example, the electronic apparatus 1200 may rotate the first horizontal polarizer 1406 in the first display 1400 by a first rotation angle 1730, and rotate the first vertical polarizer 1404 such that an orientation of a gap in the first vertical polarizer 1404 is perpendicular to an orientation of a gap in the first horizontal polarizer 1406. In addition, the electronic apparatus 1200 may rotate the second horizontal polarizer 1416 in the second display 1410 by a second rotation angle 1740, and rotate the second vertical polarizer 1414 such that an orientation of a gap in the second vertical polarizer 1414 is perpendicular to an orientation of a gap in the second horizontal polarizer 1416.

In this case, as a result of rotating the first horizontal polarizer 1406 by the first rotation angle 1730, the orientation of the gap in the first horizontal polarizer 1406 may be parallel to a slow axis 1755 of the lens array 1420. In addition, as a result of rotating the second horizontal polarizer 1416 by the second rotation angle 1740, the orientation of the gap in the second horizontal polarizer 1416 may be parallel to the slow axis 1755 of the lens array 1420.

Figure 17B:
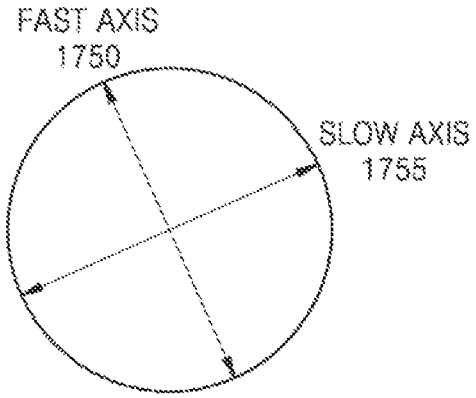
FIG. 17B is a diagram for describing a process of controlling a luminance by an electronic apparatus according to an embodiment of the disclosure.

FIG. 17B illustrates examples of a fast axis and a slow axis of the lens array 1420. According to an embodiment of the disclosure, the lens array 1420 may have the quarter-wave plate feature, and the fast axis 1750 and the slow axis 1755 of the lens array 1420 may be formed as illustrated in FIG. 17B.

Figure 17C:
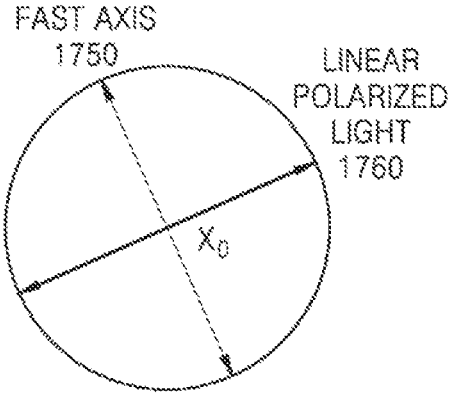
FIG. 17C is a diagram for describing a process of controlling a luminance by an electronic apparatus according to an embodiment of the disclosure.

FIG. 17C illustrates an example of linear polarized light having passed through the first display 1400. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, because the orientation of the gap in the first horizontal polarizer 1406 is parallel to the slow axis 1755 of the lens array 1420, linear polarized light 1760 may be linear polarized light that has an amplitude $X_0$ and is parallel to the slow axis 1755 of the lens array 1420.

Figure 17D:
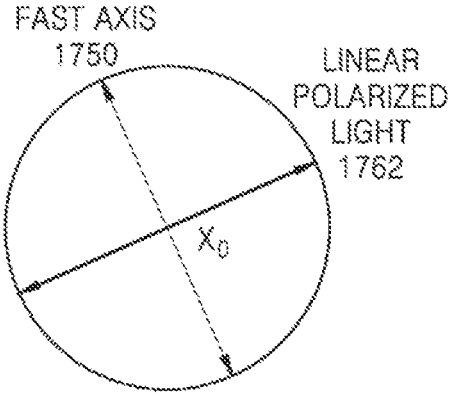
FIG. 17D is a diagram for describing a process of controlling a luminance by an electronic apparatus according to an embodiment of the disclosure.

FIG. 17D illustrates an example of polarized light having passed through the lens array 1420. According to an embodiment of the disclosure, when the lens array 1420 has the quarter-wave plate feature, the amplitude of and an angle of polarization of the linear polarized light 1760 may be maintained. For example, because the linear polarized light 1760 is parallel to the slow axis 1755 of the lens array 1420, the linear polarized light 1760 may change to linear polarized light 1762 having the same amplitude and angle of polarization as the linear polarized light 1760 when the linear polarized light 1760 passes through the lens array 1420.

Figure 17E:
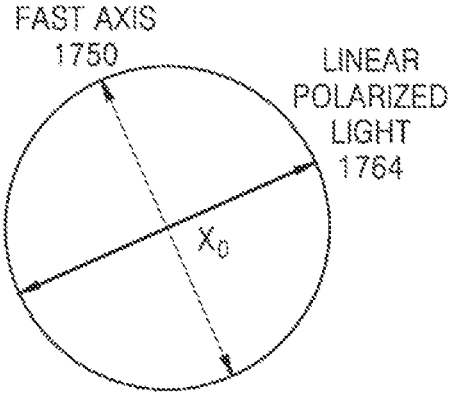
FIG. 17E is a diagram for describing a process of controlling a luminance by an electronic apparatus according to an embodiment of the disclosure.

FIG. 17E illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of linear polarized light having passed through the lens array 1420 may pass through the second horizontal polarizer 1416. In this case, because the orientation of the gap in the second horizontal polarizer 1416 is parallel to the slow axis 1755 of the lens array 1420, the linear polarized light 1764 may be linear polarized light having an amplitude $X_0$ and parallel to the slow axis 1755 of the lens array 1420.

In an embodiment of the disclosure, the amplitude $X_0$ of the linear polarized light 1764 may be the same as the amplitude $X_0$ of the linear polarized light 1760. As a result, the luminance of the second display 1410 may not reduce due to the birefringence feature of the lens array 1420.

FIGS. 18A to 18E are diagrams for describing a process of controlling a luminance by an electronic apparatus 1200 according to an embodiment of the disclosure.

Figure 18A:
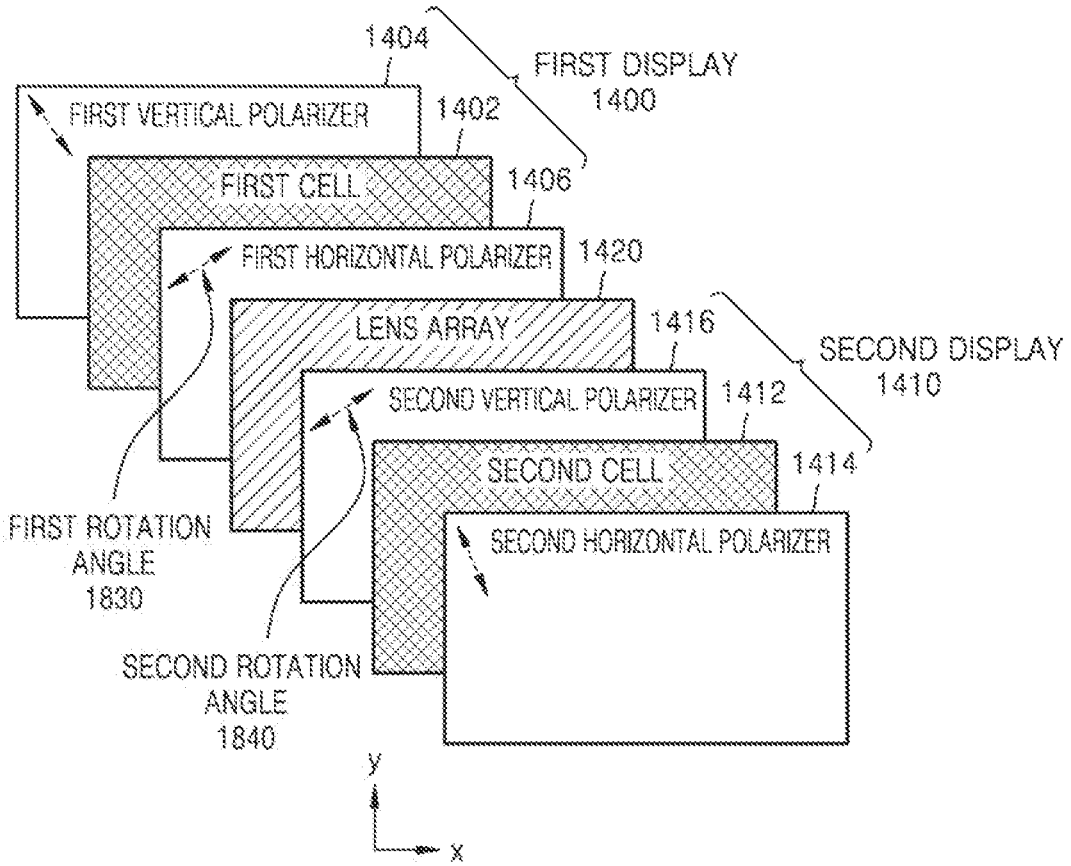
FIG. 18A is a diagram for describing a process of controlling a luminance by an electronic apparatus according to an embodiment of the disclosure.

FIG. 18A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

According to an embodiment of the disclosure, the electronic apparatus 1200 may identify a rotation angle of a polarizer in a display for maximizing a luminance of the second display 1410, and rotate the polarizer in the display, based on the rotation angle. For example, the electronic apparatus 1200 may rotate the first horizontal polarizer 1406 in the first display 1400 by a first rotation angle 1830, and rotate the first vertical polarizer 1404 such that an orientation of a gap in the first vertical polarizer 1404 is perpendicular to an orientation of a gap in the first horizontal polarizer 1406. In addition, the electronic apparatus 1200 may rotate the second horizontal polarizer 1416 in the second display 1410 by a second rotation angle 1840, and rotate the second vertical polarizer 1414 such that an orientation of a gap in the second vertical polarizer 1414 is perpendicular to an orientation of a gap in the second horizontal polarizer 1416.

In this case, as a result of rotating the first horizontal polarizer 1406 by the first rotation angle 1830, the orientation of the gap in the first horizontal polarizer 1406 may be parallel to a fast axis 1850 of the lens array 1420. In addition, as a result of rotating the second horizontal polarizer 1416 by the second rotation angle 1840, the orientation of the gap in the second horizontal polarizer 1416 may be parallel to the fast axis 1850 of the lens array 1420.

Figure 18B:
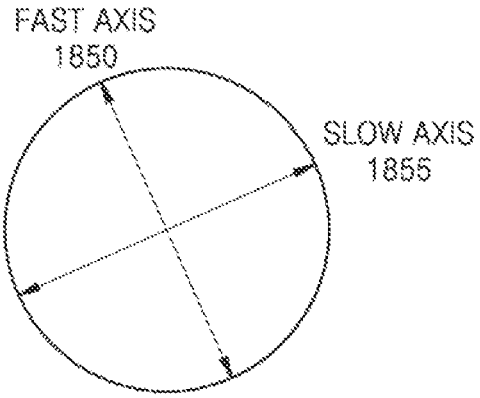
FIG. 18B is a diagram for describing a process of controlling a luminance by an electronic apparatus according to an embodiment of the disclosure.

FIG. 18B illustrates examples of a fast axis and a slow axis of the lens array 1420. According to an embodiment of the disclosure, the lens array 1420 may have the quarter-wave plate feature, and the fast axis 1850 and a slow axis 1855 of the lens array 1420 may be formed as illustrated in FIG. 18B.

Figure 18C:
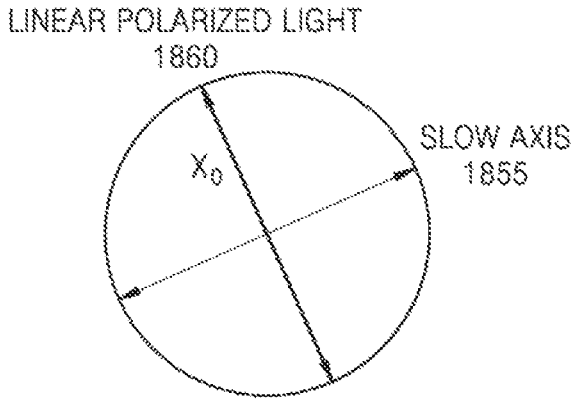
FIG. 18C is a diagram for describing a process of controlling a luminance by an electronic apparatus according to an embodiment of the disclosure.

FIG. 18C illustrates an example of linear polarized light having passed through the first display 1410. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, because the orientation of the gap in the first horizontal polarizer 1406 is parallel to the fast axis 1850 of the lens array 1420, linear polarized light 1860 may be linear polarized light that has an amplitude $X_0$ and is parallel to the fast axis 1850 of the lens array 1420.

Figure 18D:
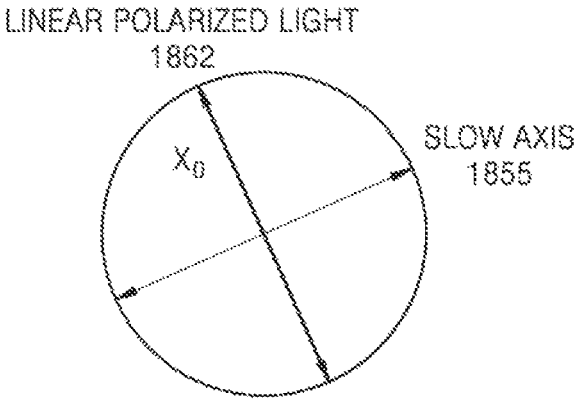
FIG. 18D is a diagram for describing a process of controlling a luminance by an electronic apparatus according to an embodiment of the disclosure.

FIG. 18D illustrates an example of polarized light having passed through the lens array 1420. According to an embodiment of the disclosure, when the lens array 1420 has the quarter-wave plate feature, the amplitude of and an angle of polarization of the linear polarized light 1860 may be maintained. For example, because the linear polarized light 1860 is parallel to the fast axis 1850 of the lens array 1420, the linear polarized light 1860 may change to linear polarized light 1862 having the same amplitude and angle of polarization as the linear polarized light 1860 when the linear polarized light 1860 passes through the lens array 1420.

Figure 18E:
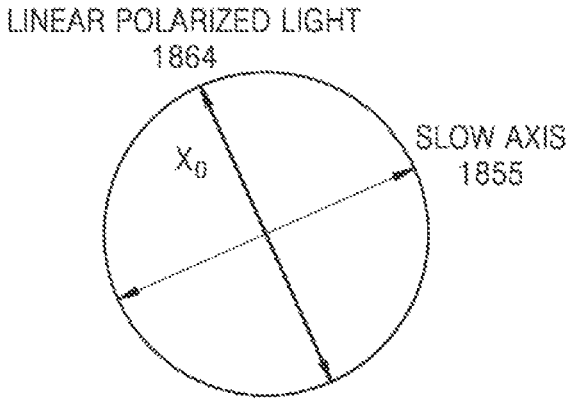
FIG. 18E is a diagram for describing a process of controlling a luminance by an electronic apparatus according to an embodiment of the disclosure.

FIG. 18E illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of linear polarized light having passed through the lens array 1420 may pass through the second horizontal polarizer 1416. In this case, because the orientation of the gap in the second horizontal polarizer 1416 is parallel to the fast axis 1850 of the lens array 1420, linear polarized light 1864 may be linear polarized light that has an amplitude $X_0$ and is parallel to the fast axis 1850 of the lens array 1420.

In an embodiment of the disclosure, the amplitude $X_0$ of the linear polarized light 1864 may be the same as the amplitude $X_0$ of the linear polarized light 1860. As a result, the luminance of the second display 1410 may not reduce due to the birefringence feature of the lens array 1420.

FIGS. 19A to 19E are diagrams for describing a process of controlling a luminance by an electronic apparatus 1200 according to an embodiment of the disclosure.

Figure 19A:
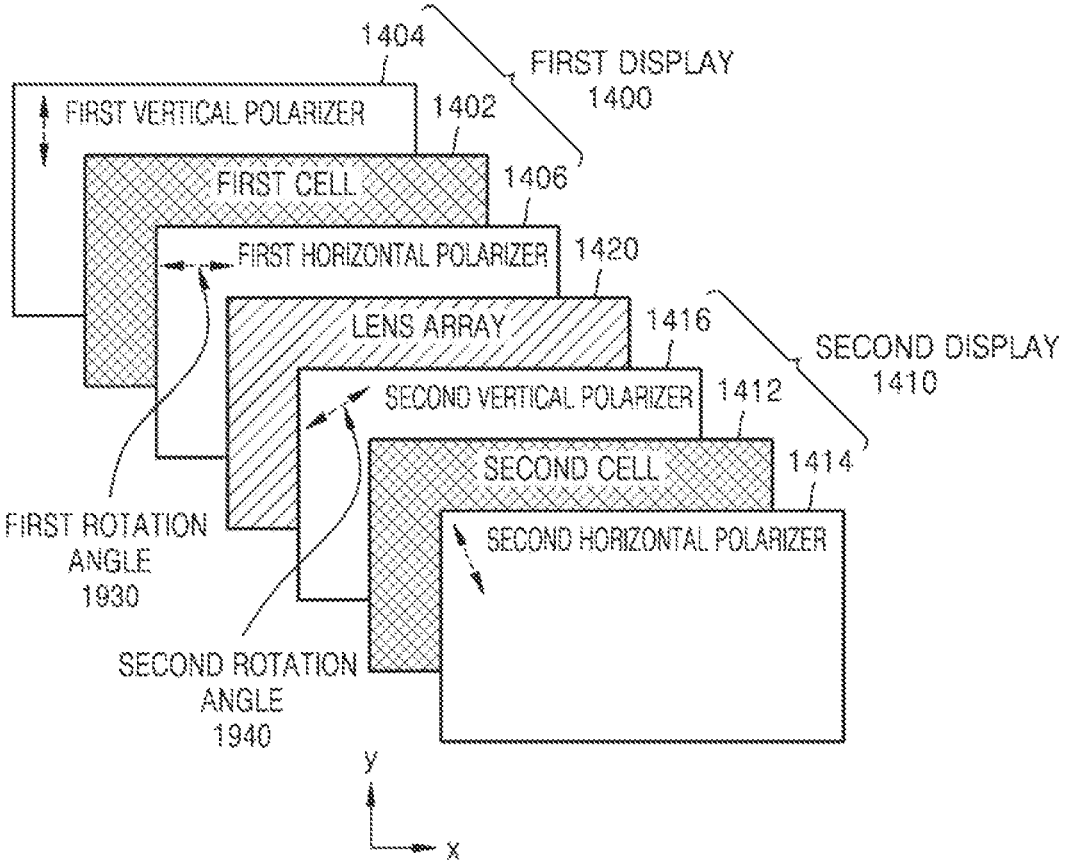
FIG. 19A is a diagram for describing a process of controlling a luminance by an electronic apparatus according to an embodiment of the disclosure.

FIG. 19A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

According to an embodiment of the disclosure, the electronic apparatus 1200 may identify a rotation angle of a polarizer in a display for maximizing a luminance of the second display 1410, and rotate the polarizer in the display, based on the rotation angle. For example, the electronic apparatus 1200 may rotate the first horizontal polarizer 1406 in the first display 1400 by a first rotation angle 1930, and rotate the first vertical polarizer 1404 such that an orientation of a gap in the first vertical polarizer 1404 is perpendicular to an orientation of a gap in the first horizontal polarizer 1406. In addition, the electronic apparatus 1200 may rotate the second horizontal polarizer 1416 in the second display 1410 by a second rotation angle 1940, and rotate the second vertical polarizer 1414 such that an orientation of a gap in the second vertical polarizer 1414 is perpendicular to an orientation of a gap in the second horizontal polarizer 1416.

According to an embodiment of the disclosure, when the lens array 1420 has the half-wave plate feature, the first rotation angle 1930 of the first horizontal polarizer 1406 in the first display 1400 may be a certain value. For example, referring to FIG. 19A, when the lens array 1420 has the half-wave plate feature, the first rotation angle 1930 of the first horizontal polarizer 1406 may be 0° as shown in FIG. 19A.

Figure 19B:
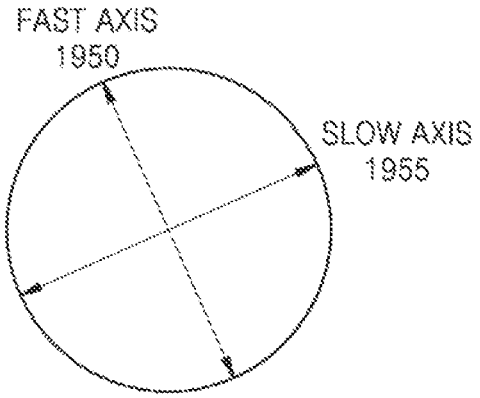
FIG. 19B is a diagram for describing a process of controlling a luminance by an electronic apparatus according to an embodiment of the disclosure.

FIG. 19B illustrates examples of a fast axis and a slow axis of the lens array 1420. According to an embodiment of the disclosure, the lens array 1420 may have the half-wave plate feature, and a fast axis 1950 and a slow axis 1955 of the lens array 1420 may be formed as illustrated in FIG. 19B.

Figure 19C:
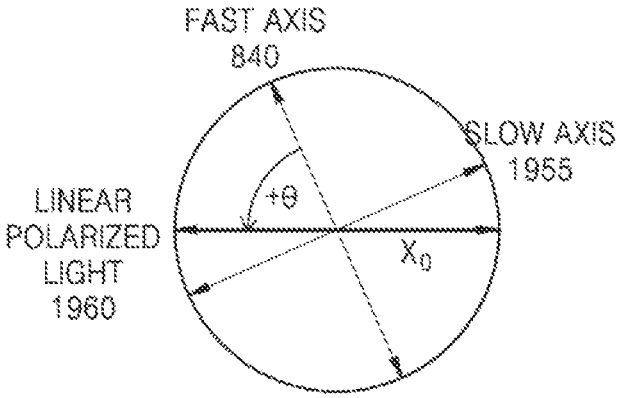
FIG. 19C is a diagram for describing a process of controlling a luminance by an electronic apparatus according to an embodiment of the disclosure.

FIG. 19C illustrates an example of linear polarized light having passed through the first display 1410. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, an angle of the orientation of the gap in the first horizontal polarizer 1406 with the X-axis is 0° and thus the linear polarized light 1960 may be linear polarized light that has an amplitude $X_0$ and forms an angle of 0° with the X-axis.

Figure 19D:
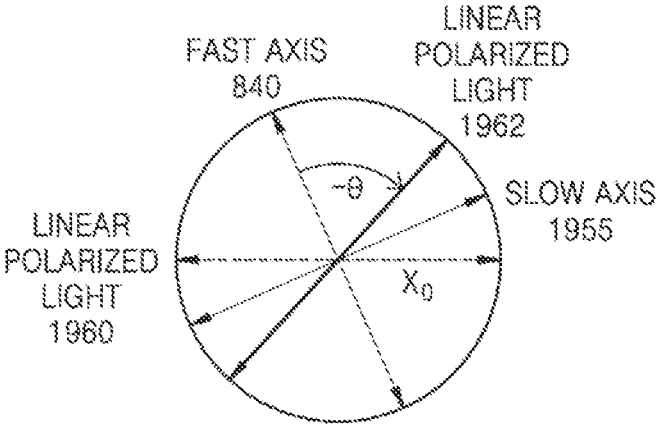
FIG. 19D is a diagram for describing a process of controlling a luminance by an electronic apparatus according to an embodiment of the disclosure.

FIG. 19D illustrates an example of polarized light having passed through the lens array 1420. According to an embodiment of the disclosure, when the lens array 1420 has the half-wave plate feature, the amplitude of the linear polarized light 1960 may be maintained but an angle of polarization of the linear polarized light 1960 may change. For example, when the linear polarized light 1960 forms an angle θ with the fast axis 1950 of the lens array 1420, the linear polarized light 1960 may rotate by −2θ to change to linear polarized light 1962 when passing through the lens array 1420.

Figure 19E:
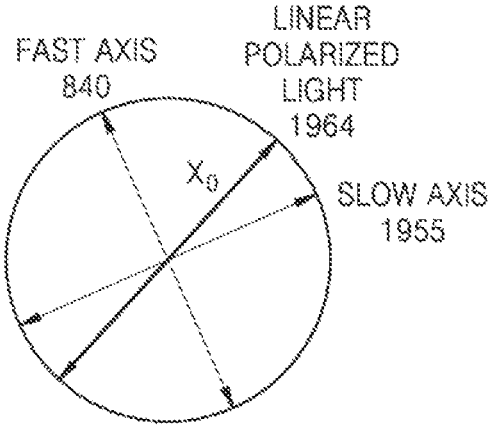
FIG. 19E is a diagram for describing a process of controlling a luminance by an electronic apparatus according to an embodiment of the disclosure.

FIG. 19E illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of linear polarized light having passed through the lens array 1420 may pass through the second horizontal polarizer 1416. In this case, the second horizontal polarizer 1416 is rotated to cause the orientation of the gap in the second horizontal polarizer 1416 to be parallel to the linear polarized light 1962 and thus linear polarized light 1964 may be linear polarized light having an amplitude and parallel to the linear polarized light 1962.

In an embodiment of the disclosure, the amplitude $X_0$ of the linear polarized light 1964 may be the same as the amplitude $X_0$ of the linear polarized light 1960. As a result, the luminance of the second display 1410 may not reduce due to the birefringence feature of the lens array 1420.

FIGS. 20A to 20F are diagrams for describing a process of controlling a luminance by an electronic apparatus 1200 according to an embodiment of the disclosure.

Figure 20A:
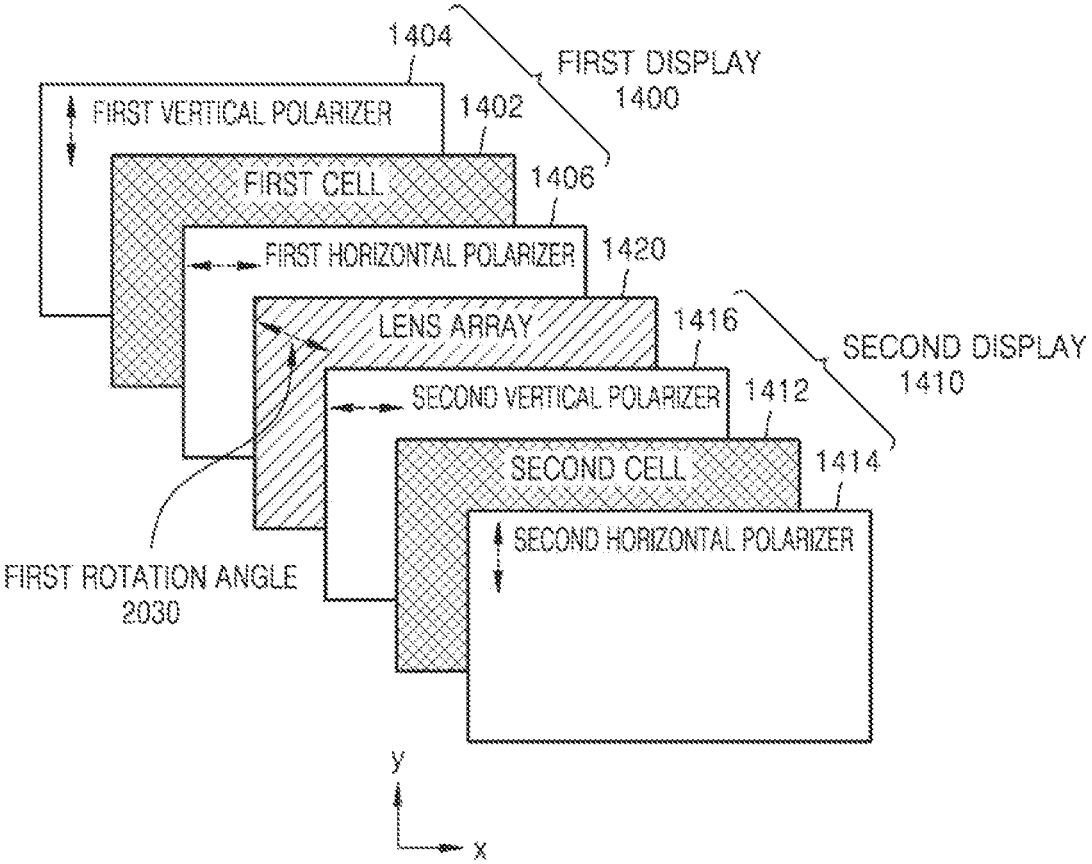
FIG. 20A is a diagram for describing a process of controlling a luminance by an electronic apparatus according to an embodiment of the disclosure.

FIG. 20A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

According to an embodiment of the disclosure, the electronic apparatus 1200 may identify a rotation angle of the lens array 1420 for maximizing a luminance of the second display 1410, and rotate the lens array 1420, based on the rotation angle. For example, the electronic apparatus 1200 may rotate the lens array 1420 by a rotation angle 2030.

In this case, as a result of rotating the lens array 1420 by the rotation angle 2030, a fast axis 2050 or a slow axis 2055 of the lens array 1420 may be parallel to orientations of gaps in the first horizontal polarizer 1406 and the second horizontal polarizer 1416.

Figure 20B:
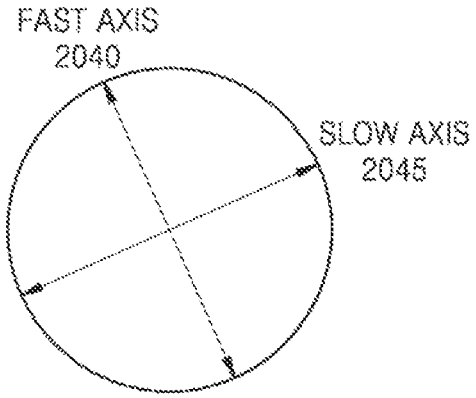
FIG. 20B is a diagram for describing a process of controlling a luminance by an electronic apparatus according to an embodiment of the disclosure.

FIG. 20B illustrates examples of a fast axis and a slow axis of the lens array 1420 before the lens array 1420 is rotated. According to an embodiment of the disclosure, the lens array 1420 may have the quarter-wave plate feature, and a fast axis 2040 and a slow axis 2045 of the lens array 1420 may be formed as illustrated in FIG. 20B.

Figure 20C:
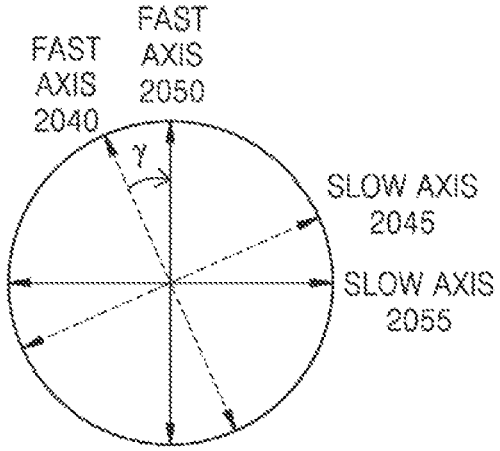
FIG. 20C is a diagram for describing a process of controlling a luminance by an electronic apparatus according to an embodiment of the disclosure.

FIG. 20C illustrates examples of a fast axis and a slow axis of the lens array 1420 after the lens array 1420 is rotated. According to an embodiment of the disclosure, a fast axis 2050 and a slow axis 2055 of the lens array 1420 may be formed as illustrated in FIG. 20C after the lens array 1420 is rotated by the rotation angle 2030.

Figure 20D:
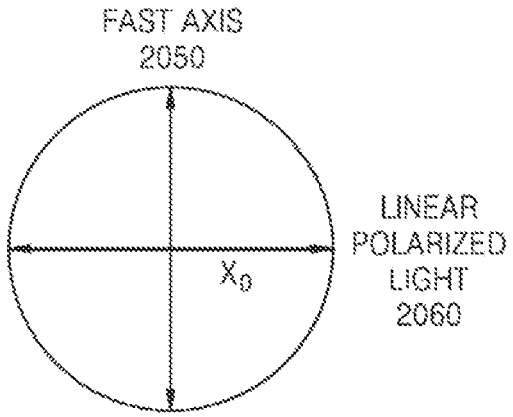
FIG. 20D is a diagram for describing a process of controlling a luminance by an electronic apparatus according to an embodiment of the disclosure.

FIG. 20D illustrates an example of linear polarized light having passed through the first display 1410. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, the first horizontal polarizer 1406 is not rotated and thus the linear polarized light 2060 may be linear polarized light having an amplitude $X_0$ and forming an angle of 0° with the X-axis.

Figure 20E:
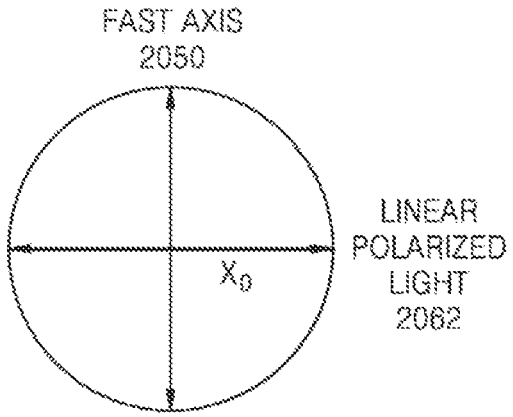
FIG. 20E is a diagram for describing a process of controlling a luminance by an electronic apparatus according to an embodiment of the disclosure.

FIG. 20E illustrates an example of polarized light having passed through the lens array 1420. According to an embodiment of the disclosure, when the fast axis 2050 or the slow shaft 2055 of the lens array 1420 is parallel to the linear polarized light 2060, an amplitude of and an angle of polarization of the linear polarized light 2060 may be maintained For example, the slow axis 2055 of the lens array 1420 is parallel to the linear polarized light 2060 due to the rotation of the lens array 1420 and thus the linear polarized light 2060 may change to linear polarized light 2062 having the same amplitude and angle of polarization as the linear polarized light 2060 when passing through the lens array 1420.

Figure 20F:
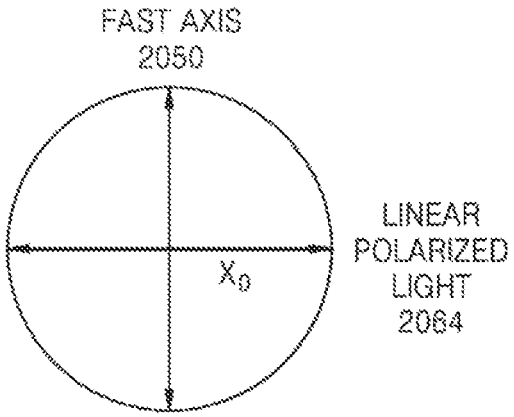
FIG. 20F is a diagram for describing a process of controlling a luminance by an electronic apparatus according to an embodiment of the disclosure.

FIG. 20F illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of linear polarized light having passed through the lens array 1420 may pass through the second horizontal polarizer 1416. In this case, an orientation in a gap in the second horizontal polarizer 1416 is parallel to the slow axis 2055 of the lens array 1420 and thus the linear polarized light 2064 may be linear polarized light having an amplitude $X_0$ and parallel to the slow axis 2055 of the lens array 1420.

In an embodiment of the disclosure, the amplitude $X_0$ of the linear polarized light 2064 may be the same as the $X_0$ of the linear polarized light 2060. As a result, the luminance of the second display 1410 may not reduce due to the birefringence feature of the lens array 1420.

Figure 21A:
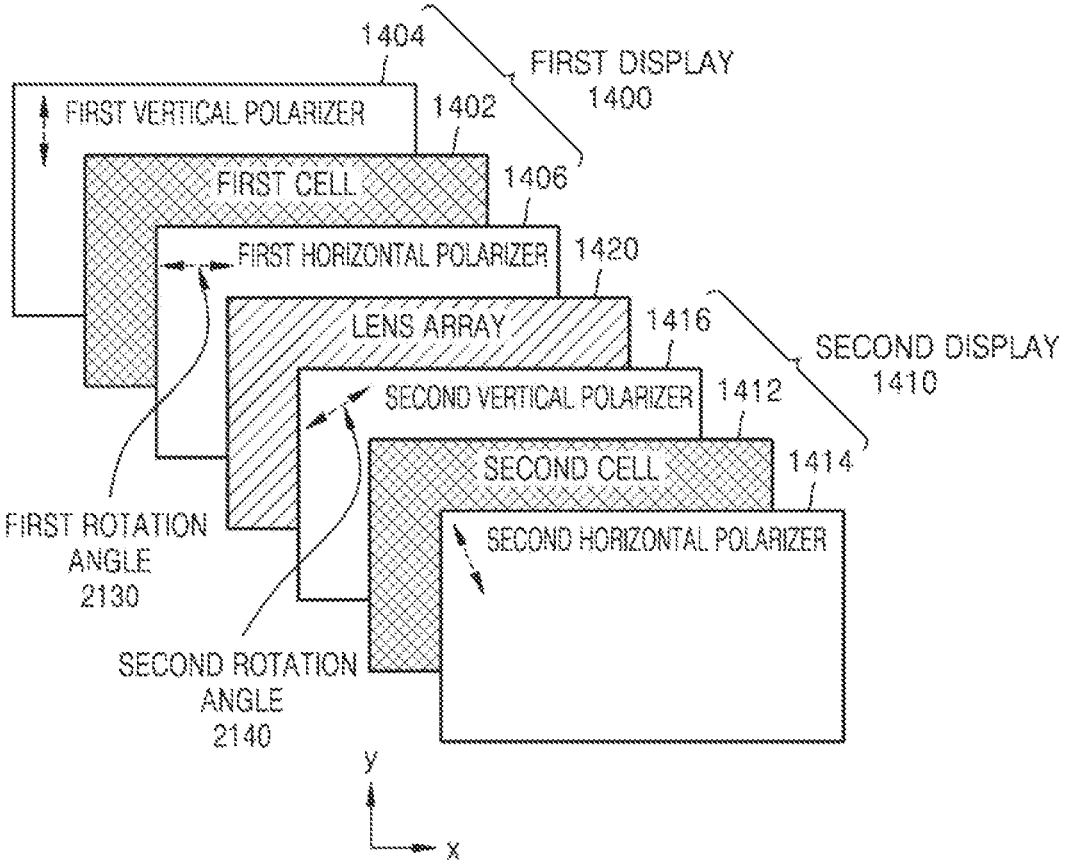
FIG. 21A is a diagram for describing a process of controlling a luminance by an electronic apparatus according to an embodiment of the disclosure.

FIGS. 21A to 20E are diagrams for describing a process of controlling a luminance by an electronic apparatus 1200 according to an embodiment of the disclosure.

FIG. 21A illustrates a configuration of the electronic apparatus 1200 according to an embodiment of the disclosure. According to an embodiment of the disclosure, the electronic apparatus 1200 may include a first display 1400, a second display 1410, and a lens array 1420. In this case, the lens array 1420 may be positioned between the first display 1400 and the second display 1410.

According to an embodiment of the disclosure, the first display 1400 may include a first vertical polarizer 1404, a first cell 1402, and a first horizontal polarizer 1406, and the second display 1410 may include a second horizontal polarizer 1416, a second cell 1412, and a second vertical polarizer 1414. However, components of the electronic apparatus 1200 are not limited thereto, and the electronic apparatus 1200 may further include other components or include some of the components.

In an embodiment of the disclosure, the electronic apparatus 1200 may identify a rotation angle of the polarizer in the second display 1410 for maximizing a luminance of the second display 1410 while the polarizer in the first display 1400 is not rotated. For example, the electronic apparatus 1200 may identify a second rotation angle 2140 of the polarizer in the second display 1410 for maximizing a luminance of the second display 1410 while a first rotation angle 2130 of the polarizer in the first display 1400 is fixed to 0°.

According to an embodiment of the disclosure, the electronic apparatus 1200 may rotate only the polarizer in the second display 1410, based on the identified second rotation angle 140. For example, the electronic apparatus 1200 may rotate the second horizontal polarizer 1416 in the second display 1410 by the second rotation angle 2140, and rotate the second vertical polarizer 1414 such that an orientation of a gap in the second vertical polarizer 1414 is perpendicular to an orientation of a gap in the second horizontal polarizer 1416.

In this case, as a result of rotating the second horizontal polarizer 1416 by the second rotation angle 2140, the orientation of the gap in the second horizontal polarizer 1416 may be parallel to the fast axis 2150 or the slow axis 2155 of the lens array 1420.

Figure 21B:
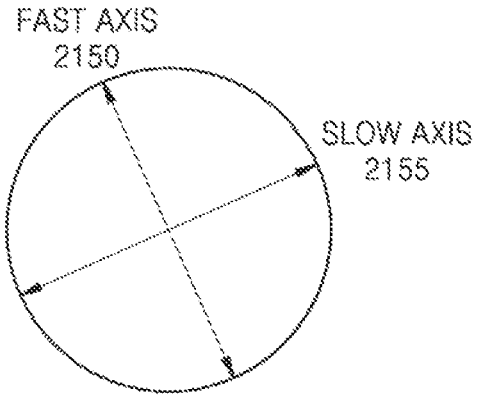
FIG. 21B is a diagram for describing a process of controlling a luminance by an electronic apparatus according to an embodiment of the disclosure.

FIG. 21B illustrates examples of a fast axis and a slow axis of the lens array 1420. According to an embodiment of the disclosure, the lens array 1420 may have the quarter-wave plate feature, and a fast axis 2150 and a slow axis 2155 of the lens array 1420 may be formed as illustrated in FIG. 21B.

Figure 21C:
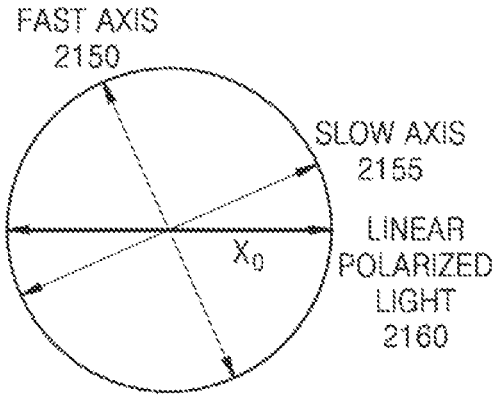
FIG. 21C is a diagram for describing a process of controlling a luminance by an electronic apparatus according to an embodiment of the disclosure.

FIG. 21C illustrates an example of linear polarized light having passed through the first display 1410. According to an embodiment of the disclosure, when all of pieces of light from backlight are pieces of white light, only a component parallel to the orientation of the gap in the first horizontal polarizer 1406 in the first display 1400 among components of the pieces of white light may pass through the first horizontal polarizer 1406. In this case, because the first horizontal polarizer 1406 is not rotated, the linear polarized light 2160 may be linear polarized light having an amplitude $X_0$ and forming an angle of 0° with the X-axis.

Figure 21D:
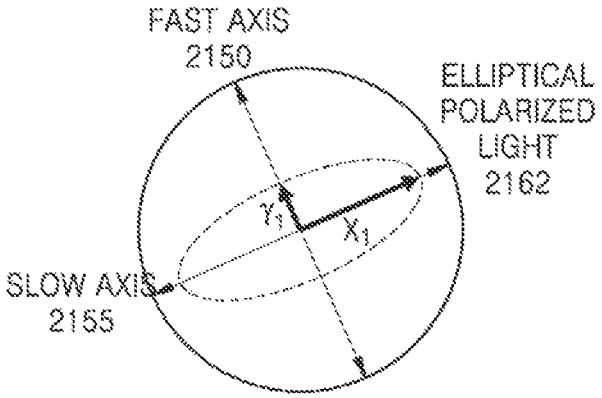
FIG. 21D is a diagram for describing a process of controlling a luminance by an electronic apparatus according to an embodiment of the disclosure.

FIG. 21D illustrates an example of polarized light having passed through the lens array 1420. In an embodiment of the disclosure, when the lens array 1420 has the quarter-wave plate feature, the linear polarized light 2160 may change to elliptical polarized light 2162 when passing through the lens array 1420. For example, the linear polarized light 2160 is not parallel to the fast axis 2150 or the slow axis 2155 of the lens array 1420 and thus may change to the elliptical polarized light 2162 having an amplitude $X_1$ in a direction of the fast axis 2150 and an amplitude $Y_1$ in a direction of the slow axis 2155 when passing through the lens array 1420.

Figure 21E:
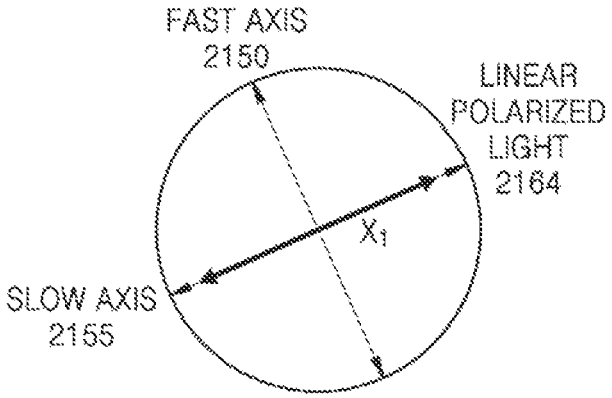
FIG. 21E is a diagram for describing a process of controlling a luminance by an electronic apparatus according to an embodiment of the disclosure.

FIG. 21E illustrates an example of polarized light having passed through the second display 1410 of the electronic apparatus 1200. According to an embodiment of the disclosure, only a component parallel to an orientation of a gap in the second horizontal polarizer 1416 in the second display 1410 among components of linear polarized light having passed through the lens array 1420 may pass through the second horizontal polarizer 1416. In this case, because the orientation of the gap in the second horizontal polarizer 1416 is parallel to the slow axis 1755 of the lens array 1420, the linear polarized light 1764 may be linear polarized light having an amplitude $X_1$ and parallel to the slow axis 2155 of the lens array 1420.

In an embodiment of the disclosure, the difference between the amplitude $X_1$ of the linear polarized light 2164 and the amplitude $X_0$ of the linear polarized light 2160 may be very small. As a result, a degree of reduction in the luminance of the second display 1410 may be minimized due to the birefringence feature of the lens array 1420.

Figure 22:
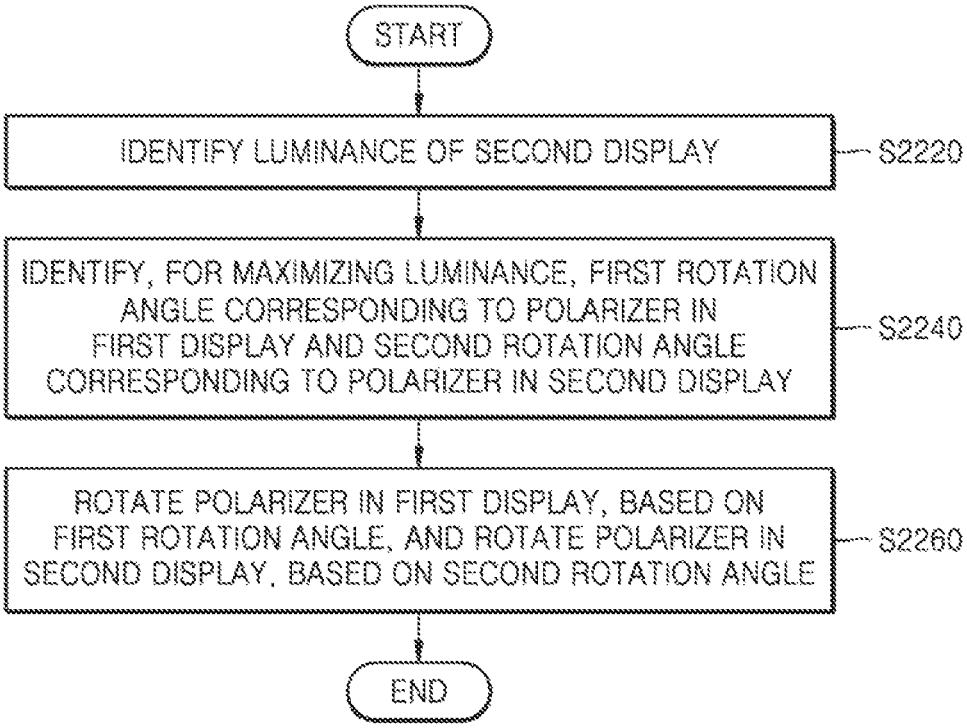
FIG. 22 is a flowchart of a process of controlling a luminance by an electronic apparatus according to an embodiment of the disclosure.

FIG. 22 is a flowchart of a process of controlling a luminance by an electronic apparatus according to an embodiment of the disclosure.

In operation S2220, the electronic apparatus may identify a luminance of a second display.

In operation S2240, the electronic apparatus may identify, for maximizing the luminance of the second display, a first rotation angle corresponding to a polarizer in a first display and a second rotation angle corresponding to a polarizer in the second display.

According to an embodiment of the disclosure, the electronic apparatus may rotate a lens array, and identify the first rotation angle and the second rotation angle, based on a rotation angle of the lens array.

According to an embodiment of the disclosure, the electronic apparatus may identify a rotation angle of the polarizer in the second display without rotating the polarizer in the first display. For example, the electronic apparatus may identify a second rotation angle of the polarizer in the second display for maximizing the luminance of the second display while a first rotation angle of the polarizer in the first display is fixed to 0°.

In operation S2260, the electronic apparatus may rotate the polarizer in the first display, based on the first rotation angle, and rotate the polarizer in the second display, based on the second rotation angle.

In an embodiment of the disclosure, when the lens array has the quarter-wave plate feature, orientations of gaps in the polarizers in the first and second displays may be parallel to a fast or slow axis of the lens array as the polarizers in the first and second displays are rotated.

In an embodiment of the disclosure, when the lens array has the half-wave plate feature, the first rotation angle corresponding to the polarizer in the first display may have a certain value. In addition, as the polarizer in the second display is rotated by the second rotation angle, the orientation of the gap in the second display may be parallel to the fast or slow axis of the lens array.

While embodiments have been described with reference to the figures, it will be understood by those of ordinary skill in the art that various changes in form and details may be made therein without departing from the spirit and scope as defined by the following claims and their equivalents.

What is claimed is:

1. An electronic apparatus comprising:

a first display;

a second display;

a lens array provided between the first display and the second display;

a first polarization modulation array provided between the first display and the lens array;

a second polarization modulation array provided between the lens array and the second display;

a memory configured to store at least one instruction; and at least one processor configured to execute the at least one instruction to:

identify a first area in the second display, the first area having a luminance lower than a reference luminance;

identify, to control a first luminance of the first area in the second display to be the reference luminance, a first polarization angle variation corresponding to a first area in the first polarization modulation array and a second polarization angle variation corresponding to a first area in the second polarization modulation array;

control the first polarization modulation array based on the first polarization angle variation; and control the second polarization modulation array based on the second polarization angle variation.

2. The electronic apparatus of claim 1, wherein the at least one processor is further configured to:

identify a second luminance of a reference area in the second display;

identify, to maximize the second luminance, a third polarization angle variation corresponding to a reference area in the first polarization modulation array and a fourth polarization angle variation corresponding to a reference area in the second polarization modulation array;

control the first polarization modulation array based on the third polarization angle variation; and control the second polarization modulation array based on the fourth polarization angle variation.

3. The electronic apparatus of claim 2, wherein the reference luminance is a maximum value of the second luminance.

4. The electronic apparatus of claim 2, wherein, to identify the third polarization angle variation and the fourth polarization angle variation, the at least one processor is further configured to:

obtain a difference value between a luminance of a reference area in the first display and the second luminance; and identify the third polarization angle variation and the fourth polarization angle variation to minimize the difference value.

5. The electronic apparatus of claim 2, wherein the third polarization angle variation and the fourth polarization angle variation are equal to an angle of a fast axis or an angle of a slow axis of the lens array with respect to an X-axis, the X-axis being a horizontal axis.

6. The electronic apparatus of claim 2, further comprising:

a camera configured to identify the second luminance, wherein the at least one processor is further configured to identify the second luminance based on changing a viewing angle of the camera.

7. The electronic apparatus of claim 1, wherein the first area comprises one or more subpixels.

8. The electronic apparatus of claim 1, wherein the at least one processor is further configured to:

control a rotation angle of the lens array; and identify the first polarization angle variation and the second polarization angle variation based on the rotation angle of the lens array.

9. A method performed by an electronic apparatus, the method comprising:

identifying a first area in a second display of the electronic apparatus, the first area having a luminance lower than a reference luminance;

identifying, to control a first luminance of the first area in the second display to be the reference luminance, a first polarization angle variation corresponding to a first area in a first polarization modulation array of the electronic apparatus and a second polarization angle variation corresponding to a first area in a second polarization modulation array of the electronic apparatus;

controlling the first polarization modulation array based on the first polarization angle variation; and controlling the second polarization modulation array based on the second polarization angle variation.

10. The method of claim 9, further comprising:

identifying a second luminance of a reference area in the second display;

identifying, to maximize the second luminance, a third polarization angle variation corresponding to a reference area in the first polarization modulation array and a fourth polarization angle variation corresponding to a reference area in the second polarization modulation array;

controlling the first polarization modulation array based on the third polarization angle variation; and controlling the second polarization modulation array based on the fourth polarization angle variation.

11. The method of claim 10, wherein the reference luminance is a maximum value of the second luminance.

12. The method of claim 10, wherein the identifying of the third polarization angle variation and the fourth polarization angle variation comprises:

identifying a difference value between a luminance of a reference area in a first display of the electronic apparatus and the second luminance; and identifying the third polarization angle variation and the fourth polarization angle variation to minimize the difference value.

13. The method of claim 10, wherein the third polarization angle variation and the fourth polarization angle variation are equal to an angle of a fast axis or a slow axis of a lens array of the electronic apparatus with respect to an X-axis, the X-axis being a horizontal axis.

14. The method of claim 10, wherein the identifying of the second luminance comprises:

identifying the second luminance based on changing a viewing angle of a camera of the electronic apparatus.

15. The method of claim 9, further comprising controlling a rotation angle of a lens array of the electronic apparatus, wherein the identifying of the first polarization angle variation and the second polarization angle variation is based on the rotation angle of the lens array.

16. A non-transitory computer-readable recording medium storing a program that is executed by a processor of an electronic device to perform a method comprising:

identifying a first area in a second display of the electronic apparatus, the first area having a luminance lower than a reference luminance;

identifying, to control a first luminance of the first area in the second display to be the reference luminance, a first polarization angle variation corresponding to a first area in a first polarization modulation array of the electronic apparatus and a second polarization angle variation corresponding to a first area in a second polarization modulation array of the electronic apparatus;

controlling the first polarization modulation array based on the first polarization angle variation; and controlling the second polarization modulation array based on the second polarization angle variation.

17. An electronic apparatus comprising:

a first display;

a second display;

a lens array provided between the first display and the second display;

a memory configured to store at least one instruction; and at least one processor configured to execute the at least one instruction to:

identify a luminance of the second display;

identify, to maximize the luminance, a first rotation angle corresponding to a first polarizer included in the first display and a second rotation angle corresponding to a second polarizer included in the second display;

rotate the first polarizer based on the first rotation angle; and rotate the second polarizer based on the second rotation angle.

18. The electronic apparatus of claim 17, wherein the at least one processor is further configured to:

rotate the lens array; and identify the first rotation angle and the second rotation angle based on a rotation angle of the lens array.

19. A method performed by an electronic apparatus, the method comprising:

identifying a luminance of a second display of the electronic apparatus;

identifying, to maximize the luminance, a first rotation angle corresponding to a first polarizer included in a first display of the electronic apparatus and a second rotation angle corresponding to a second polarizer included in the second display;

rotating the first polarizer based on the first rotation angle; and rotating the second polarizer based on the second rotation angle.

20. The method of claim 19, further comprising:

rotating a lens array of the electronic apparatus, wherein the identifying of the first rotation angle and the second rotation angle is based on a rotation angle of the lens array.

* * * * *